US010408550B2

(12) United States Patent
Murase et al.

(10) Patent No.: US 10,408,550 B2
(45) Date of Patent: Sep. 10, 2019

(54) HEAT EXCHANGER, AND FIN MATERIAL FOR SAID HEAT EXCHANGER

(71) Applicant: UACJ Corporation, Tokyo (JP)

(72) Inventors: Takashi Murase, Tokyo (JP); Kotaro Kitawaki, Tokyo (JP); Tomohito Kurosaki, Tokyo (JP); Junji Ninomiya, Tokyo (JP)

(73) Assignee: UACJ Corporation, Tokyo (JP)

( * ) Notice: Subject to any disclaimer, the term of this patent is extended or adjusted under 35 U.S.C. 154(b) by 365 days.

(21) Appl. No.: 14/895,204

(22) PCT Filed: Jun. 2, 2014

(86) PCT No.: PCT/JP2014/002909
§ 371 (c)(1),
(2) Date: Dec. 1, 2015

(87) PCT Pub. No.: WO2014/196183
PCT Pub. Date: Dec. 11, 2014

(65) Prior Publication Data

US 2016/0116234 A1 Apr. 28, 2016

(30) Foreign Application Priority Data

Jun. 2, 2013 (JP) ..... 2013-116547

(51) Int. Cl.
*F28F 21/08* (2006.01)
*C22C 21/00* (2006.01)
(Continued)

(52) U.S. Cl.
CPC ..... *F28F 21/084* (2013.01); *B22D 11/003* (2013.01); *B22D 11/0622* (2013.01);
(Continued)

(58) Field of Classification Search
CPC ..... B23K 20/00; B23K 20/16
(Continued)

(56) References Cited

U.S. PATENT DOCUMENTS 6,669,534 B2 * 12/2003 Shirzadi Ghoshouni ..... B24B 1/00 451/28
2003/0015573 A1 1/2003 Kawahara et al.

FOREIGN PATENT DOCUMENTS

EP 2017032 1/2009
EP 2787094 10/2014
(Continued)

OTHER PUBLICATIONS

Gale, "Applying TLP Bonding to the Joining of Structural Intermetallic Compounds", Feb. 1999, JOM pp. 49-52/.*
(Continued)

*Primary Examiner* — Allen J Flanigan
(74) *Attorney, Agent, or Firm* — JCIPRNET

(57) ABSTRACT

There is provided a heat exchanger and a fin material for the heat exchanger that can suppress occurrence of hollow corrosion in a fin and hold cooling performance for a long period of time under a high corrosion environment. The heat exchanger includes an aluminum tube through which a working fluid circulates and an aluminum fin which is bonded to the tube. The fin has a region B around a grain boundary, and a region A around the region B. In the region B, $5.0\times10^4$ pieces/mm$^2$ less of Al—Fe—Mn—Si based intermetallic compound, each of which has equivalent circle diameters of 0.1 to 2.5 μm, are present. In the region A, $5.0\times10^4$ pieces/mm$^2$ to $1.0\times10^7$ pieces/mm$^2$ of Al—Fe—Mn—Si based intermetallic compound, each of which has equivalent circle diameters of 0.1 to 2.5 μm, are present.

10 Claims, 12 Drawing Sheets

AREA s OF REGION B PER UNIT GRAIN BOUNDARY $s = \frac{s1+s2+\cdots+sn}{L1+L2+\cdots+Ln} \times \frac{1}{2}$

DEFINITION OF AVERAGE AREA S OF REGION B PER LENGTH OF GRAIN BOUNDARY

(51) Int. Cl.

| | |
|---|---|
| ***C22F 1/043*** | (2006.01) |
| ***F28F 19/06*** | (2006.01) |
| ***B22D 11/00*** | (2006.01) |
| ***B22D 11/06*** | (2006.01) |
| ***C22C 21/02*** | (2006.01) |
| ***F28F 1/10*** | (2006.01) |
| *F28F 1/12* | (2006.01) |

(52) U.S. Cl.
CPC ..... *C22C 21/00* (2013.01); *C22C 21/02* (2013.01); *C22F 1/043* (2013.01); *F28F 1/10* (2013.01); *F28F 19/06* (2013.01); *F28F 1/12* (2013.01)

(58) Field of Classification Search
USPC ..... 228/195, 196
See application file for complete search history.

(56) References Cited

FOREIGN PATENT DOCUMENTS

| | | | |
|---|---|---|---|
| EP | 2808410 | | 12/2014 |
| EP | 2998412 | | 3/2016 |
| JP | 2006225723 | | 8/2006 |
| JP | 2008-303405 | | 12/2008 |
| JP | 2008-308760 | | 12/2008 |
| JP | 2009-161835 | | 7/2009 |
| JP | 2010-168613 | | 8/2010 |
| JP | 2012-40611 | | 3/2012 |
| JP | 2012-51028 | | 3/2012 |
| JP | 2012040610 | | 3/2012 |
| JP | 2012040610 | A * | 3/2012 |
| JP | 2012051028 | A * | 3/2012 |
| JP | 5021097 | | 9/2012 |
| WO | 9222397 | | 12/1992 |
| WO | 2005066570 | | 7/2005 |
| WO | 2013/080650 | | 6/2013 |
| WO | 2013/111884 | | 8/2013 |

OTHER PUBLICATIONS

Shirzadi et al., "Interface evolution and bond strength when diffusion bonding materials with stable oxide films", 2001 Surface and Interface Analysis 31: 609-618.*

Shirzadi and Wallach, "Analytical Modeling of Transient Liquid Phase (TLP) Diffusion Bonding When a Temperature Gradient Is Imposed" 1999, Acta Metallurgica Inc. vol. 47, No. 13, pp. 3551-3560.*

"International Search Report (Form PCT/ISA/210) of PCT/JP2014/002909", dated Jul. 22, 2014, with English translation thereof, pp. 1-4.

"Aluminum brazing Handbook (Revised edition)", Japan Light Metal Welding and Construction Association, Jan. 2003, with English summary thereof.

"Office Action of Japanese Counterpart Application," dated Jul. 17, 2014, p. 1-p. 5, with partial English translation thereof.

"Search Report of Europe Counterpart Application", dated Aug. 29, 2016, p. 1-p. 12, in which the listed references were cited.

"Office Action of Europe Counterpart Application", dated Oct. 15, 2018, p. 1-p. 13.

* cited by examiner

SCHEMATIC DIAGRAM ILLUSTRATING STRUCTURE AND CORROSION PROGRESS OF FIN IN HEAT EXCHANGER ACCORDING TO THE PRESENT INVENTION

AREA s OF REGION B PER UNIT GRAIN BOUNDARY $$s = \frac{s1 + s2 + \cdots + sn}{L1 + L2 + \cdots + Ln} \times \frac{1}{2}$$

DEFINITION OF AVERAGE AREA S OF REGION B PER LENGTH OF GRAIN BOUNDARY

SHAPE OF HEAT EXCHANGER ACCORDING TO THE PRESENT INVENTION a IS OBTAINED AS RATIO OF SUMMATION (a1 to an) OF LENGTHS OF SURFACE LAYER IN REGION A, TO LENGTH (2M) OF ENTIRE SURFACE IN CROSS-SECTION BY CROSS-SECTION OBSERVATION $$a = \frac{a1 + a2 + \cdots + an}{2M}$$

DEFINITION OF AREA OCCUPANCY RATIO a OF REGION A IN SURFACE LAYER OF FIN

DETERMINE WHETHER OR NOT CORROSION OF SIZE INTO WHICH GUIDE IS INSERTED IS PRESENT IN CROSS-SECTION OF SAMPLE (a) CORROSION C
CORROSION INTO WHICH GUIDE OF L150 μm x t70 μm IS INSERTED IS PRESENT (b) CORROSION B
CORROSION INTO WHICH GUIDE OF L150 μm x t30 μm IS INSERTED IS PRESENT

DETERMINING METHOD OF HOLLOW CORROSION

SCHEMATIC DIAGRAM OF STRUCTURE AND CORROSION PROGRESS OF FIN (CLAD FIN) IN HEAT EXCHANGER OF THE RELATED ART

DETERMINING METHOD FOR REGION B COMING INTO CONTACT WITH GRAIN BOUNDARY, ON SURFACE $$T = \frac{t}{(n1 + n2 + \cdots + n10) \div 10}$$

MEASUREMENT EXAMPLE:n1, n5, n6, n7=ONE n2, n3, n4, n8, n9, n10=TWO

THE NUMBER OF GRAINS OF Al MATRIX IN L-ST CROSS-SECTION

DEFINITION OF REGION A AND REGION B ON SURFACE

HEAT EXCHANGER, AND FIN MATERIAL FOR SAID HEAT EXCHANGER

CROSS-REFERENCE TO RELATED APPLICATION

This application is a 371 application of the International PCT application serial no. PCT/JP2014/002909, filed on Jun. 2, 2014, which claims the priority benefit of Japan Patent Application no. 2013-116547, filed on Jun. 2, 2013. The entirety of each of the above-mentioned patent applications is hereby incorporated by reference herein and made a part of this specification.

TECHNICAL FIELD

The present invention relates to a heat exchanger that suppresses degradation of cooling performance under a high corrosion environment, and a fin material used in the heat exchanger, more particularly, to a heat exchanger for a room air-conditioner and a heat exchanger for a car air-conditioner, and a fin material used in these heat exchangers.

BACKGROUND ART

An aluminum alloy heat exchanger which is formed of aluminum alloy and has a good lightweight and good thermal conduction is widely used, for example, in a condenser and an evaporator for a room air-conditioner; a condenser, an evaporator, a radiator, a heater, an intercooler, an oil cooler, and the like for a vehicle. The aluminum alloy heat exchanger is normally configured by bonding a fin material and a tube material (constituent of a working fluid passage).

As a bonding method of an aluminum alloy material, various methods have been known. However, a brazing method is used much among the methods. The reason of using the brazing method much is because an advantage, for example, in that strong bonding for a short period of time is obtained without melting of a matrix is considered. As a method of manufacturing the aluminum alloy heat exchanger using the brazing method, the following methods have been known (PTL 1 to PTL 3): a method of using a brazing sheet obtained by cladding a brazing filler material formed of an Al—Si alloy; a method of using an extrusion material on which brazing filler material powder is applied; a method in which materials are combined, and then another brazing filler material is applied on a portion at which bonding is required; and the like. Details of the clad brazing sheet or the brazing filler material powder are described in "3.2 wax and brazing sheet" of NPL 1.

In brazing of the fin material and the tube material, when a single-layer fin material is used, a method of using a brazing sheet obtained by cladding a brazing filler material on the tube material, or a method of individually coating the tube material with a Si powder, a Si-containing wax, or a Si-containing flux is employed. When a single-layer tube material is used, a method of using a brazing sheet obtained by cladding a brazing filler material on the fin material is employed.

In this manner, a material obtained by forming a construction derived from a wax on a surface of at least one of the fin material and the tube material is used in manufacturing of a heat exchanger using brazing. For example, in a heat exchanger manufactured by using a single-layer fin material, a portion of a surface of a tube, at which a eutectic structure derived from a wax exists, appears. This portion serves as a cathode site, accelerates progress of corrosion in a tube, and thus leakage of a refrigerant occurs early.

As a heat exchanger used under a high corrosion environment, a heat exchanger which prevents a leakage of a refrigerant by using a clad fin material in such a manner that a eutectic structure is not formed on a surface of a tube by using a wax is considered.

PTL 4 discloses a method of using a single-layer brazing sheet instead of the above-described brazing sheet of a clad material, in order to omit a process of manufacturing a brazing sheet or a process of manufacturing and applying a brazing filler material powder. In this method, it has been proposed that a single-layer brazing sheet for a heat exchanger is used in a tube material and a tank member of a heat exchanger.

PTL 5 discloses a bonding method that obtains well bonding and causes deformation to hardly occur by controlling an alloy composition, a temperature in bonding, pressing, a surface status, and the like in a method of manufacturing a bonding object by using a single-layer aluminum alloy material.

PTL 6 discloses that high corrosion-resistant bonding object is obtained by controlling components of one aluminum alloy material and a pitting potential difference in a structure of the one aluminum alloy material in a bonding object bonded without using a bonding member.

In a case of a heat exchanger obtained by combining a tube material in which a wax is not included on a surface, and a clad fin material, a tube may obtain high corrosion resistance, but corrosion in a fin may be in progress, and thus sufficient cooling performance may not be obtained early. Particularly, there is a problem of often occurrence of corrosion that one thin film remains on a surface of the fin and a core portion on the inside is dissolved (referred to as "hollow corrosion" below).

Such hollow corrosion occurs due to a fin of a heat exchanger having a structure as in a schematic diagram illustrated in FIG. 8(*a*). That is, the heat exchanger has a layer in which an Al matrix (region A) and an Al matrix (region B) are provided. In the Al matrix (region A), a fine Al—Fe—Mn—Si based intermetallic compound is dispersed at a core portion. In the Al matrix (region B), the fine Al—Fe—Mn—Si based intermetallic compound does not exist on a surface. High-concentration Si is provided at a grain boundary of the core portion by surrounding matrices. In this structure, corrosion occurs easiest at the grain boundary having a high-concentration Si portion which is a strong cathode. Thus, intergranular corrosion occurs at an early stage (FIG. 8(*b*)). The next easiest corrosion-occurrence portion is the region A of the Al matrix in which the fine Al—Fe—Mn—Si based intermetallic compound is dispersed. This is because the fine Al—Fe—Mn—Si based intermetallic compound dispersed in the Al matrix acts as a cathode and the surrounding Al matrices are dissolved. For this reason, corrosion may occur easier in the region A than in the layer (region B) of a surface which is not the portion acting as the cathode, and of inside corrosion may be in progress (FIG. 8 (*c*)). In a case of such a state, there is a problem that even though a shape of the fin is ensured seemingly, heat performance is greatly degraded by a hollow portion which occurs due to hollow corrosion.

In order to prevent occurrence of hollow corrosion in the fin, a method of replacing a material of a member as disclosed in PTL 4 and PTL 6 with a fin material is considered. However, even though the material disclosed in these literatures is used simply as the fin material, holding of a shape of the fin in the heat exchanger is impossible and buckling occurs in bonding. Thus, there is a problem that manufacturing of a heat exchanger by using these is impossible.

CITATION LIST

Patent Literature

[PTL 1] JP-A-2008-303405
[PTL 2] JP-A-2009-161835
[PTL 3] JP-A-2008-308760
[PTL 4] JP-A-2010-168613
[PTL 5] Japanese Patent No. 5021097
[PTL 6] JP-A-2012-40611

Non Patent Literature

[NPL 1] "Aluminum brazing Handbook (Revised edition)" Japan Light Metal Welding and Construction Association, 2003

SUMMARY OF INVENTION

Technical Problem

As a result of close investigation for solving the above problems, there is provided a heat exchanger and a fin material for the heat exchanger that can suppress occurrence of hollow corrosion in a fin and hold cooling performance for a long period of time under a high corrosion environment by controlling a structure of a heat exchanger.

Solution to Problem

In the invention, claim 1 is directed to a heat exchanger that includes an aluminum tube through which a working fluid circulates and an aluminum fin which is bonded to the tube. The fin has a region B around a grain boundary and a region A around the region B. In the region B, $5.0\times10^4$ pieces/mm$^2$ less of Al—Fe—Mn—Si based intermetallic compound, each of which has equivalent circle diameters of 0.1 to 2.5 μm, are present. In the region A, $5.0\times10^4$ pieces/mm$^2$ to $1.0\times10^7$ pieces/mm$^2$ of Al—Fe—Mn—Si based intermetallic compound, each of which has equivalent circle diameters of 0.1 to 2.5 μm, are present.

In the invention, claim 2 is directed to claim 1, in which an average area of the region B per a length of the grain boundary is set as s μm and satisfies $2<s<40$.

In the invention, claim 3 is directed to claim 1 or 2, in which an area occupancy ratio of the region A on a surface of the fin is equal to or more than 60%.

In the invention, claim 4 is directed to any one of claims 1 to 3, in which an Al—Si eutectic structure is not on the surface of the tube other than a bonding-portion fillet.

In the invention, claim 5 is directed to any one of claims 1 to 4, in which when a grain size of an Al matrix in an L-LT cross-section of the fin is set as L μm, and a grain size of an Al matrix in an L-ST cross-section of the fin is set as T μm, $L\geq100$ and $L/T\geq2$.

In the invention, claim 6 is directed to any one of claims 1 to 5, in which a natural potential of the fin is equal to or greater than −910 mV, and the natural potential of the fin is nobler than a natural potential of a fillet at a bonding portion of the fin and tube by 0 mV to 200 mV.

In the invention, claim 7 is directed to a fin material for a heat exchanger having a heat bonding ability with a single layer according to any one of claims 1 to 6. The fin material comprises an aluminum alloy containing Si:1.0 mass % to 5.0 mass %, Fe:0.1 mass % to 2.0 mass %, Mn:0.1 mass % to 2.0 mass % with balance being Al and inevitable impurities. In the fin material, 250 pieces/mm$^2$ to $7\times10^4$ pieces/mm$^2$ of Si based intermetallic compound, each of which has equivalent circle diameters of 0.5 to 5 μm, are present, and 10 pieces/mm$^2$ to 1000 pieces/mm$^2$ of Al—Fe—Mn—Si based intermetallic compound, each of which has equivalent circle diameters of greater than 5 are present.

In the invention, claim 8 is directed to claim 7, in which the aluminum alloy further contains one or more types selected from among Mg:2.0 mass % or less, Cu:1.5 mass % or less, Zn:6.0 mass % or less, Ti:0.3 mass % or less, V:0.3 mass % or less, Zr:0.3 mass % or less, Cr:0.3 mass % or less and Ni:2.0 mass % or less.

In the invention, claim 9 is directed to a fin material for a heat exchanger having a heat bonding ability with a single layer according to any one of claims 1 to 6. The fin material comprises an aluminum alloy containing Si:1.0 mass % to 5.0 mass % and Fe:0.01 mass % to 2.0 mass % with balance being Al and inevitable impurities including Mn. In the fin material, 250 pieces/mm$^2$ to $7\times10^5$ pieces/mm$^2$ of Si based intermetallic compound, each of which has equivalent circle diameters of 0.5 to 5 μm, are present, and 100 pieces/mm$^2$ to $7\times10^5$ pieces/mm$^2$ of Al—Fe—Mn—Si based intermetallic compound, each of which has equivalent circle diameters of 0.5 to 5 μm, are present.

In the invention, claim 10 is directed to claim 9, in which the aluminum alloy further contains one or more selected from among Mn:2.0 mass % or less, Mg:2.0 mass % or less, Cu:1.5 mass % or less, Zn:6.0 mass % or less, Ti:0.3 mass % or less, V:0.3 mass % or less, Zr:0.3 mass % or less, Cr:0.3 mass % or less and 2.0 mass % or less of Ni.

In the invention, claim 11 is directed to a fin material for a heat exchanger having a heat bonding ability with a single layer according to any one of claims 1 to 6. The fin material comprises an aluminum alloy containing Si:1.0 mass % to 5.0 mass % and Fe:0.01 mass % to 2.0 mass % with balance being Al and inevitable impurities including Mn. In the fin material, wherein 200 pieces/mm$^2$ less of Si based intermetallic compound, each of which has equivalent circle diameters of 5.0 to 10 μm, are present, and 10 pieces/mm$^2$ to $1\times10^4$ pieces/μm$^3$ of Al—Fe—Mn—Si based intermetallic compound, each of which has equivalent circle diameters of 0.01 to 0.5 μm, are present.

In the invention, claim 12 is directed to claim 11, in which the aluminum alloy further contains one or more selected from among Mn:0.05 mass % to 2.0 mass %, Mg:0.05 mass % to 2.0 mass %, Cu:0.05 mass % to 1.5 mass %, Zn:6.0 mass % or less, Ti:0.3 mass % or less, V:0.3 mass % or less, Zr:0.3 mass % or less, Cr:0.3 mass % or less and Ni:2.0 mass % or less.

Advantageous Effects of Invention

It is possible to provide a heat exchanger and a fin material for the heat exchanger that can suppress occurrence of hollow corrosion in a fin and hold cooling performance for a long period of time under a high corrosion environment.

DESCRIPTION OF EMBODIMENTS

Hereinafter, the present invention will be described in detail.

Figure 1:
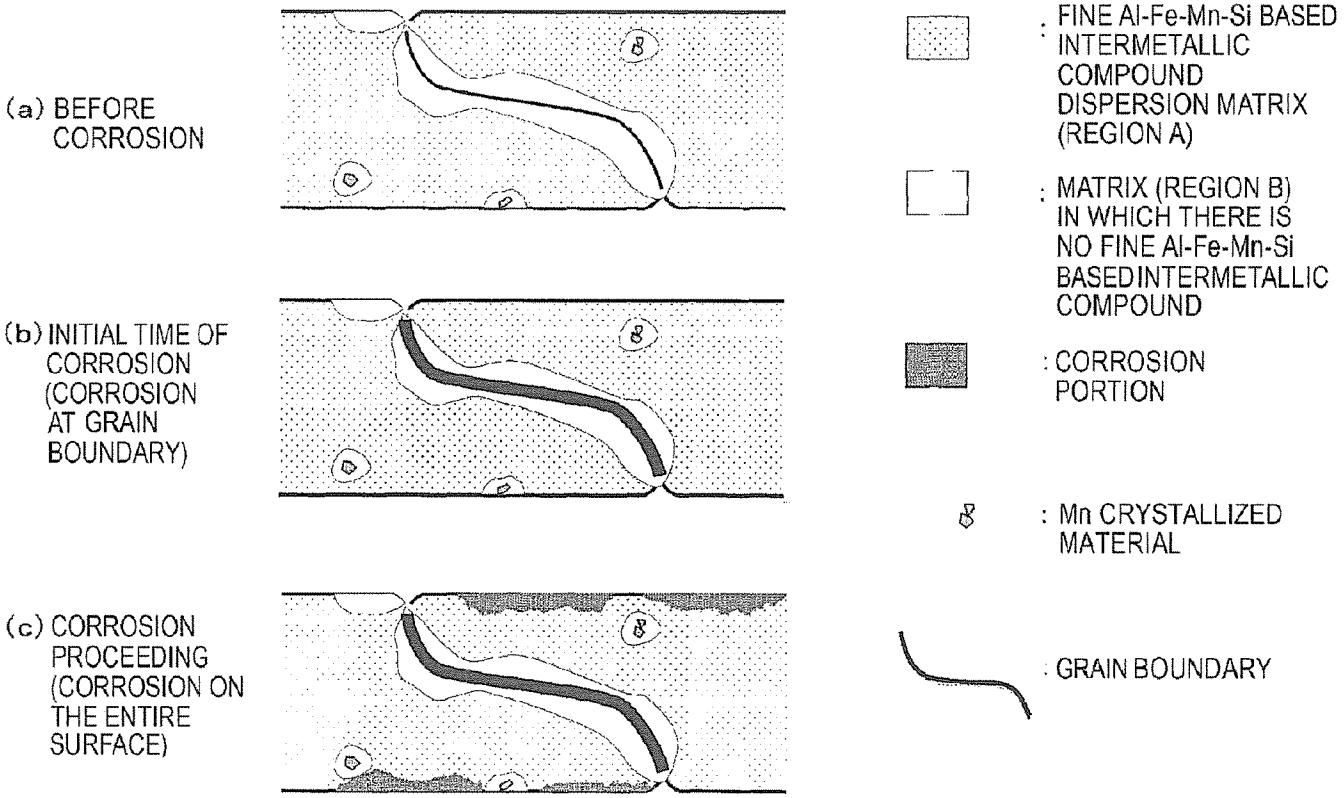
FIG. 1 is a schematic diagram illustrating a structure and corrosion progress of a fin in a heat exchanger according to the present invention.
Figure 8:
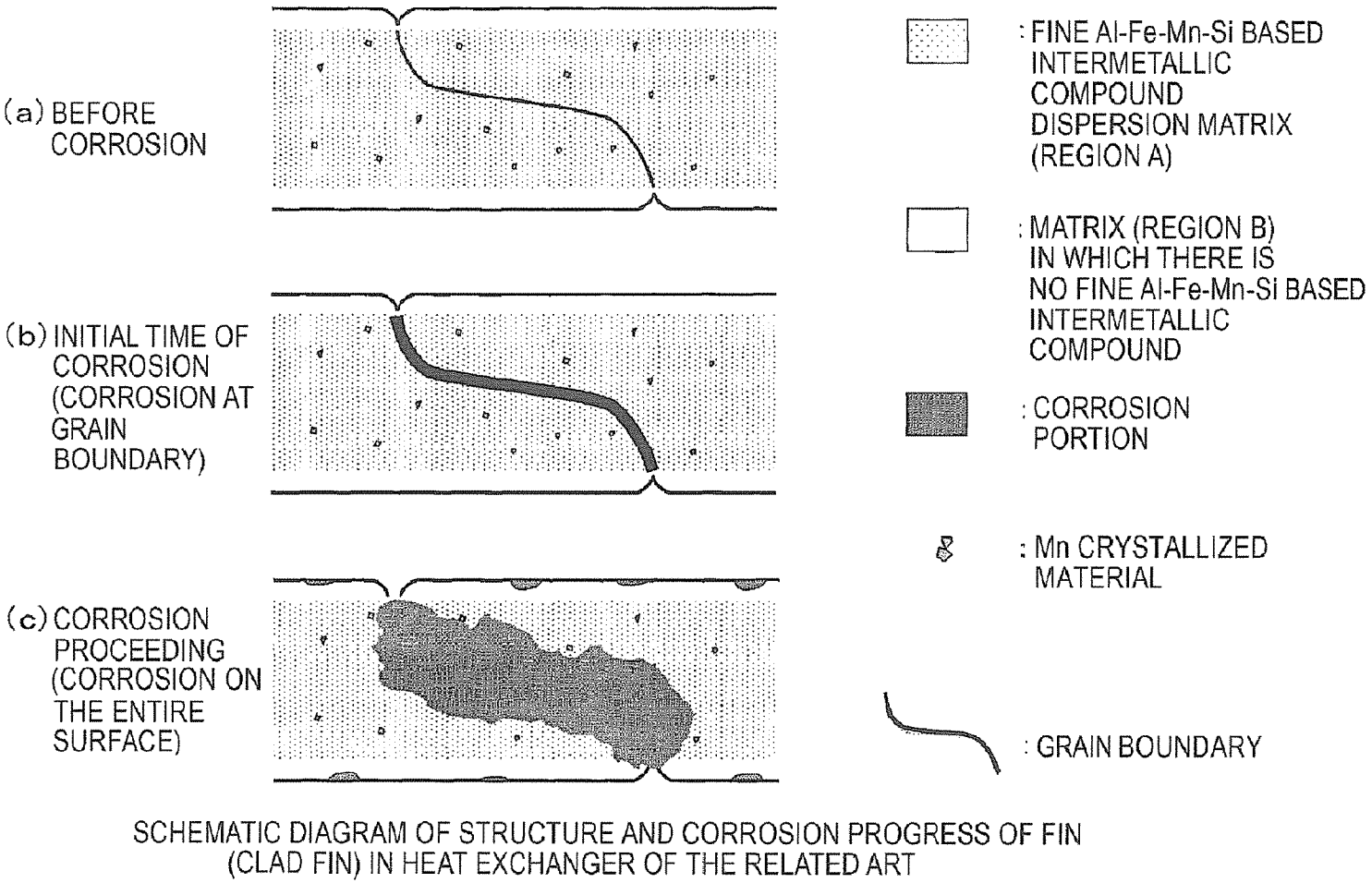
FIG. 8 illustrates a structure and corrosion progress of a fin (clad fin) in a heat exchanger of the related art.

1. Number Density of Al—Fe—Mn—Si Based Intermetallic Compound in Regions A and B A heat exchanger according to the present invention has self-corrosion resistance of a fin, particularly, suppresses hollow corrosion by controlling a material used in manufacturing and a structure of the fin. FIG. 1(*a*) illustrates a schematic diagram of a cross-section structure of a fin in the heat exchanger according to the present invention. A matrix (referred to as a "region A" below) in which fine Al—Fe—Mn—Si based intermetallic compound having an equivalent circle diameter of 0.1 μm to 2.5 μm are dispersed is present from a surface to the inside of the fin. The matrix (region A) functions as a cathode. A region (referred to as a "region B" below) in which the fine Al—Fe—Mn—Si based intermetallic compound are hardly dispersed is present around a grain boundary of the matrix. In these structures, corrosion occurs easily in an order from the vicinity of the grain boundary, the region A, and the region B (corrosion occurs easiest in the vicinity of the grain boundary, and occurrence of corrosion is the most difficult at the region B), similarly to a structure in FIG. 8. Thus, in the fin of the heat exchanger according to the present invention, corrosion occurs at first in the vicinity of the grain boundary under a corrosion environment (FIG. 1(*b*)). However, since the region B in which proceeding of corrosion is difficult is present on the outside of the vicinity thereof. Thus, proceeding of corrosion from the vicinity of the grain boundary toward the inside of the matrix is prevented. The region A in which corrosion occurs easier than in the region B is present on the surface and corrosion proceeds from the surface (FIG. 1(*c*)). In the region A, an Al—Fe—Mn—Si based intermetallic compound functions as a cathode and fine Al—Fe—Mn—Si based intermetallic compound are dispersed. Thus, preferential proceeding of corrosion in a thickness direction is prevented and corrosion occurs over the entirety of the matrix in three dimensions. Accordingly, in the fin of the heat exchanger according to the present invention, intergranular corrosion occurs and then corrosion proceeds overall from the surface in the region A, but hollow corrosion in the fin as in the heat exchanger of the related art which uses a brazing clad material for the fin does not occur.

In the fin in the heat exchanger according to the present invention, dispersion status of the intermetallic compound in the region A and the region B will be described below in detail. In the region A, Al—Fe—Mn—Si based intermetallic compound which have an equivalent circle diameter of 0.1 μm to 2.5 μm and have a number density of $5.0\times10^4$ pieces/mm$^2$ to $1.0\times10^7$ pieces/mm$^2$ are present. The Al—Fe—Mn—Si based intermetallic compound is crystal deposits of an intermetallic compound generated by combining Al and an addition element. Specific examples of the Al—Fe—Mn—Si based intermetallic compound include intermetallic compounds of Al—Fe, Al—Mn, Al—Fe—Si, Al—Mn—Si, Al—Fe—Mn, Al—Fe—Mn—Si, and the like.

In the region A, fine Al—Fe—Mn—Si based intermetallic compound which function as a cathode are dispersed so as to be separated from each other. Thus, corrosion does not proceed preferentially in one direction, and proceeds with overall uniform. For this reason, corrosion occurs easier than in the region B, but overall corrosion occurs and corrosion which causes heat dissipation performance to be drastically deteriorated does not occur.

When the number density is less than $5.0\times10^4$ pieces/mm$^2$ in the region A, the Al—Fe—Mn—Si based intermetallic compound is not stable and does not act as a cathode. In addition, if corrosion occurs, the corrosion does not proceed overall. Corrosion occurs in this region A easier than in the region B. When the number density exceeds $1.0\times10^7$ pieces/mm$^2$, the Al—Fe—Mn—Si based intermetallic compound which function as a cathode are too much and a lytic reaction proceeds, and thus overall corrosion may excessively proceed.

Regarding the number density of the Al—Fe—Mn—Si based intermetallic compound particles in the region A, a reason of limiting the equivalent circle diameter to being from 0.1 μm to 2.5 μm is as follows. When the equivalent circle diameter is less than 0.1 μm, since the particle size is too small and does not act as an effective cathode, such an intermetallic compound is excluded. When the equivalent circle diameter is greater than 2.5 μm, the intermetallic compound acts as a cathode. Corrosion occurs easily at a matrix portion coming into contact with the intermetallic compound, but the corrosion does not proceed uniformly. Accordingly, such an intermetallic compound is also excluded.

In the region B, Al—Fe—Mn—Si based intermetallic compound having an equivalent circle diameter of 0.1 μm to 2.5 μm are less than $5.0\times10^4$ pieces/mm$^2$ in number density. In this case, since the Al—Fe—Mn—Si based intermetallic compound which functions as the cathode is hardly present in the region B, proceeding of corrosion is more difficult than in the region A. For this reason, when the region A and the region B are present so as to be adjacent to each other in the same member, corrosion occurs preferentially in the region A.

When the number density is equal to or more than $5.0\times10^4$ pieces/mm$^2$ in the region B, the region B serves as the region A. Thus, even though such a structure is present around the grain boundary, working of an action of preventing proceeding of corrosion from the grain boundary toward the inside of the matrix is impossible. The number density includes a case of 0 piece/$mm^2$.

Regarding the number density of the Al—Fe—Mn—Si based intermetallic compound in the region B, a reason of limiting the equivalent circle diameter to being from 0.1 μm to 2.5 μm is as follows. When the equivalent circle diameter is less than 0.1 since the particle size is too small, it does not act as an effective cathode, and there is no influence on an corrosion suppression action of the region B, such an intermetallic compound is excluded. When the equivalent circle diameter is greater than 2.5 μm, such an intermetallic compound is excluded for the same reason as in the region A.

The number density of Al—Fe—Mn—Si based intermetallic compound in the regions A and B is a number density in a certain cross-section of an aluminum alloy material. For example, the certain cross-section may be a cross-section taken along the thickness direction or a cross-section parallel with a surface of a sheet material. From a viewpoint of simplicity in material evaluation, the cross-section along the thickness direction is preferably employed.

2. Average Area s Gm of Region B Per Length of Grain Boundary

Figure 2:
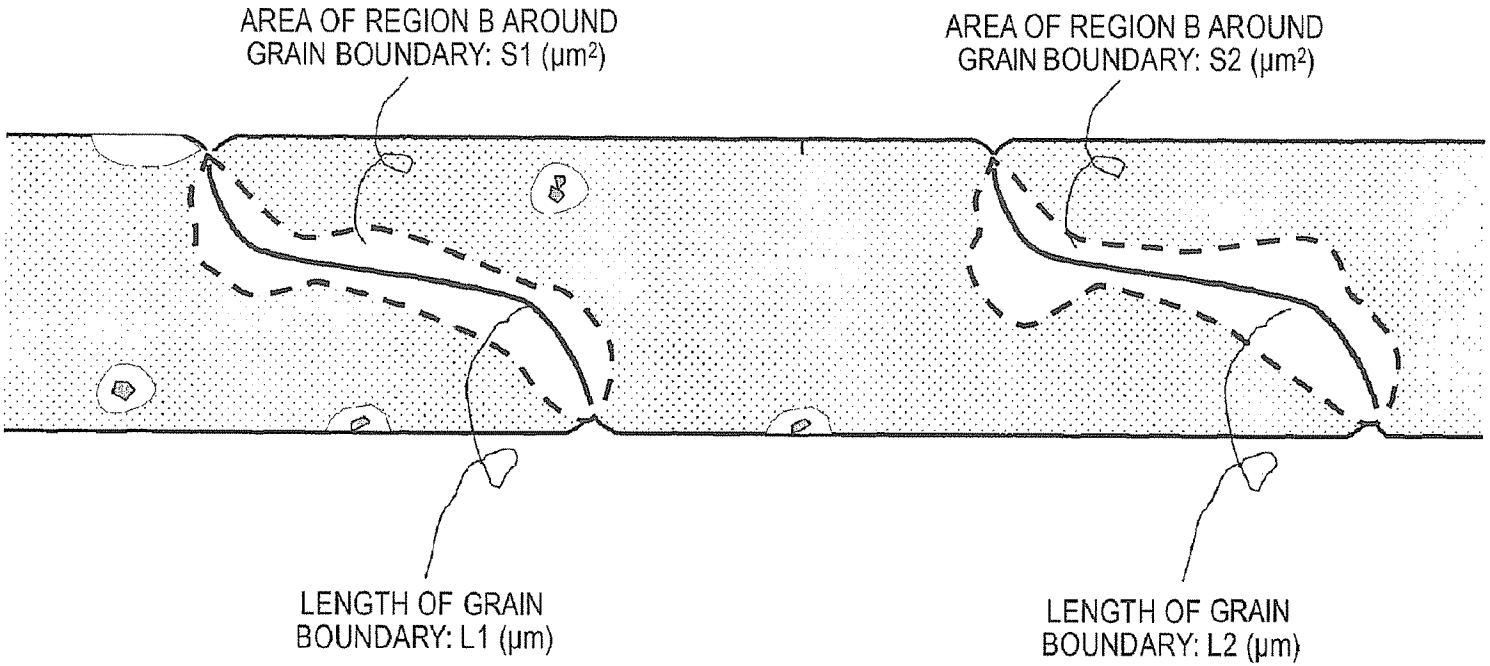
FIG. 2 is a diagram illustrating an average area s of a region B per a length of a grain boundary.

In the fin of the heat exchanger according to the present invention, when an average area of the region B per a length of the grain boundary is set as s μm, s preferably satisfies $2<s<40$. As illustrated in FIG. 2, s is obtained by measuring a cross-section structure of the fin. That is, s is obtained by measuring the total length (L1+L2+ . . . +Ln) of the grain boundary and the total area (s1+s2+ . . . +sn) of the region B coming into contact with the grain boundary in a fin cross-section of a predetermined visual field and using an expression of $s=\{(s1+s2+\ldots+sn)/(L1+L2+\ldots+Ln)\}\times(1/2)$. The predetermined visual field is desired to be a visual field of at least 0.1 $mm^2$ or more.

When the average area s μm is less than 2 μm, sufficient suppression of proceeding of corrosion is impossible and corrosion proceeds toward the dispersion region A in particles, and thus hollow corrosion may occur. When the average area s μm is greater than 40 μm, since the region A in which fine intermetallic compound functioning as a cathode are dispersed is not present in the vicinity, fitting corrosion in the thickness direction occurs rapidly and thus hollow corrosion may occur.

When an aluminum material is held at a solidus temperature or higher, the region B which is present around the grain boundary has a state in which a liquid phase is intruded into the grain boundary, and moving of the grain boundary in this state occurs. If the grain boundary in the state where a liquid phase is intruded is moved, the Al—Fe—Mn—Si based intermetallic compound or the liquid phase which is present in the front of a travelling direction is taken in. An Al-phase in which the Al—Fe—Mn—Si based intermetallic compound or the liquid phase is not present is formed in the rear thereof. The Al-phase functions as the region B and has the total area (s1+s2+ . . . +sn) by summing areas up. As mobility of the grain boundary becomes larger, the total area becomes larger. The total length of the grain boundary becomes shorter by combining crystal particles, as the mobility of the grain boundary becomes larger.

It is known that moving of the grain boundary in a state where a liquid phase is intruded is accelerated by increasing liquidity and a heating period of time, and is prevented by existing of the Al—Fe—Mn—Si based intermetallic compound. Since a width of a liquid phase satisfying the grain boundary becomes thicker as the liquidity becomes higher, Al—Fe—Mn—Si based intermetallic compound can be taken in and moved more easily in the travelling direction. Since a reaction of taking Al—Fe—Mn—Si based intermetallic compound in the travelling direction proceeds as the heating period of time becomes longer, the particles can be moved farther. When a Mn and Fe composition is high and the total amount of the Al—Fe—Mn—Si based intermetallic compound is large, or when fine Al—Fe—Mn—Si based intermetallic compound are closely formed, moving of the grain boundary in the state where the liquid phase is intruded is easily prevented.

The average area s μm of the region B around the particle boundary is specifically measured as follows.

(1) Firstly, mirror surface polishing is performed on an L-ST cross-section of an aluminum fin and Keller etching is performed, and then a plurality of places of the L-ST cross-section are observed.

(2) If an observation image is obtained, a certain grain boundary in the image is identified at first, and summation (L1+L2+ . . . +Ln) of lengths of all crystal particle boundaries is obtained. In a sample in which a liquid phase is intruded into the grain boundary, a portion on a line, which is observed to be black in Keller etching is the grain boundary. Even though the portion on the line, which is observed to be black is partially discontinuous, when a virtual line is drawn and the virtual line matches with a straight line, a blank portion is also considered as the particle boundary. When the grain boundary is not clear in a sample in which a liquid phase is a little intruded into the grain boundary, the same visual field is treated by using an anodic oxidation method and then is observed by an optical microscope, and the grain boundary can be identified. Also, the grain boundary may be identified by using analysis through an EBSP.

(3) If the grain boundary is identified, it is checked whether or not the region B is present around the identified grain boundary, in a Keller etching observation image. A region in which there is no Al—Fe—Mn—Si based intermetallic compound (referred to as a "particle" below) in a square having four sides of 4.4 μm is set as the region B by using the Al—Fe—Mn—Si based intermetallic compound of less than $5.0\times10^4$ pieces/$mm^2$. Particles within a distance of 4.4 are linked and thus a boundary line between the region A and the region B is drawn. However, in such a method, the region B which is formed to have a width of 4.4 μm or less along the particle boundary is not detected. As defined as 2 μm<s<40 μm in claim 2, it is known that an effect shows if the region B formed around the particle boundary is greater than 2 μm. Thus, in a case of a particle to a particle, particles within a distance of 4.4 μm are linked. In addition, in a case of a particle boundary to a particle, a particle within a distance of 2.0 μm and a line are drawn from each other, and thus a boundary line between the region A and the region B is drawn.

Figure 9:
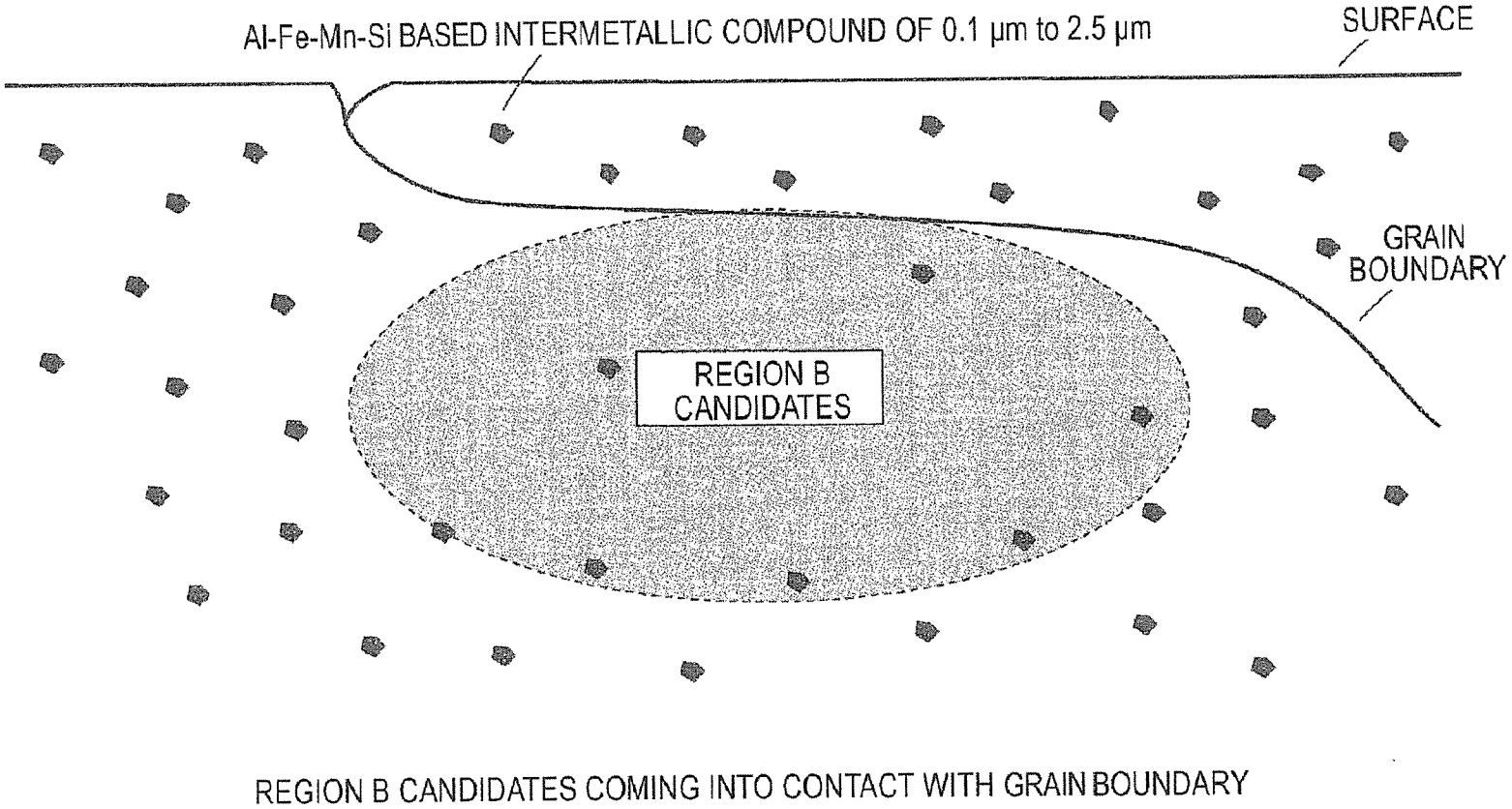
FIG. 9 is a diagram illustrating region B candidates coming into contact with a particle boundary.
Figure 10:
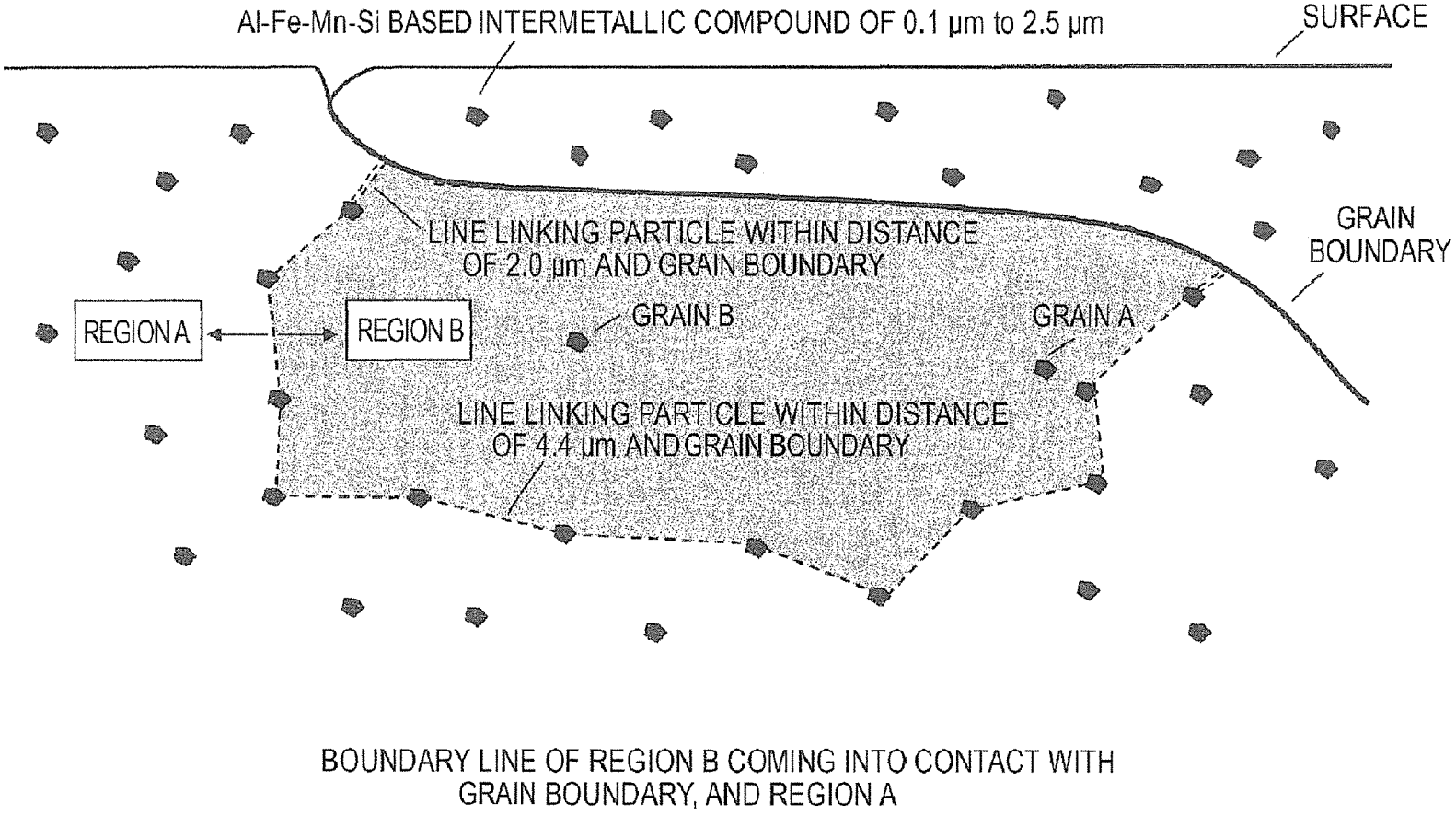
FIG. 10 is a diagram illustrating a boundary line of the region B coming into contact with the particle boundary, and the region A.

(4) When the boundary line is drawn, as illustrated in a gray portion in FIG. 9, B candidates which seem that there is no particle within a distance of 4.4 μm around the particle boundary are firstly found out. As illustrated in FIG. 10, the grain boundary is linked to a particle within a distance of 2.0 μm from the grain boundary with a line at one end portion of the particle boundary coming into contact with the region B candidates. Then, particles within a distance of 4.4 μm from the particle are linked to each other with a line. At this time, since such a particle is countlessly found out on the region A side, only particles which are nearest to the region B side may be linked to each other. The above operation is repeated. If the operation is performed at another end portion of the particle boundary, a region surrounded by the linked line and the particle boundary is the region B which is present around the particle boundary.

(5) In this manner, all "regions B around the particle boundary" in the observation image are identified and the summation (s1+s2+ . . . +sn) of areas of the identified regions B is obtained. The summation of the areas is divided by the summation (L1+L2+ . . . +Ln) of the lengths of the crystal particle boundaries in the same observation image and is further divided by 2. Thus, the average area s μm can be obtained.

Figure 11:
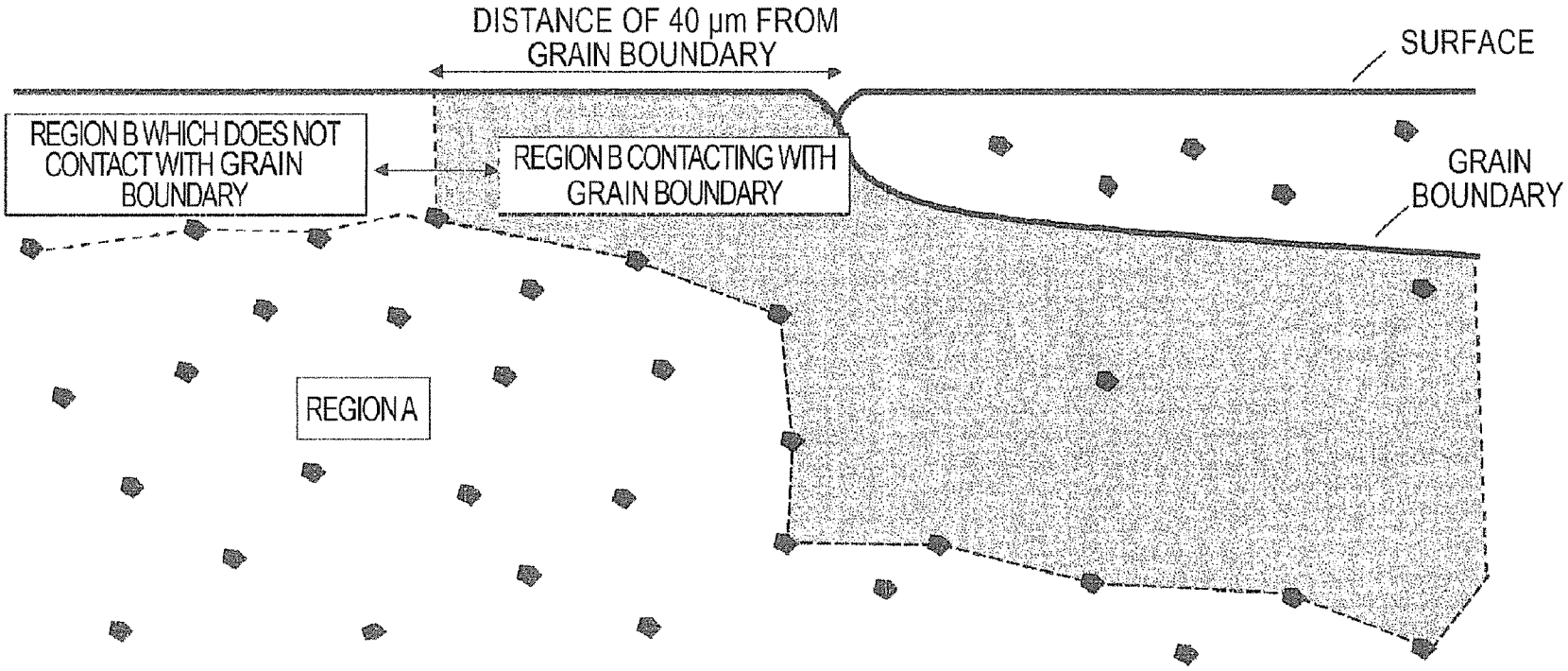
FIG. 11 is a diagram illustrating a determining method for the region B coming into contact with the particle boundary, on a surface.

(6) There is a notice when the boundary line between the region A and the region B is drawn. Firstly, as with a particle A illustrated in FIG. 10, when particles within a distance of 4.4 μm are linked one by one, a particle within a distance of 4.4 μm from the n-th particle is found out to be only the (n−1)-th particle in some cases. In this case, the n-th particle is determined to be a particle belonging to the region B and linking with a line is not performed. If a case of FIG. 10 is used as an example, the particle A and the particle B are recognized together as a particle in the region B. When only the n-th particle is found out as a particle within a distance of 4.4 μm from the (n−1)-th particle, similarly, the (n−1)-th particle is determined to be a particle belonging to the region B. This operation is similarly applied to a case where a particle within a distance of 2 μm from the particle boundary is linked. Secondarily, as illustrated in FIG. 11, when a line is linked from one end portion of the particle boundary, another end portion does not function as the particle boundary and functions as the surface in some cases. In this case, as illustrated at a gray portion in FIG. 11, the region B which is far from the particle boundary up to a distance of 40 μm is measured as the "region B around the particle boundary". In a case of the region B which is from the particle boundary over a place with a distance of greater than 40 μm on the surface, a corrosion rate on the surface is suppressed and corrosion on the inside preferentially occurs and thus hollow corrosion occurs. Accordingly, the region B is measured distinctively from other regions B.

3. Area Occupancy Ratio of Region A in Surface of Fin

In the present invention, the region A is distributed from a surface layer to the inside of the fin in the thickness direction thereof. However, as illustrated in FIG. 1(*a*), the region B may be also present variedly along with the region A from the surface layer to the inside of the fin in the thickness direction, around the grain boundary or around a crystallized material particle having equivalent circle diameter of greater than 1 μm. However, if the area occupancy ratio of the region A on the surface of the fin is equal to or more than 60%, corrosion occurs overall from the surface layer, hollow corrosion or rapid proceeding of corrosion in the thickness direction does not occur, and overall corrosion proceeds from the surface layer. Thus, the area occupancy ratio is preferably set to be equal to or more than 60%.

The grain boundary in the state where a liquid phase is intruded is moved on the surface and the number of regions B on the surface is increased, and thus the area occupancy ratio a of the region A on the surface is reduced. Thus, as the grain boundary in the state where a liquid phase is intruded is moved more, the area occupancy ratio a is reduced more. Since the length of the grain boundary coming into contact with the surface is increased as the grain size becomes smaller, an incidence ratio of the regions B by moving of the grain boundary on the surface is increased and the area occupancy ratio a becomes smaller. As with the clad material, when a brazing filler material layer is formed on the surface, the area occupancy ratio a is almost 0%.

Figure 6:
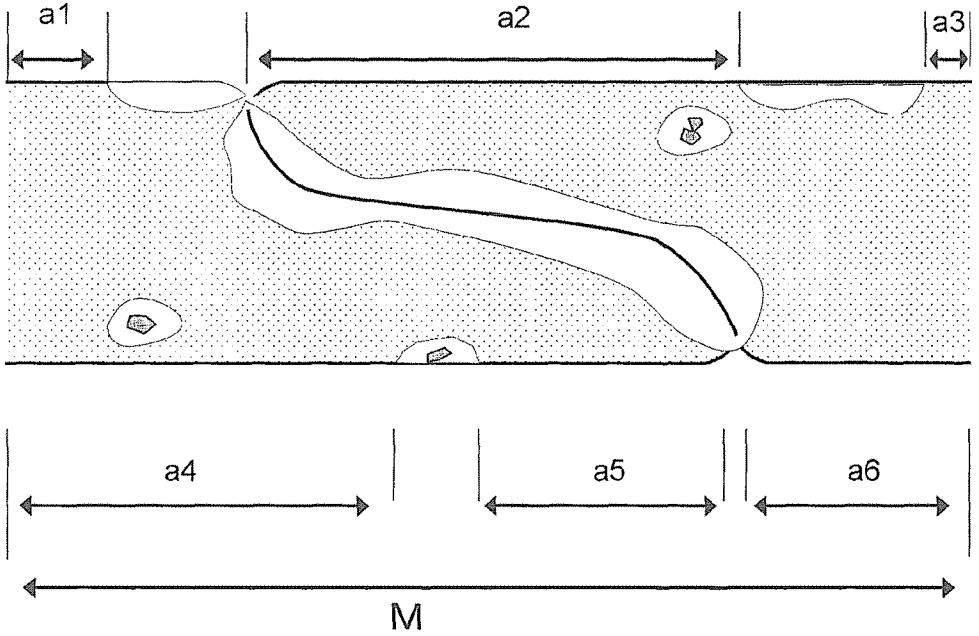
FIG. 6 is a diagram illustrating a definition of an area occupancy ratio of a region A in a surface layer of the fin.
Figure 13:
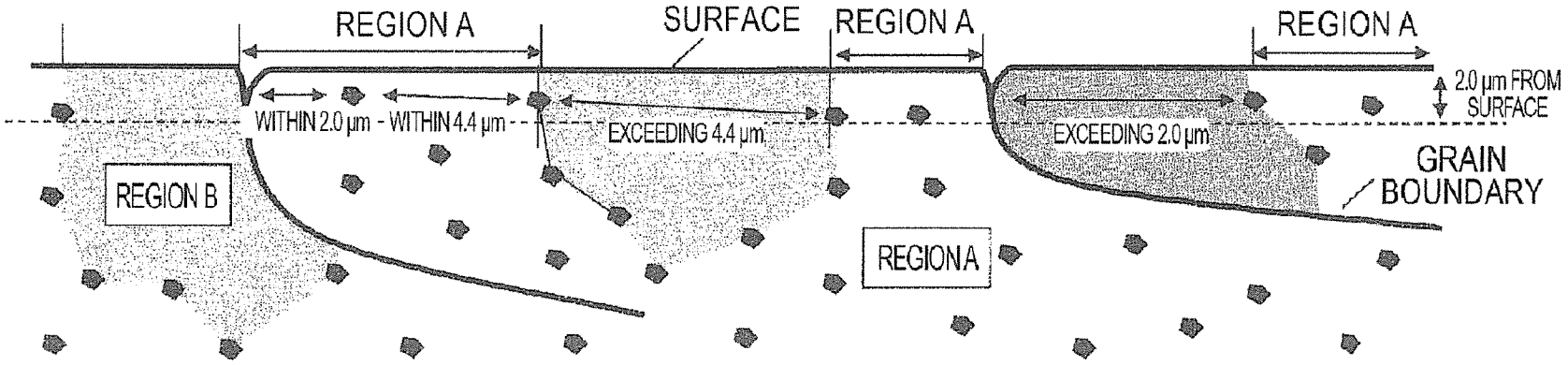
FIG. 13 is a diagram illustrating a definition of the region A and the region B on the surface.

The area occupancy ratio a of the region A on the surface can be obtained by drawing the boundary line between the region A and the region B, similarly in a case of obtaining the average area s μm. When the average area s μm is obtained, linking from the particle boundary is performed as a start. On the contrary, when the area occupancy ratio a of the region A is measured, linking from the surface is started. Similarly to the particle boundary, if the surface and a particle are linked to each other, the surface and a particle within a distance of 2.0 μm are linked to each other with a line as illustrated in FIG. 13. Then, particles within a distance of 4.4 μm from the particle are linked to each other with a line. At this time, since such a particle is countlessly found out on the region A side, only particles which are nearest to the region B side may be linked to each other. Linking of all boundary lines in a bulk is not required and a boundary line may be drawn only in the vicinity of the surface. That is, a region in which particles within 4.4 μm are adjacent to each other among particles within 2.0 μm from the surface, or a region in which the particle boundary and a particle are adjacent to each other within 2.0 μm is set as the region A. A region between particles which are separated from each other by 2.0 μm or more or a region between the particle boundary and a particle is set as the region B. As illustrated in FIG. 6, the area occupancy ratio a is calculated by dividing the total length (a1+a2+ . . . +an) of the region A on the surface in the observation image by a length 2M of the surface. In this case, differently from a case where the average area s of the region B coming into contact with the particle boundary is obtained, distinction between the region B coming into contact with the particle boundary and the region B which does not come into contact with the particle boundary is not required.

4. Al—Si Eutectic Structure of Tube Surface

The heat exchanger according to the present invention has particularly prevention of occurrence of hollow corrosion in the fin as the main point of the invention. However, since the heat exchanger is assumed to be used under a high corrosion environment, it is preferable that other portions in the heat exchanger have high corrosion resistance in addition to the fin.

An Al—Si eutectic structure is preferably present only in a bonding-portion fillet on a tube surface of the heat exchanger according to the present invention. If the Al—Si eutectic structure is present on the tube surface, a portion having the Al—Si eutectic structure acts as a strong cathode site and thus corrosion in a tube may be accelerated and a refrigerant may be leaked early. Accordingly, an extruded perforated tube or an electroseamed tube in which a sacrificial anode material is disposed on a surface is preferably used as a tube material. For example, the tube material may have a structure in which an addition element is provided small and a compound functioning as a cathode site is provided small, or have a structure in which a sacrificial corrosion-resistant layer (considered as a single layer even when spraying is performed) is included on a surface by spraying molten Zn.

5. Grain Size of Al Matrix in L-LT Cross-Section of Fin and Average Length of Crystal Particles of Al Matrix in L-ST Cross-Section in Sheet Thickness Direction In the heat exchanger according to the present invention, when the grain size of the Al matrix in an L-LT cross-section of the fin is set as L μm and an average length of crystal particles of the Al matrix in the L-ST cross-section of the fin in a sheet thickness direction is set as T μm, L≥100 is preferable and L/T≥2 is preferable. In a case of a sheet-like fin, a longitudinal direction is set as L, a width direction is set as LT, a sheet thickness direction is set as ST, a cross-section formed by an L direction and an LT direction is set as the L-LT cross-section, and a cross-section formed by an L direction and an ST direction is set as the L-ST cross-section.

As illustrated in FIG. 1(*b*), corrosion occurs particularly easily at the grain boundary in the structure. If satisfying L<100 (μm), the fin may be significantly fragile early by corrosion of the grain boundary. In the L-ST cross-section, as a ratio of a length of a grain boundary extended in the thickness direction to a length of a grain boundary extended in the longitudinal direction becomes greater, the fin is penetrated earlier in the thickness direction by corrosion and thus the working fluid may be leaked or the fin may be fragile. If satisfying L/T<2, corrosion which causes penetration of the fin in the thickness direction may occur early. Upper limit values of L and L/T are not particularly defined and are determined by an alloy composition and a manufacturing condition of a fin material, and a bonding condition of the fin material and the tube material. However, in the present invention, the upper limit value of L is set to 5000 μm and the upper limit value of L/T is set to 100.

The grain size L (μm) of the Al matrix in the L-LT cross-section may be measured in such a manner that a sample is etched by an anodic oxidation method after mirror surface polishing, the etched sample is observed by an optical microscope, and a crystal particle structure observation image is obtained. As a measuring method, an average grain size is measured based on ASTM E112-96 at the center of a sheet thickness. When the crystal particle structure observation image is obtained by analysis which is performed by an EBSP and the like, similar grain size may be also obtained.

Figure 12:
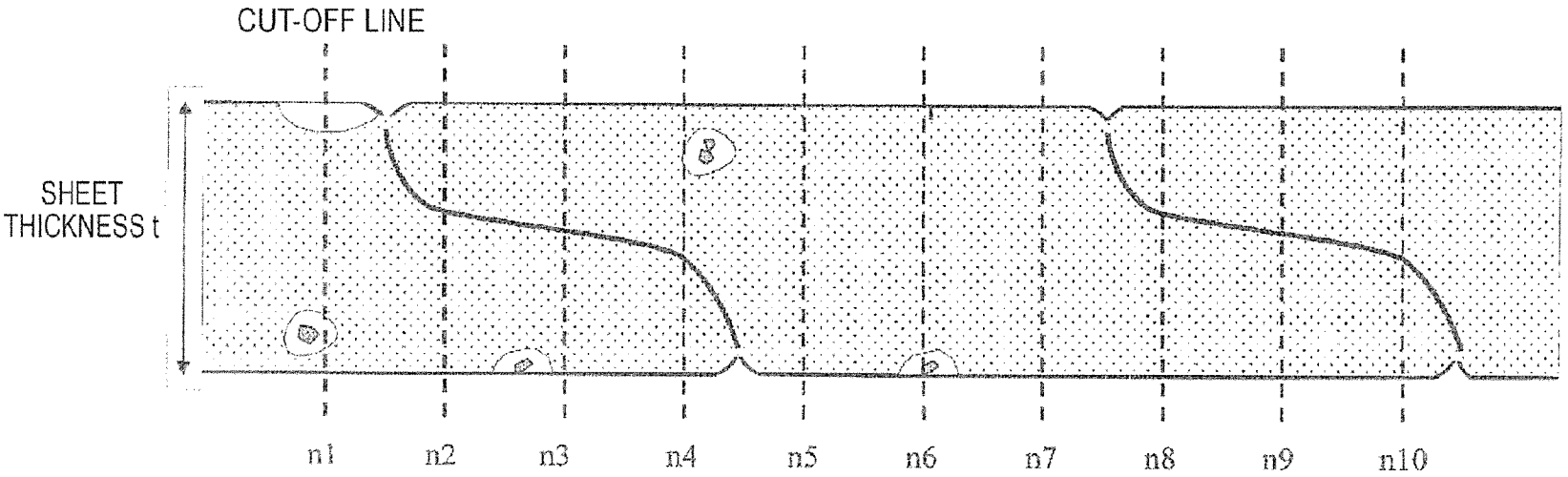
FIG. 12 is a diagram illustrating a calculating method of the number of crystal particles of an Al matrix in an L-ST cross-section.

The average length T (μm) of crystal particles in the sheet thickness direction of the Al matrix in the L-ST cross-section is calculated by dividing a sheet thickness t (μm) by an average number of Al matrices in the sheet thickness direction, as illustrated in FIG. 12. The average number of Al matrices in the sheet thickness direction is obtained in such a manner that at least 10 cutting-plane lines or more are drawn at an equal interval in the sheet thickness direction and the number of crystal particles on the cutting-plane lines is measured in an observation visual field in which at least a length in the longitudinal direction is equal to or longer than 1 mm. Preferably, the above-described measurement is performed on at least five observation images and an averaged value obtained by measurement is used.

6. Natural Potential

In the heat exchanger according to the present invention, a natural potential of the fin is preferably equal to or greater than −910 mV. When the natural potential of the fin is less than −910 mV, corrosion in the fin may rapidly proceed. An upper limit value of the natural potential of the fin is not particularly limited, and is determined by the alloy composition and the manufacturing condition of the fin material and the bonding condition of the fin material and the tube material. However, in the present invention, the upper limit value of the natural potential of the fin is −750 mV.

The natural potential of the fin is preferably nobler than a natural potential of a fillet at the bonding portion of the fin and tube by 0 mV to 200 mV. If an natural potential difference is less than 0 mV, corrosion in the fin may be accelerated and the fin may be destroyed. If the natural potential difference is greater than 200 mV, the fillet may be destroyed, and the fin may be peeled from the tube and thus maintaining of heat dissipation performance may be impossible. A preferable range of the natural potential difference is from 50 mV to 150 mV.

Relationships between natural potentials at four portions of the fin (Fin), the tube surface (TS), the tube core (TB), and the fillet (Fillet) of the bonding portion more preferably satisfy the following expressions (1), (2), (3), and (4).

$$\text{TS-Fillet} \leq 200 \text{ mV} \quad (1)$$

$$\text{Fillet} \geq -950 \text{ mV} \quad (2)$$

$$\text{TB-TS} \geq 100 \text{ mV} \quad (3)$$

$$\text{TS} \geq -950 \text{ mV} \quad (4)$$

When the left side of the expression (1) is greater than 200, preferential corrosion is too accelerated due to a sacrificial corrosion resistance action of the fillet, and thus the bonding portion may be peeled off early. When the left side of the expression (2) is less than −950 mV, corrosion in the fillet is accelerated and the bonding portion may be peeled off early. When the left side of the expression (3) is less than 100 mV, since the sacrificial corrosion resistance action of the tube surface does not work, the tube is easily penetrated. When the left side of the expression (4) is less than −950 mV, since the corrosion rate on the tube surface is too fast and a sacrificial corrosion resistance effect disappears early, the tube may be easily penetrated.

7. Fin Material (First Embodiment)

The heat exchanger according to the present invention is manufactured and obtained by using a material having a bonding function in a single layer, as the fin material which is a material before bonding. Specifically, a fin material according to a first embodiment uses an aluminum alloy which contains 1.0 mass % to 5.0 mass % (simply described as "%" below) of Si, 0.1% to 2.0% of Fe, and 0.1% to 2.0% of Mn as essential elements and is formed of residual Al and inevitable impurities, as the fin material. In the aluminum alloy, Si based intermetallic compound having an equivalent circle diameter of 0.5 μm to 5 μm are present, Al—Fe—Mn—Si based intermetallic compound having an equivalent circle diameter of greater than 5 μm are present, the number of the Si based intermetallic compound is from 250 pieces/$mm^2$ to $7\times10^4$ pieces/$mm^2$, and the number of the Al—Fe—Mn—Si based intermetallic compound is from 10 pieces/$mm^2$ to 1000 pieces/$mm^2$. Features of the aluminum alloy will be described below in detail.

7-1. Alloy Composition (Essential Element)

Si: 1.0% to 5.0%

Si is an element for generating an Al—Si liquid phase and contributing to bonding. When a Si content is less than 1.0%, generation of a liquid phase having a sufficient amount is impossible, the liquid phase bleeds small, and thus bonding is performed incompletely. When the Si content is more than 5.0%, since an amount of generated liquid phase in an aluminum alloy material is increased, material strength during heating is greatly degraded and holding of a shape of the heat exchanger is difficult. Thus, the Si content is determined to be from 1.0% to 5.0%. The Si content is preferably from 1.5% to 3.5%, and more preferably from 2.0% to 3.0%. An amount of bleeding of the liquid phase is increased as the sheet thickness becomes thicker and a heating temperature becomes higher. Thus, regarding the amount of the liquid phase required for heating, the Si content required in accordance with a structure of the heat exchanger to be manufactured or a bonding heating temperature is preferably adjusted.

Fe: 0.1% to 2.0%

A small amount of Fe is solid-soluted in a matrix, and has particularly an effect of prevention of strength degradation at a high temperature by dispersing dissolved Fe as a crystallized material, in addition to having an effect of improving strength. When a Fe content is less than 0.1%, the above effects show insufficiently, and using of base metal having high purity is necessary. Thus, cost is increased. If the Fe content is more than 2.0%, a coarse intermetallic compound is generated in casting and a problem in manufacturability occurs. When the heat exchanger is exposed under a corrosion environment (particularly, corrosion environment as with circulating of a liquid), corrosion resistance is degraded. Since crystal particles recrystallized by heating during bonding are pulverized and a particle boundary density is increased, a change of dimensions between before and after bonding becomes larger. Accordingly, an addition amount of Fe is set to be from 0.1% to 2.0%. The preferable Fe content is from 0.2% to 1.0%.

Mn: 0.1 to 2.0%

Mn is an important addition element with Si which is used for forming an Al—Mn—Si based intermetallic compound, and is used for acting for dispersion reinforcement, or improving strength by being solid-soluted in an aluminum parent phase and performing solid solution reinforcement. When an Mn content is less than 0.1%, the above effects show insufficiently. If the Mn content is more than 2.0%, a coarse intermetallic compound is easily formed and corrosion resistance is degraded. Accordingly, the Mn content is set to be from 0.1% to 2.0%, and the preferable Mn content is from 0.3% to 1.5%.

7-2. Metal Structure

Next, features of a metal structure of the fin material for the heat exchanger according to the present invention will be described. In an aluminum alloy used in this fin material, Si based intermetallic compound which have an equivalent circle diameter of 0.5 μm to 5 μm and have 250 pieces/mm$^2$ to $7\times10^4$ pieces/mm$^2$ in number density are present. The Si based intermetallic compound is (1) singleton Si and (2) a compound obtained by including other elements at a portion of singleton Si. As other elements, Ca, P, or the like is included. Such a Si based intermetallic compound contributes to generation of a liquid phase in a liquid phase generation process as will be described later. The number density is in a certain cross-section of the aluminum alloy material. For example, the number density may be in a cross-section along the thickness direction or be in a cross-section parallel with a surface of a sheet material. From a viewpoint of simplicity for material evaluation, the cross-section along the thickness direction is preferably employed.

As described above, dispersion particles of the intermetallic compound such as Si particles, which are dispersed in the aluminum alloy material react with matrices around the dispersion particles so as to generate a liquid phase during bonding. For this reason, as the dispersion particle of the intermetallic compound becomes finer, an area of portions at which the particles and the matrices come into contact with each other becomes greater. Thus, as the dispersion particle of the intermetallic compound becomes finer, more rapid generation of a liquid phase is easily performed during bonding and heating and a good bonding property is obtained. If the Si based intermetallic compound are fine, it is possible to hold a shape of the aluminum alloy material. This effect is shown greatly in a case where a bonding temperature is near to a solidus line or where a temperature rising rate is high. For this reason, in the aluminum alloy material used in the present invention, it is necessary that an equivalent circle diameter of the compound is defined to be from 0.5 μm to 5 μm and the number density thereof is defined to be from 250 pieces/mm$^2$ to $7\times10^4$ pieces/mm$^2$ for an appropriate Si based intermetallic compound. If the number density is less than 250 pieces/mm$^2$, bias occurs in a liquid phase to be generated and thus well bonding is not obtained. If the number density is more than $7\times10^4$ pieces/mm$^2$, a reaction area of the particles and the matrices is too large. Thus, an amount of the liquid phase is rapidly increased and deformation easily occurs. Consequently, the number density of the Si based intermetallic compound is set to be from 250 pieces/mm$^2$ to $7\times10^4$ pieces/mm$^2$. The number density is preferably from 500 pieces/mm$^2$ to $5\times10^4$ pieces/mm$^2$, and more preferably from 1000 pieces/mm$^2$ to $2\times10^4$ pieces/mm$^2$.

Regarding the number density of the Si based intermetallic compound in the fin material, the reason that the equivalent circle diameter of the Si based intermetallic compound is limited to being from 0.5 μm to 5 μm is as follows. Si based intermetallic compound of less than 0.5 μm are also present, but the Si based intermetallic compound of less than 0.5 μm are solid-soluted in the matrix in bonding and heating before the bonding temperature reaches the solidus line. Thus, when a liquid phase is to be generated, the Si based intermetallic compound of less than 0.5 μm are hardly present and are not used as a starting point of liquid phase generation. Accordingly, the Si based intermetallic compound of less than 0.5 μm are excluded from a target. Coarse Si based intermetallic compound of greater than 5 μm are hardly present and thus excluded from the target.

As the aluminum alloy used in the fin material according to the present invention, an Al—Fe—Mn—Si based intermetallic compound is present in a form of dispersion particles, in addition to a Si based intermetallic compound generated by using a basic composition (Al—Si alloy). The Al—Fe—Mn—Si based intermetallic compound is an intermetallic compound generated by using Al and an addition element. Examples of the intermetallic compound include compounds of Al—Fe, Al—Fe—Si, Al—Mn—Si, Al—Fe—Mn, and Al—Fe—Mn—Si. The Al—Fe—Mn—Si based intermetallic compound is different from the Si based intermetallic compound in that the Al—Fe—Mn—Si based intermetallic compound does not largely contribute to liquid phase generation, but the Al—Fe—Mn—Si based intermetallic compound is dispersion particles being in charge of material strength along with the matrix. It is necessary that the number of the Al based intermetallic compound having an equivalent circle diameter of greater than 5 μm is 10 pieces/mm$^2$ to 1000 pieces/mm$^2$. When the number of the particles is less than 10 pieces/mm$^2$, deformation occurs due to strength degradation. When the number of the particles is more than 1000 pieces/mm$^2$, generation frequency of nucleuses for recrystallized particles during bonding and heating is increased, and the grain size becomes smaller. If the crystal particles are small, crystal particles slip on each other at the particle boundary and deformation easily occurs. Thus, fin buckling occurs. In addition, a liquid phase is generated around the intermetallic compound during heating and bonding and a proportion of the generated liquid phase itself to the sheet thickness becomes greater. Thus, fin buckling occurs. Consequently, the number density of the Al based intermetallic compound is set to be from 10 pieces/mm$^2$ to 1000 pieces/mm$^2$.

Regarding the number density of the Al—Fe—Mn—Si based intermetallic compound, the Al—Fe—Mn—Si based intermetallic compounds having an equivalent circle diameter of 5 μm or less are also present and contribute to strength of a raw material, strength in bonding and heating, and strength after bonding and heating. However, particles having an equivalent circle diameter of 5 μm or less are easily dissolved in the matrix by moving the particle boundary during bonding and heating, and hardly have an influence on easy occurrence of deformation due to the grain size after heating. Thus, the particles having an equivalent circle diameter of 5 μm or less are excluded from a target. Al—Fe—Mn—Si based intermetallic compound having an equivalent circle diameter of 10 μm or greater are hardly present and thus are excluded from the target.

Similarly to the Si based intermetallic compound, the number density is in a certain cross-section of the aluminum alloy material. For example, the number density may be in a cross-section along the thickness direction or be in a cross-section parallel with a surface of a sheet material. From a viewpoint of simplicity for material evaluation, the cross-section along the thickness direction is preferably employed.

The equivalent circle diameter of the dispersion particle may be determined by performing SEM observation of a cross-section (reflected electron image observation). Here, the equivalent circle diameter corresponds to a diameter of an equivalent circle. It is preferable that image analysis is performed on a SEM picture and thus an equivalent circle diameter of the dispersion particle before bonding is obtained. The Si based intermetallic compound and the Al based intermetallic compound may be distinguished from each other by using light and shade of contrast in SEM-reflected electron image observation. The metal type of the dispersion particle may be accurately specified by using an EPMA (X-ray microanalyzer).

The aluminum alloy which is described above, has features in an alloy composition and a metal structure, and is used in the fin material according to the present invention enables bonding by the bonding property of the aluminum alloy, and thus may be used as a constituent of various aluminum alloy construction objects. It is possible to obtain the heat exchanger according to the present invention by applying this alloy material as the fin material.

7-3. Alloy Composition (Selective Addition Element)

The aluminum alloy may contain one or more types selected from the following materials, as a selective addition element: 2.0% or less of Mg, 1.5% or less of Cu, 6.0% or less of Zn, 0.3% or less of Ti, 0.3% or less of V, 0.3% or less of Zr, 0.3% or less of Cr, and 2.0% or less of Ni.

Mg: 2.0% or Less

Mg is used for improving strength by age-hardening. The age-hardening occurs by $Mg_2Si$ after bonding and heating. That is, Mg is an addition element for showing an effect of improving strength. If an addition amount of Mg is more than 2.0%, Mg reacts with flux so as to form a high-melting point compound, and as a result, acting of the flux as an oxide film is impossible. Thus, bonding becomes significantly difficult. Accordingly, the addition amount of Mg is set to be equal to or less than 2.0%. The addition amount of Mg is preferably from 0.05% to 2.0%, and is more preferably, from 0.1% to 1.5%.

Cu: 1.5% or Less

Cu is an addition element which is solid-soluted in the matrix and thus is used for improving strength. If an addition amount of Cu is more than 1.5%, corrosion resistance is degraded. Accordingly, the addition amount of Cu is preferably set to be equal to or less than 1.5%. The addition amount of Cu is more preferably set to be from 0.05% to 1.5%.

Zn: 6.0% or Less

Addition of Zn is effective for improving corrosion resistance by the sacrificial corrosion resistance action. Zn is substantially uniformly solid-soluted in the matrix. However, if the liquid phase is generated, Zn is eluted in the liquid phase and thus Zn in the liquid phase becomes in a high concentration. If the liquid phase bleeds to the surface, the Zn concentration at a portion of the surface at which the liquid phase bleeds is increased. Thus, corrosion resistance is improved by the sacrificial anode action. When the aluminum alloy material according to the present invention is applied to a heat exchanger, the aluminum alloy material according to the present invention is used in a fin and thus a sacrificial corrosion resistance action for prevention of corrosion in a tube and the like may work. If an addition amount of Zn is more than 6.0%, the corrosion rate becomes fast and self-corrosion resistance is degraded. Accordingly, the amount of Zn is preferably set to be equal to or less than 6.0%. The addition amount of Zn is more preferably from 0.05% to 6.0%.

Ti: 0.3% or Less, V: 0.3% or Less

Ti and V have an effect of improving strength by being solid-soluted in the matrix and have an effect of preventing progress of corrosion in the sheet thickness direction by being distributed to have a layer shape. If either of Ti and V is more than 0.3%, a coarse crystallized material is generated and thus moldability and corrosion resistance are prevented. Accordingly, each of a Ti content and a V content is preferably set to be equal to or less than 0.3% and more preferably set to be from 0.05% to 0.3%.

Zr: 0.3% or Less

Zr is deposited as the Al—Zr based intermetallic compound and shows an effect of improving strength after bonding, by dispersion reinforcement. The Al—Zr based intermetallic compound serves to cause crystal particles in heating to be coarse. If Zr is more than 0.3%, a coarse intermetallic compound is easily formed, and thus plastic processability is degraded. Thus, an addition amount of Zr is preferably set to be equal to or less than 0.3%, and is more preferably set to be from 0.05% to 0.3%.

Cr: 0.3% or Less

Cr serves to improve strength by solid solution reinforcement and to cause crystal particles after heating to be coarse by depositing the Al—Cr based intermetallic compound. If Cr is more than 0.3%, a coarse intermetallic compound is easily formed, and thus plastic processability is degraded. Thus, an addition amount of Cr is preferably set to be equal to or less than 0.3% and is more preferably set to be from 0.05% to 0.3%.

Ni: 2.0% or Less

Ni is crystallized or deposited as an intermetallic compound and shows an effect of improving strength after bonding, by dispersion reinforcement. A content of Ni is preferably set to be in a range of 2.0% or less and is more preferably set to be in a range of 0.05% to 2.0%. If the content of Ni is more than 2.0%, a coarse intermetallic compound is easily formed, and thus processability is degraded, and self-corrosion resistance is also degraded.

In the aluminum alloy material according to the present invention, a selective element for improving corrosion resistance of a heat exchanger may be also added. As such an element, 0.3% or less of Sn and 0.3% or less of In are preferably used. If necessary, one or two types of these materials are added.

Sn and In have an effect of performing the sacrificial anode action. If addition amounts of Sn and In are more than 0.3%, the corrosion rate becomes fast and self-corrosion resistance is degraded. Thus, the addition amount of each of these elements is preferably set to be equal to or less than 0.3%. The addition amount is more preferably from 0.05% to 0.3%.

In the aluminum alloy material according to the present invention, a selective element which causes characteristics of the liquid phase to be improved and thus causes the bonding property to be better may be further added. As such an element, 0.1% or less of Be, 0.1% or less of Sr, 0.1% or less of Bi, 0.1% or less of Na, and 0.05% or less of Ca are preferably used, and if necessary, one or more types of these elements are added. Amore preferable range of each of the elements is as follows: Be: 0.0001% to 0.1%, Sr: 0.0001% to 0.1%, Bi: 0.0001% to 0.1%, Na: 0.0001% to 0.1%, and Ca: 0.0001% to 0.05%. These trace elements enable the bonding property to be improved by fine dispersion of Si particles, improvement of flowability of the liquid phase, and the like. If these trace elements are less than the more preferably defined range, fine dispersion of Si particles or improvement of flowability of the liquid phase may insufficiently occur. If the trace elements are more than the more preferably defined range, a problem such as degradation of corrosion resistance may occur. When one of Be, Sr, Bi, Na, and Ca is added, or when any two types or more are added, any of the above elements is added within the above preferable component range or within the above more preferable component range.

7-4. Mechanical Characteristics

The fin material for the heat exchanger according to the present invention satisfies a relationship of $T/To \leq 1.40$ when tensile strength of an element sheet is set as T and tensile strength of the element sheet after heating at 450° C. for 2 hours is set as To. Heating at 450° C. for 2 hours causes the fin material for the heat exchanger according to the present invention to be sufficiently annealed and thus an O material is formed. T/To represents a strength rising ratio from the O material. In a case of this alloy material, since the grain size after bonding and heating becomes large, it is effective to reduce an amount of processing of the final cold-rolling process after annealing in a manufacturing process. If the amount of the final processing is large, a driving force of recrystallization becomes large and crystal particles during bonding and heating are pulverized. As the amount of the final processing becomes large, the strength increases, and T/To has a large value. In order to prevent deformation of the fin by causing the grain size after bonding and heating to be large, it is effective that T/To which is an index representing the amount of the final processing is set to be equal to or less than 1.40.

In the fin material for the heat exchanger according to the present invention, tensile strength before bonding and heating is from 80 MPa to 250 MPa. If the tensile strength before bonding and heating is less than 80 MPa, strength necessary for molding of a fin shape is insufficient, and molding is impossible. If the tensile strength before bonding and heating is greater than 250 MPa, a shape retaining property after molding of the fin is bad. In addition, when the molded fin is assembled to the heat exchanger, a gap between the molded fin and other constituents may occur, and thus the bonding property is deteriorated.

In the fin material for the heat exchanger according to the present invention, the tensile strength after bonding and heating is preferably from 80 MPa to 250 MPa. If the tensile strength after bonding and heating is less than 80 MPa, the strength as a fin is insufficient, and when stress is applied to the heat exchanger itself, deformation occurs. If the tensile strength after bonding and heating is greater than 250 MPa, the strength is higher than that of other constituents in the heat exchanger, and a bonding portion with other constituents may be broken in use of the heat exchanger.

7-5. Manufacturing Method of Aluminum Alloy Material Used in Fin Material 7-5-1. Casting Process A manufacturing method of the aluminum alloy material used in the fin material according to the first embodiment will be described. The aluminum alloy material is casted by using a direct chill (DC) casting method. A casting rate of a slab in casting is controlled as follows. Since the casting rate has an influence on a cooling rate, the casting rate is set to be from 20 mm/minute to 100 mm/minute. When the casting rate is lower than 20 mm/minute, the sufficient cooling rate is not obtained and a crystallized intermetallic compound such as the Si based intermetallic compound and the Al—Fe—Mn—Si based intermetallic compound becomes coarse. When the casting rate is greater than 100 mm/minute, the aluminum material in casting is insufficiently solidified and a normal ingot is not obtained. The casting rate is preferably from 30 mm/minute to 80 mm/minute. In order to obtain the metal structure according to the present invention, the casting rate may be adjusted in accordance with a composition of an alloy material to be manufactured. The cooling rate is determined in accordance with a cross-section shape of the slab, such as a thickness and a width. However, if the casting rate is set to be from 20 mm/minute to 100 mm/minute as described above, the cooling rate may be set to be from 0.1° C./second to 2° C./second at the center portion of an ingot.

The ingot (slab) in DC continuous casting is preferably equal to or less than 600 mm in thickness. When the thickness of the slab is greater than 600 mm, the sufficient cooling rate is not obtained and an intermetallic compound becomes coarse. The more preferable thickness of the slab is equal to or less than 500 mm.

The slab manufactured by using the DC casting method goes through a heating process before hot-rolling, a hot-rolling process, a cold rolling process, and an annealing process. Homogenizing treatment may be performed after casting, before hot-rolling.

The slab manufactured by using the DC casting method goes through the heating process before hot-rolling, after the homogenizing treatment or without the homogenizing treatment. This heating process is preferably performed in a state where a heating holding temperature is set to be from 400° C. to 570° C. and a holding time is set to be substantially from 0 hour to 15 hours. When the holding temperature is lower than 400° C., deformation resistance of the slab in hot-rolling is large and thus a crack may occur. When the holding temperature is higher than 570° C., melting may partially occur. When the holding time is longer than 15 hours, deposition of the Al—Fe—Mn—Si based intermetallic compound proceeds, a deposit material particle becomes coarse and distribution of deposit material particles becomes sparse. A nucleus generation frequency of recrystallized particles in bonding and heating is increased and the grain size becomes small. The holding time being 0 hour means that heating is ended just after a temperature reaches the heating holding temperature.

7-5-2. Hot-Rolling Process

Subsequently to the heating process, the slab goes through the hot-rolling process. The hot-rolling process includes a hot rough rolling stage and a hot finish rolling stage. Here, the total rolling reduction ratio is set to be from 92% to 97% at the hot rough rolling stage and the hot rough rolling stage is set to include a pass at which a rolling reduction ratio is equal to or greater than 15% among passes in hot rough rolling, three times or more.

A coarse crystallized material is generated at the last solidified portion of the slab manufactured by using the DC casting method. In a process for a sheet material, the crystallized material is subjected to shearing by rolling and thus is divided to be small. Accordingly, the crystallized material after rolling is observed to have a particle shape. The hot-rolling process includes the hot rough rolling stage at which a sheet having a certain thickness is formed from the slab, and the hot finish rolling stage at which the formed sheet is made to have a sheet thickness of about several mm. In order to divide the crystallized material, a control of the rolling reduction ratio at the hot rough rolling stage at which rolling from the slab is performed is important. Specifically, rolling is performed on the slab having a thickness of 300 mm to 700 mm so as to be about from 15 mm to 40 mm at the hot rough rolling stage. However, the total rolling reduction ratio at the hot rough rolling stage is set to be from 92% to 97% and the hot rough rolling stage includes the pass in which the rolling reduction ratio is equal to or greater than 15%, three times or more, and thereby it is possible to divide the coarse crystallized material to be fine. Thus, it is possible to pulverize the Si based intermetallic compound or the Al—Fe—Mn—Si based intermetallic compound which is the crystallized material, and to hold a distribution state defined in the present invention.

If the total rolling reduction ratio at the hot rough rolling stage is less than 92%, a pulverization effect for the crystallized material is not sufficiently obtained. If the total rolling reduction ratio at the hot rough rolling stage is greater than 97%, since the thickness of the slab is substantially thick and the cooling rate in the casting becomes slow, the crystallized material becomes coarse, and pulverization of the crystallized material is not sufficiently performed even though the hot rough rolling is performed. Since the rolling reduction ratio in each pass at the hot rough rolling stage also has an influence on distribution in the intermetallic compound, the rolling reduction ratio in each pass becomes greater and thus the crystallized material is divided. If the pass in which the rolling reduction ratio is equal to or greater than 15% among passes at the hot rough rolling stage is included less than three times, the pulverization effect of the crystallized material is not sufficient. A case where the rolling reduction ratio is less than 15% is excluded from a target because the rolling reduction ratio is insufficient and the crystallized material is not pulverized. An upper limit of the number of performing the pass in which the rolling reduction ratio is equal to or greater than 15% is not particularly limited. However, practically, the upper limit thereof is set to about 10.

7-5-3. Cold Rolling Process and Annealing Process

After the hot-rolling process is ended, the hot-rolling material goes through the cold rolling process. Conditions of the cold rolling process are not particularly limited. An annealing process is provided in the middle of the cold rolling process. In the annealing process, the cold rolling material is sufficiently annealed and thus a recrystallization structure is formed. After the annealing process, the rolling material goes through the final cold-rolling and thus a rolling material is caused to have the final sheet thickness. If the processing ratio {(sheet thickness before processing−sheet thickness after processing)/sheet thickness before processing}×100(%) at the final cold-rolling stage is excessively great, the driving force for recrystallization in bonding and heating becomes strong, and the crystal particles become small. Thus, deformation occurs largely in bonding and heating. Accordingly, as described above, the amount of processing at the final cold-rolling stage is set so that T/To is equal to or less than 1.40. The processing ratio at the final cold-rolling stage is preferably set to be about from 10% to 30%.

8. Fin Material (Second Embodiment)

The heat exchanger according to the present invention is manufactured and obtained by using a material having a bonding function in a single layer, as the fin material which is a material before bonding. However, the heat exchanger is also manufactured and obtained by using a material having a bonding function in a single layer which will be described later, instead of the fin material according to the first embodiment. Specifically, the material is an aluminum alloy material which contains 1.0% to 5.0% of Si and 0.01% to 2.0% of Fe and is formed of residual Al and inevitable impurities including Mn, as the fin material. In the aluminum alloy material, Si based intermetallic compound having an equivalent circle diameter of 0.5 μm to 5 μm are present, Al—Fe—Mn—Si dispersion particles having an equivalent circle diameter of 0.5 μm to 5 μm are present, the number of the Si based intermetallic compound is from 250 pieces/$mm^2$ to $7\times10^5$ pieces/$mm^2$ in a cross-section of the aluminum alloy material, and the number of the Al—Fe—Mn—Si dispersion particles is from 100 pieces/$mm^2$ to $7\times10^5$ pieces/$mm^2$ in the cross-section of the aluminum alloy material. Features of the aluminum alloy will be described below in detail.

8-1. Alloy Composition (Essential Element)

Regarding a Si concentration, Si is an element for generating an Al—Si liquid phase and contributing to bonding. When the Si concentration is less than 1.0%, generation of a liquid phase having a sufficient amount is impossible, the liquid phase bleeds small, and thus bonding is performed incompletely. When the Si concentration is more than 5.0%, since an amount of generated liquid phase in an aluminum alloy material is increased, material strength during heating is greatly degraded and holding of a shape of the structural object is difficult. Thus, the Si concentration is determined to be from 1.0% to 5.0%. The Si concentration is preferably from 1.5% to 3.5% and more preferably from 2.0% to 3.0%. An amount of bleeding of the liquid phase is increased as the sheet thickness becomes thicker and the heating temperature becomes higher. Thus, regarding the amount of the liquid phase required in heating, the Si content or the bonding heating temperature required in accordance with a structure of the structural object to be manufactured is preferably adjusted.

Regarding a Fe concentration, Fe has an effect of prevention of strength degradation particularly at a high temperature by dispersing solid-soluted Fe as a crystallized material, in addition to having an effect of improving strength by solid-soluting a small amount of Fe in the matrix. When an addition amount of Fe is less than 0.01%, the above effects show small, and using of base metal having high purity is necessary. Thus, cost is increased. If the addition amount of Fe is more than 2.0%, a coarse intermetallic compound is generated in casting and a problem in manufacturability occurs. When this bonding object is exposed under a corrosion environment (particularly, corrosion environment as with circulating of a liquid), corrosion resistance is degraded. Since crystal particles recrystallized by heating during bonding are pulverized and the particle boundary density is increased, a change of dimensions between before and after bonding becomes larger. Accordingly, the addition amount of Fe is set to be from 0.01% to 2.0%. The preferable addition amount of Fe is from 0.2% to 1.0%.

8-2. Metal Structure

Next, features of a metal structure of an aluminum alloy material according to the present invention will be described. In the aluminum alloy material according to the present invention, Si based intermetallic compound which have an equivalent circle diameter of 0.5 μm to 5 μm and have 250 pieces/mm$^2$ to $7\times10^5$ pieces/mm$^2$ are present in a cross-section. The Si based intermetallic compound is (1) singleton Si and (2) a compound obtained by including an element such as Ca and P at a portion of singleton Si. The Si based intermetallic compound is an intermetallic compound which contributes to liquid phase generation described in the liquid phase generation process as described above. The cross-section is a certain cross-section of the aluminum alloy material. For example, the cross-section may be a cross-section along the thickness direction or be a cross-section parallel with a surface of a sheet material. From a viewpoint of simplicity for material evaluation, the cross-section along the thickness direction is preferably employed.

As described above, dispersion particles of the intermetallic compound such as Si particles, which are dispersed in the aluminum alloy material react with matrices around the dispersion particles so as to generate a liquid phase during bonding. For this reason, as the dispersion particle of the intermetallic compound becomes finer, an area of portions at which the particles and the matrices come into contact with each other becomes greater. Thus, as the dispersion particle of the intermetallic compound becomes finer, more rapid generation of a liquid phase is easily performed during bonding and heating and a good bonding property is obtained. This effect is shown greatly in a case where a bonding temperature is near to a solidus line or where a temperature rising rate is high. For this reason, in the present invention, it is necessary that an equivalent circle diameter of the compound is defined to be from 0.5 μm to 5 μm and an abundance is defined to be from 250 pieces/mm$^2$ to $7\times10^5$ pieces/mm$^2$ in a cross-section for an appropriate Si based intermetallic compound. If the abundance is less than 250 pieces/mm$^2$, bias occurs in a liquid phase to be generated and thus well bonding is not obtained. If the abundance is more than $7\times10^5$ pieces/mm$^2$, a reaction area of the particles and the matrices are too large. Thus, an amount of the liquid phase is rapidly increased and deformation easily occurs. Consequently, the abundance of the Si based intermetallic compound is set to be from 250 pieces/mm$^2$ to $7\times10^5$ pieces/mm$^2$. The abundance is preferably from $1\times10^3$ pieces/mm$^2$ to $1\times10^5$ pieces/mm$^2$.

In the aluminum alloy material according to the present invention, an Al based intermetallic compound is present in a form of dispersion particles, in addition to a Si based intermetallic compound generated by using a basic composition (Al—Si alloy). The Al based intermetallic compound is an intermetallic compound generated by using Al and an addition element. Examples of the intermetallic compound generated by using Al and an addition element include compounds of Al—Fe, Al—Fe—Si, Al—Mn—Si, Al—Fe—Mn, and Al—Fe—Mn—Si. The Al based intermetallic compound is different from the Si intermetallic compound in that the Al—Fe—Mn—Si based intermetallic compound does not largely contribute to liquid phase generation, but the Al based intermetallic compound is dispersion particles being in charge of material strength along with the matrix. It is necessary that the number of the Al based intermetallic compound having an equivalent circle diameter of 0.5 μm to 5 μm is 100 pieces/mm$^2$ to $7\times10^5$ pieces/mm$^2$ in a material cross-section. When the number of the particles is less than 100 pieces/mm$^2$, deformation occurs due to strength degradation. When the number of the particles is more than $7\times10^5$ pieces/mm$^2$, a nucleus for recrystallization is increased, and the crystal particles are pulverized, and thus deformation occurs. Consequently, the abundance of the Al based intermetallic compound is set to be from 100 pieces/mm$^2$ to $7\times10^5$ pieces/mm$^2$. The abundance is preferably from $1\times10^3$ pieces/mm$^2$ to $1\times10^5$ pieces/mm$^2$.

The equivalent circle diameter of the dispersion particle may be determined by performing SEM observation of a cross-section (reflected electron image observation). Here, the equivalent circle diameter corresponds to a diameter of an equivalent circle. It is preferable that image analysis is performed on a SEM picture and thus an equivalent circle diameter of the dispersion particle before bonding is obtained. The Si based intermetallic compound and the Al based intermetallic compound may be distinguished from each other by using light and shade of contrast in SEM-reflected electron image observation. The metal type of the dispersion particle may be accurately specified by using an EPMA (X-ray microanalyzer).

The aluminum alloy material which is described above, and has features in Si and Fe concentration ranges and metal structure enables bonding by the bonding property thereof, and may be used as the fin material for the heat exchanger according to the present invention.

As described above, addition amounts of Si, Fe, and Mn as essential elements are defined such that the aluminum alloy material in the first embodiment performs a basic function of the bonding property. In order to further improve strength in addition to the basic function of the bonding property, predetermined amounts of Mn, Mg, and Cu are added as addition elements in addition to Si and Fe which are the essential elements, in the aluminum alloy material according to the second embodiment. In the second embodiment, the surface density in a cross-section of the Si based intermetallic compound and the Al based intermetallic compound is defined similarly to in the first embodiment.

8-3. Selective Element

Mn is an important addition element with Si which is used for forming an Al—Mn—Si based intermetallic compound, and is used for acting for dispersion reinforcement, or improving strength by being solid-soluted in an aluminium parent phase and performing solid solution reinforcement. If an addition amount of Mn is more than 2.0%, a coarse intermetallic compound is easily formed and corrosion resistance is degraded. Accordingly, the addition amount of Mn is set to be equal to or less than 2.0%. The addition amount of Mn is preferably set to 0.05% to 2.0%. In the present invention, regarding other alloy components in addition to Mn, 0% is included in a case of being equal to or less than a predetermined addition amount.

Mg is used for improving strength by age-hardening. The age-hardening occurs by $Mg_2Si$ after bonding and heating. That is, Mg is an addition element for showing an effect of improving strength. If an addition amount of Mg is more than 2.0%, since Mg reacts with flux so as to form a high-melting point compound, the bonding property is significantly degraded. Accordingly, the addition amount of Mg is set to be equal to or less than 2.0%. The addition amount of Mg is preferably from 0.05% to 2.0%.

Cu is an addition element which is solid-soluted in the matrix and thus is used for improving strength. If an addition amount of Cu is more than 1.5%, corrosion resistance is degraded. Accordingly, the addition amount of Cu is set to be equal to or less than 1.5%. The addition amount of Cu is preferably set to be from 0.05% to 1.5%.

In the present invention, in order to further improve strength or corrosion resistance, as an addition element other than the above addition elements, each or a plurality of Ti, V, Cr, Ni, and Zr may be selectively added. Each selective addition element will be described below.

Ti and V have an effect of improving strength by being solid-soluted in the matrix and have an effect of preventing progress of corrosion in the sheet thickness direction by being distributed to have a layer shape. If each of Ti and V is more than 0.3%, a large crystallized material is generated and thus moldability and corrosion resistance are prevented. Accordingly, each of addition amounts of Ti and V is preferably set to be equal to or less than 0.3% and more preferably set to be from 0.05% to 0.3%.

Cr serves to improve strength by solid solution reinforcement and to cause crystal particles after heating to be coarse by depositing the Al—Cr based intermetallic compound. If Cr is more than 0.3%, a coarse intermetallic compound is easily formed, and thus plastic processability is degraded. Thus, an addition amount of Cr is preferably set to be equal to or less than 0.3%, and is more preferably set to be from 0.05% to 0.3%.

Ni is crystallized or deposited as an intermetallic compound, and shows an effect of improving strength after bonding, by dispersion reinforcement. An addition amount of Ni is preferably set to be in a range of 2.0% or less, and is more preferably set to be in a range of 0.05% to 2.0%. If a content of Ni is more than 2.0%, a coarse intermetallic compound is easily formed, and thus processability is degraded, and self-corrosion resistance is also degraded.

Zr is deposited as the Al—Zr based intermetallic compound and shows an effect of improving strength after bonding, by dispersion reinforcement. The Al—Zr based intermetallic compound serves to cause crystal particles in heating to be coarse. If Zr is more than 0.3%, a coarse intermetallic compound is easily formed, and thus plastic processability is degraded. Thus, an addition amount of Zr is preferably set to be equal to or less than 0.3%, and is more preferably set to be from 0.05% to 0.3%.

In addition to the selective addition element mainly for improving strength as described above, a selective addition element for improving corrosion resistance may be added. As the selective addition element for improving corrosion resistance, Zn, In, and Sn are exemplified.

Addition of Zn is effective for improving corrosion resistance by the sacrificial corrosion resistance action. Zn is substantially uniformly solid-soluted in the matrix. However, if the liquid phase is generated, Zn is eluted in the liquid phase and thus Zn in the liquid phase becomes in a high concentration. If the liquid phase bleeds to the surface, the Zn concentration at a portion of the surface at which the liquid phase bleeds is increased. Thus, corrosion resistance is improved by the sacrificial anode action. When the aluminum alloy material according to the present invention is applied to a heat exchanger, the aluminum alloy material according to the present invention is used in a fin and thus a sacrificial corrosion resistance action for prevention of corrosion in a tube and the like may work. If an addition amount of Zn is more than 6.0%, the corrosion rate becomes fast and self-corrosion resistance is degraded. Accordingly, the amount of Zn is preferably set to be equal to or less than 6.0%, and more preferably from 0.05% to 6.0%.

Sn and In show an effect of performing the sacrificial anode action. If addition amounts of Sn and In are more than 0.3%, the corrosion rate becomes fast and self-corrosion resistance is degraded. Thus, the addition amount of each of Sn and In is preferably set to be equal to or less than 0.3%, and more preferably from 0.05% to 0.3%.

In the above-described aluminum alloy material, a selective element which causes characteristics of the liquid phase to be improved and thus causes the bonding property to be better may be further added. As such an element, 0.1% or less of Be, 0.1% or less of Sr, 0.1% or less of Bi, 0.1% or less of Na, and 0.05% or less of Ca are preferably used, and if necessary, one or more types of these elements are added. A more preferable range of each of the elements is as follows: Be: 0.0001% to 0.1%, Sr: 0.0001% to 0.1%, Bi: 0.0001% to 0.1%, Na: 0.0001% to 0.1%, and Ca: 0.0001% to 0.05%. These trace elements enable the bonding property to be improved by fine dispersion of Si particles, improvement of flowability of the liquid phase, and the like. If these trace elements are less than the more preferably defined range, fine dispersion of Si particles or an effect of improvement of flowability of the liquid phase may insufficiently occur. If the trace elements are more than the more preferably defined range, a problem such as degradation of corrosion resistance may occur. When one of Be, Sr, Bi, Na, and Ca is added, or when any two types or more are added, any of the above elements is added within the above preferable component range or within the above more preferable component range.

Fe and Mn form the Al—Fe—Mn—Si based intermetallic compound along with Si. Since Si for generating the Al—Fe—Mn—Si based intermetallic compound contributes small to generation of the liquid phase, the bonding property is degraded. For this reason, when Fe and Mn are added to the aluminum alloy material according to the present invention, the addition amounts of Si, Fe, and Mn are preferably noticed. Specifically, when the contents (mass %) of Si, Fe, and Mn are respectively set as S, F, and M, a relational expression of $1.2 \leq S-0.3(F+M) \leq 3.5$ is preferably satisfied. When $S-0.3(F+M)$ is less than 1.2, bonding is insufficient. When $S-0.3(F+M)$ is more than 3.5, a shape is easily deformed before and after bonding.

8-4. Manufacturing Method of Aluminum Alloy Material Used in Fin Material

A manufacturing method of the aluminum alloy material used in the fin material according to the second embodiment will be described. The aluminum alloy material may be manufactured by using a continuous casting method, a direct chill (DC) casting method, or an extrusion method. The continuous casting method is not particularly limited as long as a method of continuously casting a sheet material, such as a twin roll type continuous casting rolling method and a twin belt type continuous casting method, is used. The twin roll type continuous casting rolling method is a method in which molten aluminum is supplied to a space between a pair of water cooling rolls from a hot-water supply nozzle formed of a refractory material, and a thin sheet is continuously subjected to casting and rolling. As the twin roll type continuous casting rolling method, a Hunter method, a 3C method, or the like has been known. The twin belt type continuous casting method is a continuous casting method in which molten metal is poured to a space between rotation belts which are disposed up and down so as to face each other, and are water-cooled, the molten metal is solidified by cooling from surfaces of the belts so as to form a slab, and the slab is continuously drawn from a side of the belt opposite to a surface on which a supply of the molten metal is performed, and is wound so as to have a coil shape.

In the twin roll type continuous casting rolling method, a cooling rate in casting is faster than that in the DC casting method by several times to several hundred times. For example, a cooling rate in a case of the DC casting method is from 0.5° C./sec to 20° C./sec. On the contrary, the cooling rate in a case of the twin roll type continuous casting rolling method is from 100° C./sec to 1000° C./sec. For this reason, the twin roll type continuous casting rolling method has features in which dispersion particles generated in casting are fine and have high density distribution in comparison to the DC casting method. The dispersion particle which is distributed with high density may react with matrices around the dispersion particles so as to easily generate large quantity of the liquid phase in bonding. Thus, the generated liquid phase causes the good bonding property to be obtained.

In the twin roll type continuous casting rolling method, a speed of a rolled sheet during casting is preferably from 0.5 m pieces/minute to 3 m pieces/minute. The casting rate has an influence on a cooling rate. When the casting rate is less than 0.5 m pieces/minute, the sufficient cooling rate is not obtained and the compound becomes coarse. When the casting rate is greater than 3 m pieces/minute, an aluminum material is not sufficiently solidified between the rolls during casting and thus a normal ingot sheet is not obtained.

In the twin roll type continuous casting rolling method, a molten metal temperature during casting is preferably in a range from 650° C. to 800° C. The molten metal temperature is a temperature of a headbox which is disposed right ahead of the hot-water supply nozzle. When the molten metal temperature is lower than 650° C., large dispersion particles of the intermetallic compound are generated in the hot-water supply nozzle and these large dispersion particles are mixed and inserted into an ingot. This is a reason of sheet crack in cold rolling. If the molten metal temperature is greater than 800° C., an aluminum material is not sufficiently solidified between the rolls during casting and thus a normal ingot sheet is not obtained. The molten metal temperature is more preferably from 680° C. to 750° C.

The thickness of a sheet to be casted is preferably from 2 mm to 10 mm. In this thickness range, a solidification rate at the sheet thickness center portion is also fast and a uniform structure is easily obtained. If the casted sheet thickness is less than 2 mm, an amount of aluminum passing through a casting machine per unit time is small and stable. Thus, supplying of molten metal in a width direction of a sheet is difficult. If the casted sheet thickness is greater than 10 mm, winding by rolls is difficult. The casted sheet thickness is more preferably from 4 mm to 8 mm.

In a process in which the obtained casted sheet material is subjected to rolling processing so as to have a final sheet thickness, annealing may be performed once or more. Regarding a conditioning, an appropriate conditioning is selected depending on use. Generally, an H1n or H2n conditioning for preventing erosion is selected. However, an annealing material may be used in accordance with a shape or a using method.

When the aluminum alloy material according to the present invention is manufactured by using the DC continuous casting method, the casting rate of a slab or a billet in casting is preferably controlled. Since the casting rate has an influence on the cooling rate, the casting rate is preferably from 20 mm pieces/minute to 100 m pieces/minute. When the casting rate is less than 20 mm pieces/minute, the sufficient cooling rate is not obtained and the compound becomes coarse. When the casting rate is greater than 100 m pieces/minute, an aluminum material in casting is not sufficiently solidified and a normal ingot is not obtained. The casting rate is more preferably from 30 mm pieces/minute to 80 mm pieces/minute.

A slab thickness in DC continuous casting is preferably equal to or less than 600 mm. When the slab thickness is greater than 600 mm, the sufficient cooling rate is not obtained and the intermetallic compound becomes coarse. The slab thickness is more preferably equal to or less than 500 mm.

The slab is manufactured by using the DC casting method, and then homogenizing treatment, hot-rolling, cold rolling, and annealing may be performed if necessary. Conditioning is performed depending on use. As the conditioning, H1n or H2n for preventing erosion is generally selected. A soft material may be used in accordance with a shape or a using method.

9. Fin Material (Third Embodiment)

The heat exchanger according to the present invention is manufactured and obtained by using a material having a bonding function in a single layer, as the fin material which is a material before bonding. However, the heat exchanger is also manufactured and obtained by using a material having a bonding function in a single layer instead of the fin material according to the first and second embodiments. Specifically, an aluminum alloy which contains 1.0% to 5.0% of the Si concentration and 0.01% to 2.0% of Fe as essential elements and uses an Al—Fe—Mn—Si aluminum alloy formed from residual Al and inevitable impurities including Mn, as a basic composition is used. In a metal structure of the above-described aluminum alloy, Al based intermetallic compound having an equivalent circle diameter of 0.01 μm to 0.5 μm are present, Si based intermetallic compound having an equivalent circle diameter of 5 μm to 10 μm are present, the number of the Al based intermetallic compound is from 10 pieces/$\mu m^3$ to $1\times10^4$ pieces/$\mu m^3$, and the number of the Si based intermetallic compound is equal to or less than 200 pieces/$mm^2$. Features of the aluminum alloy will be described below.

9-1. Regarding Essential Element

Regarding Si Concentration

Regarding a Si concentration, Si is an element for generating an Al—Si liquid phase and contributing to bonding. When the Si concentration is less than 1.0%, generation of a liquid phase having a sufficient amount is impossible, the liquid phase bleeds small, and thus bonding is performed incompletely. When the Si concentration is more than 5.0%, since an amount of generated liquid phase in an aluminum alloy material is increased, material strength during heating is greatly degraded and holding of a shape of the structural object is difficult. Thus, the Si concentration is determined to be from 1.0% to 5.0%. The Si concentration is preferably from 1.5% to 3.5%, and more preferably from 2.0% to 3.0%. An amount of bleeding of the liquid phase is increased as the volume becomes larger and the heating temperature becomes higher. Thus, regarding the amount of the liquid phase required in heating, the Si content or the bonding heating temperature required in accordance with a structure of the structural object to be manufactured is preferably adjusted.

Regarding Fe Concentration

Regarding a Fe concentration, Fe has an effect of prevention of strength degradation particularly at a high temperature by dispersing solid-soluted Fe as a crystallized material or a deposit material, in addition to having an effect of improving strength by solid-soluting a small amount of Fe in the matrix. When an addition amount of Fe is less than 0.01%, the above effects show small, and using of base metal having high purity is necessary. Thus, cost is increased. If the addition amount of Fe is more than 2.0%, a coarse intermetallic compound is generated in casting and a problem in manufacturability occurs. When this bonding object is exposed under a corrosion environment (particularly, corrosion environment as with circulating of a liquid), corrosion resistance is degraded. Since crystal particles recrystallized by heating during bonding are pulverized and the particle boundary density is increased, a change of dimensions between before and after bonding becomes larger. Accordingly, the addition amount of Fe is set to be from 0.01% to 2.0%. The preferable addition amount of Fe is from 0.2% to 1.0%.

9-2. Regarding Al Based Intermetallic Compound

Next, features of a metal structure of an aluminum alloy material according to the present invention will be described. The aluminum alloy material according to the present invention is heated by using a MONOBRAZE method in bonding and heating so as to be equal to or higher than a solidus temperature. At this time, aluminum alloy material particles often slip on each other at particle boundaries and thus the aluminum alloy material is deformed. Here, as the metal structure, (1) it is desired that crystal particles are coarse in bonding and heating. (2) If a liquid phase is generated at the particle boundary, since deformation easily occurs due to slipping at the particle boundary, it is desired that generation of the liquid phase at the particle boundary is suppressed. In the present invention, a metal structure in which crystal particles after heating are coarse and generation of the liquid phase at the particle boundary is suppressed is defined.

That is, in the aluminum alloy material according to the present invention, which has the bonding function by heating in a single layer, Al based intermetallic compound having an equivalent circle diameter of 0.01 μm to 0.5 μm are present as dispersion particles. The Al based intermetallic compound is an intermetallic compound generated by using Al and an addition element. Examples of the Al based intermetallic compound include compounds of Al—Fe, Al—Fe—Si, Al—Mn—Si, Al—Fe—Mn, and Al—Fe—Mn—Si. The Al based intermetallic compound having an equivalent circle diameter of 0.01 μm to 0.5 μm act as pinning particles of suppressing growth of the grain boundary, not as recrystallization nuclei in heating. The Al based intermetallic compound become nuclei generated by using the liquid phase and function to collect Si solid solution in a particle. Since the aluminum alloy material according to the present invention has Al based intermetallic compound which have an equivalent circle diameter of 0.01 μm to 0.5 μm, growth of many recrystallization nuclei in heating is suppressed. Since only recrystallization nuclei of the limited number are growing, crystal particles after heating are coarse. Generation of the liquid phase at the particle boundary is relatively suppressed by collecting Si solid solution in a particle.

Effects of the Al based intermetallic compound are more reliably shown by causing a volume density of the Al based intermetallic compound to be in an appropriate range. Specifically, the Al based intermetallic compound having a volume density of 10 pieces/$\mu m^3$ to $1\times10^4$ pieces/$\mu m^3$ at a certain portion in the material are present. When the volume density is less than 10 pieces/$\mu m^3$, a pinning effect is small. Thus, many growable recrystallized particles are generated and forming of coarse crystal particles is difficult. Since nuclei for generation of the liquid phase is reduced, an action of collecting the Si solid solution in a particle does not work sufficiently, a proportion of the Si solid solution in the particle contributing to growth of a liquid phase generated at the particle boundary is increased, and deformation resistance is degraded. When the volume density is more than $1\times10^4$ pieces/$\mu m^3$, the pinning effect is excessively large. Thus, growth of all recrystallized particles is suppressed and forming of coarse crystal particles is difficult. Since nuclei for generation of the liquid phase is too many, the liquid phase which directly comes into contact with the particle boundary is increased and the liquid phase at the particle boundary is more growing. Thus, the volume density is set to be in the volume density range such that the pinning effect of appropriate strength causes only the crystal particles of the limited number to grow and the crystal particles become coarse, and such that nuclei of an appropriate amount, which are used for generation of the liquid phase are formed and the Si solid solution in the particle is collected so as to suppress generation of the liquid phase at the particle boundary. The volume density is preferably from 50 pieces/$\mu m^3$ to $5\times10^3$ pieces/$\mu m^3$ and more preferably from 100 pieces/$\mu m^3$ to $1\times10^3$ pieces/$\mu m^3$.

The Al based intermetallic compound having an equivalent circle diameter of less than 0.01 μm are excluded from a target because measurement is substantially difficult. The Al based intermetallic compound having an equivalent circle diameter of greater than 0.5 μm are present, but hardly act as effective pinning particles. Thus, an influence on the effects according to the present invention is small and the Al based intermetallic compound having an equivalent circle diameter of greater than 0.5 μm are excluded from the defined target. The Al based intermetallic compound having an equivalent circle diameter of greater than 0.5 μm may act as nuclei for generating the liquid phase. However, since the effect of collecting the Si solid solution in the particle is determined based on a distance from a compound surface, a Si solid solution collection effect per volume of the compound is small in the Al based intermetallic compound having an equivalent circle diameter of greater than 0.5 μm. Accordingly, the Al based intermetallic compound having an equivalent circle diameter of greater than 0.5 μm is excluded from the target.

A sample subjected to thin-wall processing by electrolytic polishing is observed by a TEM and thus the equivalent circle diameter of the Al based intermetallic compound may be determined. Here, the equivalent circle diameter corresponds to a diameter of an equivalent circle. It is preferable that image analysis is performed on a TEM observation image as a two-dimensional image, similarly to the SEM observation image, and thus an equivalent circle diameter of the particles before bonding is obtained. In order to calculate the volume density, a film thickness of the sample is also measured in visual field in which TEM observation is performed, by using an EELS method and the like. After image analysis is performed on the TEM observation image as a two-dimensional image, the film thickness measured by using the EELS method is multiplied by a measured area of the two-dimensional image and thus a measured volume is obtained, and the volume density is calculated. If the film thickness of the sample is too thick, the number of overlapped particles in a transmission direction of an electron is increased and accurate measurement is difficult. Thus, it is desired that a portion having a film thickness in a range of 50 nm to 200 nm is measured. The Si based intermetallic compound and the Al based intermetallic compound are distinguished from each other with more accuracy by performing element analysis using an EDS and the like.

The aluminum alloy material itself according to the present invention, which is described above, has features in Si and Fe concentration ranges and metal structure, and has the bonding function by heating in a single layer has a half melt state during the bonding and heating, and thereby enables bonding by supplying the liquid phase and has excellent deformation resistance.

9-3. Regarding Si Based Intermetallic Compound

In the aluminum alloy material according to the present invention, in addition to regulations relating to the Al based intermetallic compound, regulations relating to the Si based intermetallic compound are present. In the aluminum alloy material according to the present invention, the Si based intermetallic compound which have an equivalent circle diameter of 5.0 μm to 10 μm and have 200 pieces/mm$^2$ or less are present in a cross-section of the material. The Si based intermetallic compound is (1) singleton Si and (2) a compound obtained by including other elements at a portion of singleton Si. As other elements, Ca, P, or the like is included. The cross-section in the material is a certain cross-section of the aluminum alloy material. For example, the cross-section may be a cross-section along the thickness direction or be a cross-section parallel with a surface of a sheet material. From a viewpoint of simplicity for material evaluation, the cross-section along the thickness direction is preferably employed.

Here, the Si based intermetallic compound having an equivalent circle diameter of 5.0 μm to 10 μm function as nuclei for recrystallization in heating. For this reason, if the surface density of the Si based intermetallic compound is more than 200 pieces/mm$^2$, the recrystallization nuclei become many and crystal particles become fine. Thus, deformation resistance in bonding and heating is degraded. If the surface density of the Si based intermetallic compound is equal to or less than 200 pieces/mm$^2$, the number of the recrystallization nuclei is small, and only specified crystal particles are growing. Thus, coarse crystal particles are obtained and deformation resistance in bonding and heating is improved. The surface density is preferably equal to or less than 20 pieces/mm$^2$. As the number of the Si based intermetallic compound having an equivalent circle diameter of 5.0 μm to 10 μm becomes small, deformation resistance is improved. Thus, the surface density is most preferably 0 pieces/mm$^2$.

The reason that the equivalent circle diameter of the Si based intermetallic compound is limited to being from 5.0 μm to 10 μm is as follows. Si based intermetallic compound of less than 5.0 μm are present, but functioning as the nuclei for recrystallization is difficult, and thus the Si based intermetallic compound of less than 5.0 μm are excluded from the target. The Si based intermetallic compound having an equivalent circle diameter of greater than 10 μm cause crack in manufacturing and thus cause manufacturing to be difficult. Accordingly, there is no aluminum alloy in which the Si based intermetallic compound having such a large equivalent circle diameter are included, and the Si based intermetallic compound having an equivalent circle diameter of greater than 10 μm are excluded from the target.

The equivalent circle diameter of the Si based intermetallic compound particle may be determined by performing SEM observation of a cross-section (reflected electron image observation). Here, the equivalent circle diameter corresponds to a diameter of an equivalent circle. It is preferable that image analysis is performed on a SEM picture and thus an equivalent circle diameter of the dispersion particle before bonding is obtained. The surface density may be calculated based on an image analysis result and a measured area. The Si based intermetallic compound and the Al based intermetallic compound may be distinguished from each other by using light and shade of contrast in SEM-reflected electron image observation. The metal type of the dispersion particle may be accurately specified by using an EPMA (X-ray microanalyzer).

9-4. Regarding Amount of Si Solid Solution

In the aluminum alloy material, amount of the Si solid solution is defined in addition to regulations of the Al based intermetallic compound and the Si based intermetallic compound. In the aluminum alloy material according to the present invention, the amount of the Si solid solution before bonding by using the MONOBRAZE method is preferably equal to or less than 0.7%. The amount of the Si solid solution is a measured value at the room temperature of 20° C. to 30° C. As described above, the Si solid solution is diffused in a form of a solid phase during heating, and contributes to growth of the surrounding liquid phase. If the amount of the Si solid solution is equal to or less than 0.7%, an amount of liquid phase generated at the particle boundary becomes small by diffusing the Si solid solution and deformation during heating may be suppressed. If the amount of the Si solid solution is more than 0.7%, an amount of Si which is taken in the liquid phase generated at the particle boundary is increased. As a result, the amount of the liquid phase generated at the particle boundary is increased and deformation easily occurs. The amount of the Si solid solution is more preferably equal to or less than 0.6%. A lower limit value of the amount of the Si solid solution is not particularly limited, but is naturally determined based on the Si content and the manufacturing method of the aluminum alloy. In the present invention, the lower limit value is 0%.

9-5. Regarding First Selective Addition Element

As described above, the aluminum alloy material according to the present invention, which has the bonding function by heating in a single layer contains predetermined amounts of Si and Fe as essential elements in order to improve deformation resistance in bonding and heating. In order to further improve strength, a predetermined amount of one or more types selected from Mn, Mg, and Cu is added as a first selective addition element, in addition to Si and Fe as essential elements. When the aluminum alloy material contains such a first selective addition element, the volume density of the Al based intermetallic compound and the surface density of the Si based intermetallic compound are also defined as described above.

Mn is an important addition element with Si and Fe, which is used for forming the based intermetallic compound of Al—Mn—Si, Al—Mn—Fe—Si, and Al—Mn—Fe, and is used for acting for dispersion reinforcement, or improving strength by being solid-soluted in an aluminum parent phase and performing solid solution. If an addition amount of Mn is more than 2.0%, a coarse intermetallic compound is easily formed and corrosion resistance is degraded. If the addition amount of Mn is less than 0.05%, the above effects show insufficiently. Accordingly, the addition amount of Mn is set to be from 0.05% to 2.0%, and is more preferably from 0.1% to 1.5%.

Mg is used for improving strength by age-hardening. The age-hardening occurs by $Mg_2Si$ after bonding and heating. That is, Mg is an addition element for showing an effect of improving strength. If an addition amount of Mg is more than 2.0%, since Mg reacts with flux so as to form a high-melting point compound, the bonding property is significantly degraded. If the addition amount of Mg is less than 0.05%, the above effects show insufficiently. Accordingly, the addition amount of Mg is set to be from 0.05% to 2.0%, and is more preferably from 0.1% to 1.5%.

Cu is an addition element which is solid-soluted in the matrix and thus is used for improving strength. If an addition amount of Cu is more than 1.5%, corrosion resistance is degraded. If the addition amount of Cu is less than 0.05%, the above effects show insufficiently. Accordingly, the addition amount of Cu is set to be from 0.05% to 1.5%, and is more preferably from 0.1% to 1.0%.

9-6. Regarding Second Selective Addition Element

In the present invention, in order to further improve corrosion resistance, a predetermined amount of one or more types selected from Zn, In, and Sn is added as a second selective addition element, in addition to the essential element and/or the first selective addition element. When the aluminum alloy material contains such a second selective addition element, the volume density of the Al based intermetallic compound and the surface density of the Si based intermetallic compound are also defined as described above.

Addition of Zn is effective for improving corrosion resistance by the sacrificial corrosion resistance action. Zn is substantially uniformly solid-soluted in the matrix. However, if the liquid phase is generated, Zn is eluted in the liquid phase and thus Zn in the liquid phase becomes in a high concentration. If the liquid phase bleeds to the surface, the Zn concentration at a portion of the surface at which the liquid phase bleeds is increased. Thus, corrosion resistance is improved by the sacrificial anode action. When the aluminum alloy material according to the present invention is applied to a heat exchanger, the aluminum alloy material according to the present invention is used in a fin and thus a sacrificial corrosion resistance action for prevention of corrosion in a tube and the like may work. If an addition amount of Zn is more than 6.0%, the corrosion rate becomes fast and self-corrosion resistance is degraded. Accordingly, the addition amount of Zn is set to be equal to or less than 6.0%, and preferably from 0.05% to 6.0%.

Sn and In show an effect of performing the sacrificial anode action. If addition amounts of Sn and In are more than 0.3%, the corrosion rate becomes fast and self-corrosion resistance is degraded. Thus, the addition amount of each of Sn and In is set to be equal to or less than 0.3%, and preferably from 0.05% to 0.3%.

9-7. Regarding Third Selective Addition Element

In the present invention, in order to further improve strength or corrosion resistance, a predetermined amount of one or more types selected from Ti, V, Cr, Ni, and Zr is added as a third selective addition element, in addition to any one of the essential element, the first selective addition element, and the second selective addition element. When the aluminum alloy material contains such a third selective addition element, the volume density of the Al based intermetallic compound and the surface density of the Si based intermetallic compound are also defined as described above.

Ti and V have an effect of improving strength by being solid-soluted in the matrix and have an effect of preventing progress of corrosion in the sheet thickness direction by being distributed to have a layer shape. If each of addition amounts of Ti and V is more than 0.3%, a coarse crystallized material is generated and thus moldability and corrosion resistance are prevented. Accordingly, each of addition amounts of Ti and V is set to be equal to or less than 0.3% and preferably set to be from 0.05% to 0.3%.

Cr serves to improve strength by solid solution reinforcement and to cause crystal particles after heating to be coarse by depositing the Al—Cr based intermetallic compound. If an addition amount of Cr is more than 0.3%, a coarse intermetallic compound is easily formed, and thus plastic processability is degraded. Thus, the addition amount of Cr is set to be equal to or less than 0.3%, and is preferably set to be from 0.05% to 0.3%.

Ni is crystallized or deposited as an intermetallic compound, and shows an effect of improving strength after bonding, by dispersion reinforcement. An addition amount of Ni is set to be in a range of 2.0% or less, and is preferably set to be in a range of 0.05% to 2.0%. If a content of Ni is more than 2.0%, a coarse intermetallic compound is easily formed, and thus processability is degraded, and self-corrosion resistance is also degraded.

Zr is deposited as the Al—Zr based intermetallic compound and shows an effect of improving strength after bonding, by dispersion reinforcement. The Al—Zr based intermetallic compound serves to cause crystal particles in heating to be coarse. If an addition amount of Zr is more than 0.3%, a coarse intermetallic compound is easily formed, and thus plastic processability is degraded. Thus, the addition amount of Zr is set to be equal to or less than 0.3%, and is preferably set to be from 0.05% to 0.3%.

9-8. Regarding Fourth Selective Addition Element

In the aluminum alloy material according to the present invention, in order to improve characteristics of the liquid phase and to cause the bonding property to be better, a predetermined amount of one or more types selected from Be, Sr, Bi, Na, and Ca may be further added as a fourth selective addition element in addition to any one of the essential element, and the first to third selective addition elements. When the aluminum alloy material contains such a fourth selective addition element, the volume density of the Al based intermetallic compound and the surface density of the Si based intermetallic compound are also defined as described above.

As such an element, 0.1% or less of Be, 0.1% or less of Sr, 0.1% or less of Bi, 0.1% or less of Na, and 0.05% or less of Ca are preferably used, and if necessary, one or more types of these elements are added. A preferable range of each of the elements is as follows: Be: 0.0001% to 0.1%, Sr: 0.0001% to 0.1%, Bi: 0.0001% to 0.1%, Na: 0.0001% to 0.1%, and Ca: 0.0001% to 0.05%. These trace elements enable the bonding property to be improved by fine dispersion of Si particles, improvement of flowability of the liquid phase, and the like. If these trace elements are less than the more preferably defined range, fine dispersion of Si particles or improvement of flowability of the liquid phase may insufficiently occur. If the trace elements are more than the more preferably defined range, a problem such as degradation of corrosion resistance may occur.

9-9. Relationship Between Contents of Si, Fe, and Mn

Any one of Fe and Mn forms the Al—Fe—Mn—Si based intermetallic compound along with Si. Since Si for generating the Al—Fe—Mn—Si based intermetallic compound contributes small to generation of the liquid phase, the bonding property is degraded. For this reason, when Fe and Mn are added to the aluminum alloy material according to the present invention, the addition amounts of Si, Fe, and Mn are preferably noticed. Specifically, when the contents (mass %) of Si, Fe, and Mn are respectively set as S, F, and M, a relational expression of $1.2 \leq S-0.3(F+M) \leq 3.5$ is preferably satisfied. When $S-0.3(F+M)$ is less than 1.2, bonding is insufficient. When $S-0.3(F+M)$ is more than 3.5, a shape is easily deformed before and after bonding.

9-10. Tensile Strength Before Bonding by Using MONOBRAZE Method

In the aluminum alloy material, tensile strength before bonding by using the MONOBRAZE method is preferably from 80 MPa to 250 MPa. If the tensile strength is less than 80 MPa, strength necessary for molding of a product is insufficient, and molding is impossible. If the tensile strength is greater than 250 MPa, a shape retaining property after molding is bad. In addition, when the molded product is assembled as the bonding object, a gap between the product and other members may occur, and thus the bonding property is deteriorated. The tensile strength before bonding by using the MONOBRAZE method has a measured value at the room temperature of 20° C. to 30° C. A ratio (T/T0) of tensile strength (T0) before bonding by using the MONOBRAZE method and tensile strength (T) after bonding is preferably in a range of 0.6 to 1.1. When (T/T0) is less than 0.6, strength of the material is insufficient and a function as the structural object may fail. If (T/T0) is greater than 1.1, deposition at the particle boundary may occur too much and intergranular corrosion may easily occur.

9-11. Manufacturing Method for Aluminum Alloy Material Used in Fin Material 9-11-1. Casting Process The manufacturing method of the aluminum alloy material used in the fin material according to the third embodiment will be described. The aluminum alloy material is manufactured by using the continuous casting method. In the continuous casting method, since the cooling rate in solidification is fast, forming of the coarse crystallized material is difficult, and forming of the Si based intermetallic compound having an equivalent circle diameter of 5.0 μm to 10 μm is suppressed. As a result, only specific crystal particles which enable the number of recrystallization nuclei to be small are growing and coarse crystal particles are obtained. Since amounts of solid solution of Mn, Fe, and the like are increased, forming of the Al—Fe—Mn—Si based intermetallic compound having an equivalent circle diameter of 0.01 μm to 0.5 μm is accelerated in the subsequent processing process. In this manner, only the crystal particles of the limited number to grow, the crystal particles become coarse, generation of the liquid phase at the particle boundary is suppressed, and deformation resistance is improved by forming the Al—Fe—Mn—Si based intermetallic compound having an equivalent circle diameter of 0.01 μm to 0.5 μm which cause the pinning effect of appropriate strength and the effect of collecting the Si solid solution in a particle to be obtained.

In the continuous casting method, the amount of the Si solid solution in the matrix is reduced by forming the Al—Fe—Mn—Si based intermetallic compound having an equivalent circle diameter of 0.01 μm to 0.5 μm. As a result, the amount of the Si solid solution supplied to the particle boundary during bonding and heating is more reduced, generation of the liquid phase at the particle boundary is suppressed, and deformation resistance is improved.

The continuous casting method is not particularly limited as long as a method of continuously casting an ingot sheet, such as a twin roll type continuous casting rolling method and a twin belt type continuous casting method, is used. The twin roll type continuous casting rolling method is a method in which molten aluminum is supplied to a space between a pair of water cooling rolls from a hot-water supply nozzle formed of a refractory material, and a thin sheet is continuously subjected to casting and rolling. As the twin roll type continuous casting rolling method, a Hunter method, a 3C method, or the like has been known. The twin belt type continuous casting method is a continuous casting method in which molten metal is poured to a space between rotation belts which are disposed up and down so as to face each other, and are water-cooled, the molten metal is solidified by cooling from surfaces of the belts so as to form a slab, and the slab is continuously drawn from a side of the belt opposite to a surface on which a supply of the molten metal is performed, and is wound so as to have a coil shape.

In the twin roll type continuous casting rolling method, a cooling rate in casting is faster than that in the half continuous casting method by several times to several hundred times. For example, a cooling rate in a case of the half continuous casting method is from 0.5° C./second to 20° C./second. On the contrary, the cooling rate in a case of the twin roll type continuous casting rolling method is from 100° C./second to 1000° C./second. For this reason, the twin roll type continuous casting rolling method has features in which dispersion particles generated in casting are fine and have high density distribution in comparison to the half continuous casting method. With such features, generation of the coarse crystallized material is suppressed and thus crystal particles in bonding and heating become coarse. Since the cooling rate is fast, an amount of a solid solution of the addition element may be increased. Thus, a fine deposit material is formed through the subsequent thermal treatment and contributing to forming of coarse crystal particles in bonding and heating is enabled. In the present invention, the cooling rate in a case of the twin roll type continuous casting rolling method is preferably from 100° C./second to 1000° C./second. When the cooling rate is less than 100° C./second, obtaining of a required metal structure is difficult. When the cooling rate is greater than 1000° C./second, stable manufacturing is difficult.

In the twin roll type continuous casting rolling method, a speed of a rolled sheet during casting is preferably from 0.5 m pieces/minute to 3 m pieces/minute. The casting rate has an influence on a cooling rate. When the casting rate is less than 0.5 m pieces/minute, the sufficient cooling rate as described above is not obtained and the compound becomes coarse. When the casting rate is greater than 3 m pieces/minute, an aluminum material is not sufficiently solidified between the rolls during casting and thus a normal ingot sheet is not obtained.

In the twin roll type continuous casting rolling method, a molten metal temperature during casting is preferably in a range from 650° C. to 800° C. The molten metal temperature is a temperature of a headbox which is disposed right ahead of the hot-water supply nozzle. When the molten metal temperature is lower than 650° C., coarse dispersion particles of the intermetallic compound are generated in the hot-water supply nozzle and these coarse dispersion particles are mixed and inserted into an ingot. This is a reason of sheet crack in cold rolling. If the molten metal temperature is greater than 800° C., an aluminum material is not sufficiently solidified between the rolls during casting and thus a normal ingot sheet is not obtained. The molten metal temperature is more preferably from 680° C. to 750° C.

The sheet thickness of an ingot sheet to be casted by using the twin roll type continuous casting rolling method is preferably from 2 mm to 10 mm. In this thickness range, a solidification rate at the sheet thickness center portion is also fast and a uniform structure is easily obtained. If the casted sheet thickness is less than 2 mm, an amount of aluminum passing through a casting machine per unit time is small and stable. Thus, supplying of molten metal in a width direction of a sheet is difficult. If the casted sheet thickness is greater than 10 mm, winding by rolls is difficult. The casted sheet thickness is more preferably from 4 mm to 8 mm.

In the middle of a process in which an ingot sheet casted by using the twin roll type continuous casting rolling method is subjected to cold rolling so as to have the final sheet thickness, annealing is performed at 250° C. to 550° C. for 1 to 10 hours. The annealing may be performed in any process other than the final cold-rolling in a manufacturing process after casting, and performing of the annealing once or more is required. An upper limit of the number of performing annealing is preferably three, and more preferably two. The annealing is performed in order to soften the material so as to easily obtain desired material strength in the final rolling. The annealing may cause the particle size and density of the intermetallic compound in the material, and an amount of a solid solution of the addition element to be optimally adjusted. If an annealing temperature is less than 250° C., since the material is insufficiently softened, TS is increased before brazing and heating. If Ts is increased before brazing and heating, moldability is deteriorated and dimensions of a core are bad. As a result, durability is degraded. If annealing is performed at a temperature of greater than 550° C., since a quantity of heating applied into the material in the manufacturing process is too much, the intermetallic compound become coarse and are sparsely distributed. The intermetallic compound which are coarse and are sparsely distributed are difficult to take in a solid solution element, and since an amount of the solid solution in the material is reduced, there is a difficulty. The above effect is insufficiently shown when annealing is performed at the annealing temperature for a period of time less than one hour. When annealing is performed for an annealing time exceeding 10 hours, since the above effect is saturated, there is an economical disadvantage.

Conditioning may be performed by using an O material or an H material. In a case of using an H1n material or an H2n material, the final cold-rolling ratio is important. The final cold-rolling ratio is equal to or less than 50%, and is preferably from 5% to 50%. If the final cold-rolling ratio is greater than 50%, many recrystallization nuclei are generated in heating and the grain size after bonding and heating is reduced. If the final cold-rolling ratio is less than 5%, manufacturing may be substantially difficult.

9-11-2. Control of Intermetallic Compound Density in Twin Roll Type Continuous Casting Rolling Method The dispersion particles may be fine through the above-described twin roll type continuous casting rolling method and the subsequent manufacturing process, in comparison to in half continuous casting. However, in order to obtain the metal structure of the aluminum alloy material according to the present invention, controlling of the cooling rate in solidification with more accuracy is important. The inventors find that the cooling rate may be controlled by control of an aluminum coating thickness and sump control in molten metal by using a rolling load.

9-11-3. Control of Aluminum Coating Thickness

The aluminum coating corresponds to a film in which aluminum and aluminum oxide are contained as main components. The aluminum coating formed on a surface of the roll in casting causes the surface of the roll and molten metal to be wet well, and thus causes heat transference between the surface of the roll and the molten metal to be improved. In order to form the aluminum coating, twin roll type continuous casting rolling may be performed on molten aluminum of 680° C. to 740° C. using a rolling load of 500 N pieces/mm or more. In addition, an aluminum alloy sheet for a malleable material which is heated up to 300° C. or more before twin roll type continuous casting rolling may be rolled twice or more at a rolling reduction ratio of greater than 20%. As the molten aluminum or the aluminum alloy sheet used in forming of the aluminum coating, at least 1000-series alloy of the addition element is particularly preferable. However, even when other aluminum alloys are used, coating may be formed. Since the aluminum coating thickness is normally increased during casting, the surface of the roll is coated with 10 μg/cm$^2$ of boron nitride or a carbon release agent (graphite spray or soot) and thus more forming of the aluminum coating is suppressed. Substances on the surface of the aluminum coating may be physically removed by Using a brush roll and the like.

The aluminum coating thickness is preferably from 1 μm to 500 μm. Thus, the cooling rate of the molten metal is adjusted to be optimum, and an aluminum alloy having intermetallic compound density and an amount of the Si solid solution which are excellent in deformation resistance in bonding and heating may be casted. When the aluminum coating thickness is less than 1 μm, since wettability on the surface of the roll and the molten metal is bad, a contact area of the surface of the roll and the molten metal is reduced. Thus, heat transference between the surface of the roll and the molten metal is deteriorated and the cooling rate of the molten metal is decreased. As a result, the intermetallic compound becomes coarse and desired intermetallic compound density is not obtained. If wettability on the surface of the roll and the molten metal is bad, non-contact of the surface of the roll and the molten metal may partially occur. In this case, the ingot is redissolved and the molten metal having high solute concentration bleeds to a surface of the ingot, and surface segregation occurs. Thus, coarse intermetallic compound may be formed on the surface of the ingot. If the aluminum coating thickness is greater than 500 μm, wettability on the surface of the roll and the molten metal is improved. However, because coating is too thick, heat transference between the surface of the roll and the molten metal becomes significantly worse. As a result, since the cooling rate of the molten metal is also reduced in this case, the intermetallic compound become coarse, and desired intermetallic compound density and a desired amount of the Si solid solution are not obtained. The aluminum coating thickness is more preferably from 80 μm to 410 μm.

9-11-4. Sump Control in Molten Metal by Using Rolling Load

It is desired that the intermetallic compound density of the continuous-casted sheet is operated by controlling the cooling rate in original solidification. Measuring of the cooling rate during casting is significantly difficult, and thus controlling of the intermetallic compound density by using parameter which can be measured by online is required.

Figure 3:
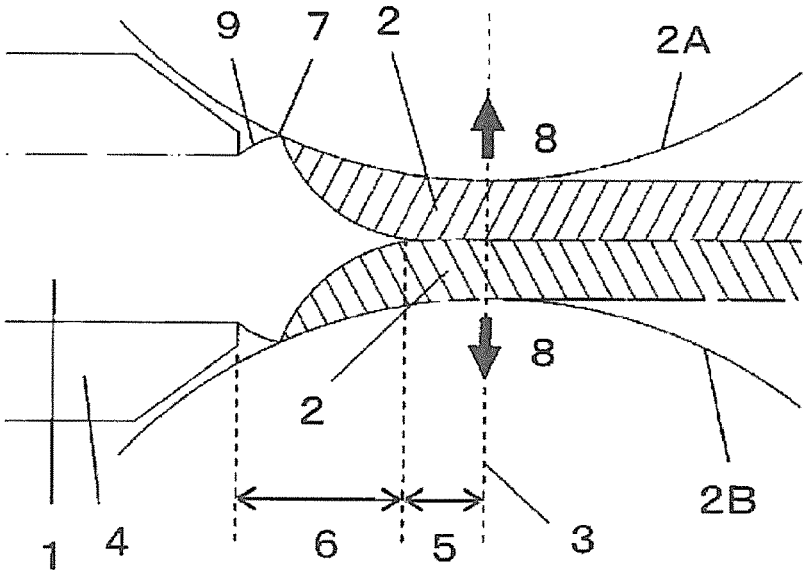
FIG. 3 is a diagram illustrating a cooling rate of injected molten aluminum in a twin roll type continuous casting rolling method.
Figure 4:
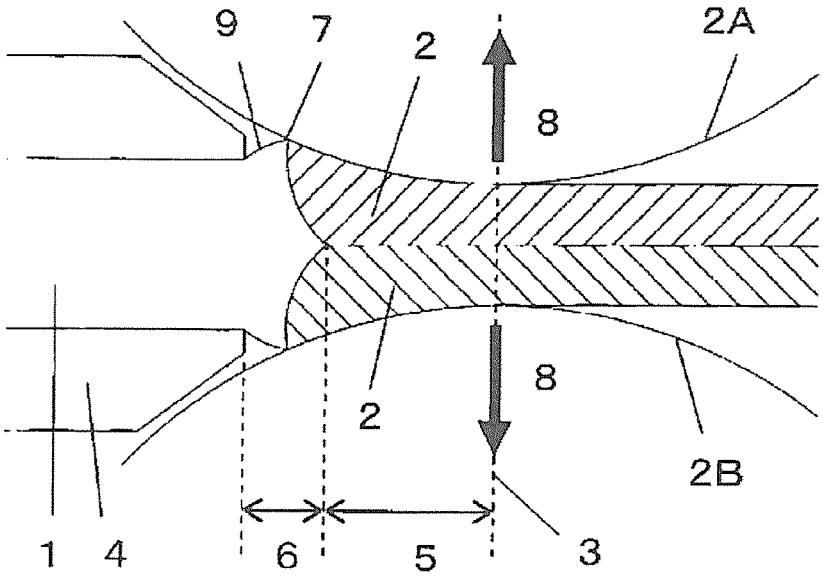
FIG. 4 is a diagram illustrating the cooling rate of injected molten aluminum in the twin roll type continuous casting rolling method.

As illustrated in FIGS. 3 and 4, the twin roll type continuous casting rolling method is performed in such a manner that molten metal 1 of an aluminum alloy is injected to a region 2 surrounded by metallic cooling rolls 2A and 2B which are disposed up and down so as to face each other, a roll center line 3, and an outlet of a nozzle tip 4, through the nozzle tip 4 formed of a refractory material. Here, the region 2 in continuous casting may be largely divided into a rolling region 5 and a non-rolling region 6. In the rolling region 5, solidification of an aluminum alloy is complete so as to form an ingot and a roll separating force against pressing of the rolls is generated. In a case of the aluminum alloy in the non-rolling region 6, solidification in the vicinity of the rolls is complete, but since the aluminum alloy at the center portion in sheet thickness exists as non-solidified molten metal, the roll separating force is not generated. A position of a solidification starting point 7 is hardly moved even though casting conditions are changed. For this reason, if the casting rate is caused to be fast or the molten metal temperature is caused to be high such that the rolling region 5 is caused to be small as illustrated in FIG. 3, a sump in the molten metal becomes deep and as a result, the cooling rate is reduced. Conversely, if the casting rate is caused to be slow or the molten metal temperature is caused to be low such that the rolling region 5 is caused to be large as illustrated in FIG. 4, the sump in the molten metal becomes shallow and the cooling rate is increased. In this manner, the cooling rate may be controlled by an increase or a decrease of the rolling region, that is, measurement of a rolling load 8 which is a vertical component of the roll separating force. The sump in the molten metal corresponds to a solid-fluid interface between a solidified portion and a non-solidified portion in casting. When the interface digs deep in a rolling direction, and a valley is formed, it is called that the sump is deep. Conversely, when the interface does not dig in the rolling direction, and a substantially flat interface is formed, it is called that the sump is shallow.

The rolling load is preferably from 500 N pieces/mm to 5000 N pieces/mm. If the rolling load is less than 500 N pieces/mm, the rolling region 4 becomes small as illustrated in FIG. 1, and a situation in which the sump in the molten metal is deep occurs. Thus, the cooling rate is reduced, the coarse crystallized material is easily formed, and forming of the fine deposit material is difficult. As a result, the number of recrystallized particles which include the coarse crystallized material as nuclei during bonding and heating is increased, and the crystal particles become fine, and thereby deformation easily occurs. The sparsely distributed fine deposit material causes the appropriate pinning effect not to be obtained. In addition, the amount of the Si solid solution is also increased, and thus an amount of the liquid phase generated at the particle boundary during bonding and heating is increased, and deformation easily occurs. Solute atoms are concentrated at the center portion in sheet thickness and thus cause centerline segregation.

If the rolling load is greater than 5000 N pieces/mm, as illustrated in FIG. 2, the rolling region 5 becomes large, and a situation in which the sump in the molten metal is shallow occurs. Thus, the cooling rate is excessively increased, and Al based intermetallic compound distribution becomes excessively dense. As a result, the pinning effect is excessive in bonding and heating and thus the crystal particles become fine and deformation easily occurs. Since a heat extraction amount from the surface of the roll is large, solidification proceeds to non-contact molten metal (meniscus portion 9) with the surface of the roll. For this reason, molten metal in casting is insufficiently supplied and a ripple becomes deep, and thus a surface defect occurs on the surface of the ingot. The surface defect may be a starting point of crack in rolling.

9-11-5. Measuring Method of Rolling Load

In the twin roll type continuous casting rolling method, a force which causes the ingot to push up the roll in casting and a constant force which is applied to a space between up and down rolls from before casting to in the middle of casting occur. Summation of these two forces may be measured by using a hydraulic cylinder, as a component parallel with the roll center line. Accordingly, the rolling load is obtained by converting an increase between cylinder pressure before a start of casting and cylinder pressure in casting into a force and dividing the force by the width of the casted sheet. For example, when the number of cylinders is 2, the diameter of the cylinder is 600 mm, an increase of cylinder pressure of one cylinder is 4 MPa, the width of the rolled sheet in casting is 1500 mm, the rolling load per unit width of the ingot sheet is 1508 N pieces/mm through the following expression.

$$4\times300^2\times\pi\div1500\times2=1508\ N \text{ pieces/mm}$$

10. Other Members

Members other than the fin material, which are materials used in manufacturing of the heat exchanger according to the present invention are not particularly defined. However, the members preferably have a form as follows.

A tube material combined to the fin material may be an aluminum alloy material which does not have brazing filler material on an outer surface and enables brazing. For example, a 3000-series or 1000-series extruded perforated tube, an electroseamed tube obtained by cladding a 7000-series sacrificial anode material on an outer surface of a core material of 3000-series, and the like are used. Molten Zn spraying, coating with Zn-substituted flux, and the like may be performed on a surface of the tube materials, in order to improve corrosion resistance of a tube of the heat exchanger.

A header material which is disposed at both ends of the tube material preferably corresponds to an aluminum alloy member to which a wax for bonding the tube material is supplied. Specifically, a brazing sheet obtained by cladding a 4000-series brazing filler material on one-side surface or both surfaces of a 3000-series core material, a tube obtained by performing electroseamed processing on a brazing sheet having the above configuration, an extrusion or extension material obtained by cladding a 4000-series brazing filler material on one-side surface or both surfaces of a 3000-series core material, a material obtained by coating a 3000-series extrusion or extension material with a paste wax, and the like are used as a raw material. Cladding of the sacrificial anode material, molten Zn spraying, coating with Zn-substituted flux, and the like may be performed on these materials, in order to improve corrosion resistance of a header of the heat exchanger. Press processing is performed on these materials and a material obtained as a result is supplied as the header material.

11. Manufacturing Method of Heat Exchanger

The heat exchanger according to the present invention is manufactured in such a manner that the above members are put together so as to have a shape of the heat exchanger, then processing such as coating with a flux is performed, and heating and bonding is performed in a furnace.

The manufacturing method of the heat exchanger according to the present invention, particularly, a bonding method thereof will be described below in detail. In the heat exchanger according to the present invention, the brazing filler material is not used and bonding capacity shown by the fin material itself of the aluminum alloy is used. However, if use as the fin material of the heat exchanger is considered, deformation of the fin material itself is a big problem. In addition, the metal structure of the fin of the above-described heat exchanger is formed in bonding. For this reason, managing of conditions for bonding and heating is important. Specifically, heating is performed at a temperature as follows for a period of time necessary for bonding. That is, the temperature at which heating is performed is a temperature from the solidus temperature at which a liquid phase is generated in the fin material used in the present invention to a liquidus temperature, and is equal to or lower than a temperature in which a liquid phase is generated in the fin material, strength is degraded, and holding of the shape is impossible.

As the more specific heating condition, bonding is required at a temperature at which a ratio (described as "liquidity" below) of mass of a liquid phase generated in the aluminum alloy material to the total mass of the aluminum alloy material which is the fin material is from 5% to 35%. Since bonding is difficult if an amount of the liquid phase is small, liquidity is preferably equal to or more than 5%. If the liquidity is more than 35%, an amount of the generated liquid phase is too much, the aluminum alloy material is largely deformed in bonding and heating, and thus the shape is not held. The liquidity is preferably from 5% to 30%, and more preferably from 10% to 20%.

In order to cause spaces between the fin material and other members to be sufficiently filled with the liquid phase, consideration of a filling time thereof is preferable, and a period of time when the liquidity is equal to or more than 5% is preferably from 30 seconds within 3600 seconds. More preferably, the period of time when the liquidity is equal to or more than 5% is preferably from 60 seconds within 1800 seconds. Thus, further sufficient filling is performed and bonding is reliably performed. If the period of time when the liquidity is equal to or more than 5% is less than 30 seconds, the bonding portion is not sufficiently filled with the liquid phase in some cases. In addition, the region B may be not sufficiently formed around the grain boundary, and sufficient corrosion resistance performance may be not obtained. If the period of time when the liquidity is equal to or more than 5% is more than 3600 seconds, deformation of the aluminum alloy material may proceed. In addition, the region B may be excessively formed around the grain boundary. In the bonding method according to the present invention, since the liquid phase is moved within a region very close to the bonding portion, the period of time necessary for filling does not depend on the size of the bonding portion.

As a specific example of preferable heating conditions, in a case of the aluminum alloy material according to the present invention, a temperature from 580° C. to 640° C. may be set as the bonding temperature and the holding time at the bonding temperature may be set to be about from 0 minute to 10 minutes. Here, 0 minute means that cooling is started as soon as a temperature of the member reaches a predetermined bonding temperature. The holding time is more preferably from 30 seconds to 5 minutes. The bonding temperature is set to be a temperature which causes the defined liquidity not the composition.

Measuring of actual liquidity in heating is very difficult. The liquidity defined in the present invention may be generally obtained based on an alloy composition and the highest temperature by using an equilibrium diagram and using the lever rule. In alloys of which a phase diagram has already been drawn, the liquidity can be obtained by using the phase diagram and using the lever rule. Regarding alloys of which an equilibrium diagram is not disclosed, the liquidity can be obtained by using equilibrium calculation phase diagram software. A method in which liquidity is obtained by using an alloy composition and a temperature and using the lever rule is included in the equilibrium calculation phase diagram software. As the equilibrium calculation phase diagram software, Thermo-Calc (product manufactured by Thermo-Calc Software AB) and the like is used. In the alloys of which an equilibrium diagram is drawn, since the same result as a result of obtaining liquidity based on the equilibrium diagram by using the lever rule is obtained even though liquidity is calculated by using the equilibrium calculation phase diagram software, the equilibrium calculation phase diagram software may be used for simplification.

A heating atmosphere in heating treatment is preferably an unoxidizing atmosphere substituted with nitrogen, argon, or the like. It is possible to obtain much better bonding property by using a non-corrosive flux. Heating and bonding in the vacuum or in decompression may be performed.

As a method of coating with the non-corrosive flux, a method in which flux powder is sprinkled after a bonded member is assembled, a method in which flux powder is suspended in water and spray coating is performed, and the like are exemplified. When the material is coated with paint in advance, if a binder such as acrylic resin is mixed with flux powder, and coating is performed, it is possible to improve adhesion of coating with paint. As the non-corrosive flux used for obtaining a general function of the flux, the following flux is included: fluoride flux of $KAlF_4$, $K_2AlF_5$, $K_2AlF_5.H_2O$, $K_3AlF_6$, $AlF_3$, $KZnF_3$, $K_2SiF_6$, and the like; cesium flux of $Cs_3AlF_6$, $CsAlF_4.2H_2O$, $Cs_2AlF_5.H_2O$, and the like.

The aluminum alloy material for the fin in the heat exchanger according to the present invention can be bonded well by heating treatment as described above, and controlling the heating atmosphere. Since the fin material is thin, if stress occurring inside is too high, holding of the shape may be impossible. Particularly, when liquidity during bonding is large, if the stress occurring in the fin material is relatively low, holding of the shape is enabled well. In this manner, in a case where consideration of stress in the fin material is preferable, when the maximum value of the stress occurring in the fin material is set as P (kPa), and the liquidity is set as V (%), if a condition of $P \leq 460-12V$ is satisfied, significantly stable bonding is obtained. A value represented on the right side (460-12V) of the expression indicates critical stress. If stress exceeding the critical stress is applied to the fin material, deformation may occur largely. The stress occurring in the fin material is obtained based on the shape and load. For example, the stress occurring in the fin material may be calculated by using a structural calculation program or the like.

EXAMPLES

1. First Example

Figure 5:
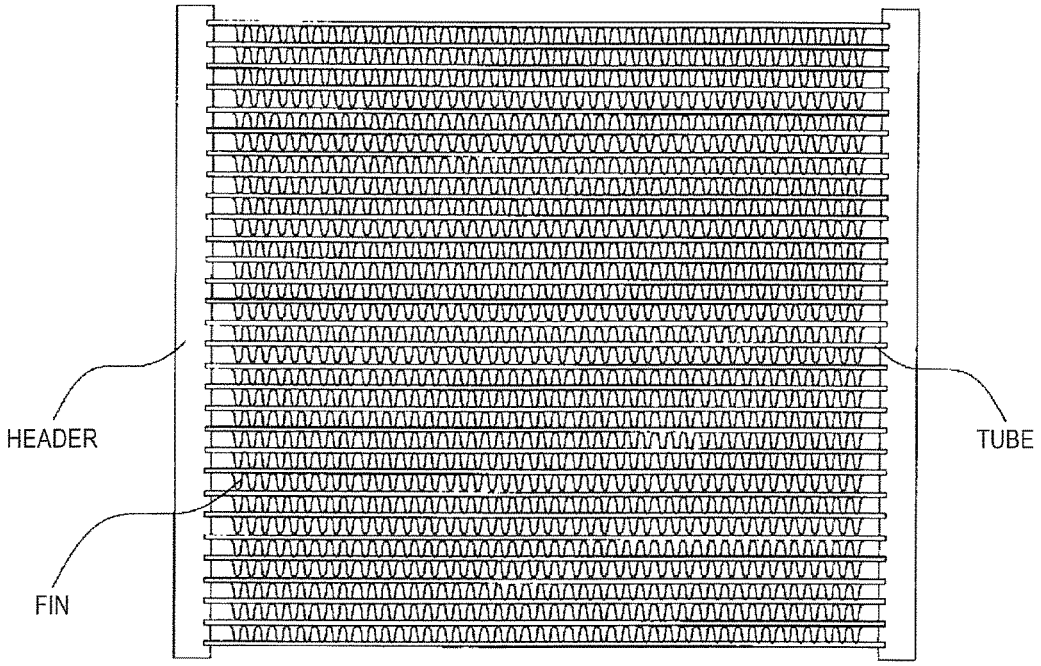
FIG. 5 is a cross-sectional view illustrating a shape of the heat exchanger according to the present invention.

A fin, a tube, and a header were formed by using the following material and these components were assembled so as to have a shape of a heat exchanger as illustrated in FIG. 5. Then, the entirety was bonded and heated, and thereby a heat exchanger was manufactured.

Manufacturing of Fin Material

A test material of an alloy composition in Table 1 was used. In Table 1, "-" of the alloy composition indicates being equal to or less than a detection limit. A "residue" includes inevitable impurities. A casted ingot was manufactured by using the test material. Regarding F1 and F3, casting was performed by using the DC casting method so as to have a size of 400 mm in thickness, 1000 mm in width, and 3000 mm in length. A casting rate was set to 40 mm pieces/minute. After the ingot was subjected to surface cutting and thus the thickness was caused to be 380 mm, the ingot was heated up to 500° C. and was held at 500° C. for 5 hours, and then went through the hot-rolling process, as a heating holding process before hot-rolling. The total rolling reduction ratio was set to 93% at the hot rough rolling stage in the hot-rolling process, and rolling was performed so as to have a thickness of 27 mm at this stage. A pass in which the rolling reduction ratio was equal to or greater than 15% was performed five times at the hot rough rolling stage. After the hot rough rolling stage, the rolling material went through the hot finish rolling stage and was rolled so as to have a thickness of 3 mm. Then, in the cold rolling process, a rolled sheet was rolled so as to have a thickness of 0.09 mm. The rolling material went through an intermediate annealing process at 380° C. for 2 hours. At last, rolling was performed so as to have the final sheet thickness of 0.07 mm at the final cold-rolling stage, and a result of rolling was used as a sample material.

Regarding a test material of F2, a casted ingot was manufactured by using the twin roll type continuous casting rolling method (CC). In the twin roll type continuous casting rolling method, the molten metal temperature in casting was from 650° C. to 800° C. and the casting rate was set to 0.6 m pieces/minute. Direct measurement of the cooling rate is difficult. However, as described above, it is considered that the cooling rate is in a range of 300° C./second to 700° C./second by sump control in the molten metal. The sump control in the molten metal is performed by controlling the aluminum coating thickness and using the rolling load. Such a casting process caused a casted ingot having a width of 130 mm, a length of 20000 mm, and a thickness of 7 mm to be obtained. Then, the obtained ingot sheet was subjected to cold rolling so as to be 0.7 mm. After intermediate annealing at 420° C. for 2 hours, cold rolling was performed so as to be 0.071 mm. After second annealing at 350° C. for 3 hours, rolling was performed at the final cold-rolling ratio of 30% so as to be 0.050 mm, and a result of rolling was used as a sample material.

TABLE 1

| | | Core material composition (mass %) | | | | | | | | Skin material (brazing filler material) composition (mass %) | | | | | |
|---|---|---|---|---|---|---|---|---|---|---|---|---|---|---|---|
| No. | Configuration | Si | Fe | Mn | Cu | Mg | Zn | residue | Liquidity at 605° C. (%) | Si | Fe | Mn | Zn | residue | Liquidity at 605° C. (%) |
| F1 | Bare | 2.5 | 0.2 | 1.1 | — | — | 1.5 | Al | 20 | | | | | | |
| F2 | Bare | 2.3 | 0.2 | 1.1 | — | — | 1.5 | Al | 17 | | | | | | |
| F3 | Bare | 2.5 | 0.2 | 1.5 | 0.15 | — | 2.5 | Al | 23 | | | | | | |
| F4 | Clad | 0.5 | 0.2 | 1.1 | — | — | 1.5 | Al | 0 | 10 | 0.5 | — | — | Al | 100 |

| | Particle distribution*1) of fin material (in core material) | | | | |
|---|---|---|---|---|---|
| | Si based intermetallic compound (pieces/mm$^2$) | | Al—Fe—Mn—Si based intermetallic compound (pieces/mm$^2$) | | |
| No. | 0.5 to 5 μm | greater than 5 μm and 10 μm or less | 0.01 μm or more and less than 0.5 μm *2) | 0.5 to 5 μm | greater than 5 μm and 10 μm or less |
| F1 | 1.4E+03 | 0.0E+00 | 3.1E+01 | 4.3E+03 | 2.5E+02 |
| F2 | 1.3E+04 | 1.2E+00 | 3.4E+02 | 2.2E+04 | 1.0E+00 |
| F3 | 1.5E+03 | 0.0E+00 | 3.5E+01 | 5.2E+03 | 2.7E+02 |
| F4 | 0.0E+00 | 0.0E+00 | 2.7E+01 | 3.8E+03 | 1.1E+02 |

*1)regarding exponential indication, for example, 1.4E+03 represents $1.4 \times 10^3$.

*2): unit is (pieces/μm$^3$)

During casting in the CC, a crystal particle pulverizing agent was put at the molten metal temperature of 680° C. to 750° C. At this time, the crystal particle pulverizing agent was continuously put into the molten metal flowing in a gutter at a constant rate by using a wire-like crystal particle pulverizing agent rod. The gutter links a molten metal holding furnace and the headbox right ahead of the hot-water supply nozzle. The crystal particle pulverizing agent adjusted an addition amount by using an Al-5Ti-1B alloy so as to be 0.002% in B amount conversion.

Regarding F4, a skin material (brazing filler material) is cladded to the DC casted ingot which has a width of 1000 mm, a length of 3000 mm, and a thickness of 400 mm, and a result of cladding is used as a two-layer brazing sheet. Cold rolling, intermediate annealing, cold rolling, second annealing, and the final cold-rolling which are subsequent to cladding were performed similarly to in other fin materials.

In number density of Al—Fe—Mn—Si based intermetallic compound in the manufactured sheet material (element sheet), number density of particles having an equivalent circle diameter of 0.01 μm or more and less than 0.5 μm was measured by performing TEM observation of a cross-section along the sheet thickness direction. A sample for TEM observation was manufactured by using electrolytic etching. A visual field which corresponds to a film thickness of 50 μm to 200 μm on average was selected and observed. The Si based intermetallic compound and Al based intermetallic compound may be distinguished from each other by performing mapping using a STEM-EDS. Observation was performed at magnification of 100000 for the sample for each of 10 visual fields. Image analysis was performed on each of TEM pictures and thus the number of Al—Fe—Mn—Si based intermetallic compound having an equivalent circle diameter of 0.01 μm or more and less than 0.5 μm was measured and the number density was calculated by dividing the measured number by a measured area.

Number density of particles of 0.5 μm or more and less than 5 μm, and particles of 5 μm to 10 μm among the Al—Fe—Mn—Si based intermetallic compound in the manufactured sheet material (element sheet), and number density of Si based intermetallic compound of 0.5 μm to 5 μm, and particles of greater than 5 μm and 10 μm or less were measured by performing SEM observation of a cross-section along the sheet thickness direction. The Si based intermetallic compound and the Al—Fe—Mn—Si based intermetallic compound were distinguished from each other by using SEM-reflected electron image observation and SEM-secondary electron image observation. In the reflected electron image observation, a portion having white strong contrast is the Al based intermetallic compound and a portion having white weak contrast is the Si based intermetallic compound. Since the Si based intermetallic compound has weak contrast, determination of fine particles and the like may be difficult. In this case, SEM-secondary electron image observation was performed on a sample which was etched by using a colloidal silica polishing suspension solution for about 10 seconds after surface polishing. A particle having black strong contrast is the Si based intermetallic compound. Observation was performed for each of 5 visual fields of the sample and image analysis was performed on a SEM picture having each visual field. Thus, the number density of the Al—Fe—Mn—Si based intermetallic compound having an equivalent circle diameter of 0.5 μm or more and less than 5 μm, and an equivalent circle diameter of 5 μm to 10 μm, and the number density of the Si based intermetallic compound having an equivalent circle diameter of 0.5 μm to 5 μm, and an equivalent circle diameter of greater than 5 μm and 10 μm or less, in the sample were examined.

As described above, the number density of the Al—Fe—Mn—Si based intermetallic compound and the number density of the Si based intermetallic compound are represented together by Table 1.

As the fin material, a fin material having a sheet thickness of 0.07 mm was subjected to corrugate processing and a corrugate fin material having a fin peak height of 8 mm, a fin pitch of 3 mm, and a length of 400 mm was used.

As the tube, a test material of an alloy composition in Table 2 was used. As illustrated in Table 2, an extruded perforated tube having a length of 440 mm was used as a tube material. A status of an outer surface of the tube material is represented together by Table 2.

obtained in the above-described manner in FIG. 2. The area occupancy ratio a of the region A on the surface of the fin was obtained as a ratio of summation of lengths of portions at which the region A is present, to the total length of the surface, from a cross-section of a visual field having the total fin lengths of 1 mm in FIG. 6 as described above. The grain size of the Al matrix in the L-LT cross-section of the fin was set as L μm, and the grain size of the Al matrix in the L-ST cross-section of the fin was set as T μm, and thus L/T was obtained in the above-described manner. The natural potential of the fin after bonding and heating was measured and a difference between the natural potential of the fin and the natural potential of the fillet was measured. The natural potential was measured in a solution by using Ag/AgCl electrodes. The solution was obtained in such a manner that 5% NaCl in weight ratio was dissolved in pure water and acetic acid was added so as to have pH3. As a sample to be measured, a sample which was cut off by the heat exchanger and in which portions other than a measured portion (fin or fillet) were masked was used.

TABLE 2

| | | Core material composition (mass %) | | | | | | | | |
|---|---|---|---|---|---|---|---|---|---|---|
| No. | Form | Si | Fe | Mn | Cu | Mg | Zn | Residue | Liquidity at 600° C. (%) | Status of outer surface of tube |
| T1 | Extrusion perforated tube | 0.1 | 0.15 | 0.2 | 0.5 | — | — | Al | 0 | Molten Zn spraying (amount of spraying 7 g/m$^2$) |
| T2 | Extrusion perforated tube | 0.1 | 0.15 | 0.2 | 0.5 | — | — | Al | 0 | No particular treatment |
| T3 | Extrusion perforated tube | 0.2 | 0.3 | — | — | — | — | Al | 0 | Molten Zn spraying (amount of spraying 7 g/m$^2$) |

A clad tube (core material+skin material (brazing filler material)) having a wall thickness of 1.3 mm and a diameter of 20 mm as illustrated in Table 3 was cut off so as to have a length of 400 mm, and total 30 tube insertion holes in accordance with the tube thickness and the fin peak height were processed and a result of processing was used as the header.

Figure 7:
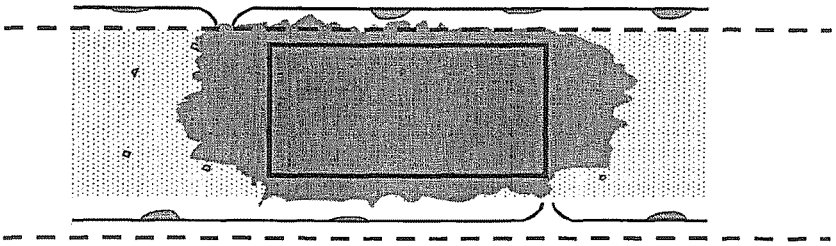
FIG. 7 is a diagram illustrating a measuring method of hollow corrosion.
Figure 7:
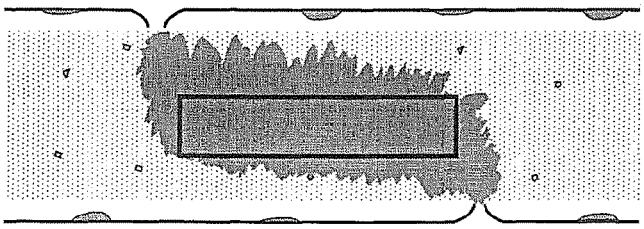

A SWATT test was performed as a corrosion test on the heat exchanger manufactured in the above-described manner. A test time was set to 1000 hours and presence of leakage in the tube after the test was ended was evaluated. Then, a sample as illustrated in FIG. 7 was cut off at the center portion of the heat exchanger at which there is no leakage in the tube. After a corrosion product was removed,

TABLE 3

| | | Core material composition (mass %) | | | | | | | Skin material (brazing filler material) composition (mass %) | | | | |
|---|---|---|---|---|---|---|---|---|---|---|---|---|---|
| No. | Configuration | Si | Fe | Mn | Cu | Mg | Zn | residue | Si | Fe | Mn | Zn | Residue |
| H1 | Clad tube | 0.5 | 0.2 | 1.1 | 0.5 | — | — | Al | 7.5 | 0.5 | — | 1 | Al |

These members were assembled so as to have the shape in FIG. 5 and the entirety was coated with fluoride flux from a surface. Then, heating and bonding was performed at a furnace of nitrogen atmosphere. Combination of the members was represented in Table 4. When an assembly was heated, the highest temperature was set to 605° C. When the temperature of the assembly was equal to or higher than 400° C., oxygen concentration in the furnace was controlled so as to be equal to or less than 100 ppm, and the dew point was controlled so as to be equal to or lower than −40° C. A period of time when the members were held at a temperature of 600° C. to 605° C. was set to 30 minutes.

Regarding a completed heat exchanger, cross-section observation of a fin was performed. First, presence of the region B around the grain boundary and the region A around the region B was observed. Next, the average area s of the Al—Fe—Mn—Si compound particles which are present in the region B and have a particle size of 0.1 μm to 2.5 μm was a result of removal was embedded with resin. After cross-section polishing, cross-section observation was performed. Presence of the hollow corrosion portion defined as illustrated in FIG. 7 was observed from a cross-section of a visual field having the total fin length of 2 mm. That is, a cross-section of the fin after the corrosion test was observed and presence and degrees of hollow corrosion were determined based on whether or not corrosion of a predetermined degree or more occurred on an inner side of the outermost portion of the fin in the visual field. When corrosion into which a guide of L 150 μm×t 70 μm as illustrated in FIG. 7(*a*) was inserted was present at one place in the visual field, determination to be C was performed. When there is no corrosion in the visual field, corresponding to C, and corrosion into which a guide of L 150 μm×t 30 μm was inserted was present at one place, determination to be B was performed. In other cases, determination to be A was performed.

The above results are represented in Table 4.

TABLE 4

| No. | Fin | Tube | Header | Presence of region B around grain boundary | Presence of region A around region B | Average area S of region B around grain boundary (μm) | Area occupancy ratio a on surfaces of region A (%) | L (μm) | L/T (—) | Natural potential of fin (mV) | Natural potential of fin − natural potential of fillet (mV) | Hollow corrosion of fin | Leakage in tube |
|---|---|---|---|---|---|---|---|---|---|---|---|---|---|
| Example 1 | F1 | T1 | H1 | Presence | Presence | 8 | 80 | 325 | 3.2 | −790 | 100 | A | None |
| Example 2 | F2 | T1 | H1 | Presence | Presence | 10 | 75 | 220 | 4.1 | −800 | 100 | A | None |
| Example 3 | F3 | T1 | H1 | Presence | Presence | 13 | 75 | 130 | 1.5 | −780 | 60 | B | None |
| Example 4 | F1 | T2 | H1 | Presence | Presence | 7 | 82 | 325 | 3.2 | −730 | 80 | A | None |
| Example 5 | F1 | T3 | H1 | Presence | Presence | 8 | 80 | 325 | 3.2 | −825 | 75 | A | None |
| Comparative Example 6 | F4 | T1 | H1 | None | — | — | — | 350 | 3.8 | −770 | 95 | C | None |
| Comparative Example 7 | F4 | T2 | H1 | None | — | — | — | 350 | 3.8 | −710 | 80 | C | None |

In Examples 1 to 5, there was no leakage in the tube and evaluation results of hollow corrosion of the fin after the corrosion test had B or higher. That is, the good result was obtained.

In Comparative Examples 6 and 7, the region B was not formed around the grain boundary and there was no leakage in the tube, but hollow corrosion occurred largely.

Second Example

A fin, a tube, and a header were formed by using the following materials and these components were assembled so as to have a shape of a heat exchanger, similarly to in the first example. Then, the entirety was bonded and heated, and thereby a heat exchanger was manufactured.

Test materials of alloy compositions in Table 5 were used for the fin material. In Table 5, "-" of the alloy composition indicates being less than a detection limit, and a "residue" includes inevitable impurities. In the second example, an influence of the trace addition element in the fin material was examined.

TABLE 5

| | | Core material composition (mass %) | | | | | | | | | | | | | | | | | | | |
|---|---|---|---|---|---|---|---|---|---|---|---|---|---|---|---|---|---|---|---|---|---|
| No. | Configuration | Si | Fe | Mn | Cu | Mg | Zn | In | Sn | Ni | Ti | V | Zr | Cr | Be | Sr | Bi | Na | Ca | Residue | Liquidity at 605° C. (%) |
| F5 | Bare | 2.5 | 0.25 | 1.0 | — | 0.05 | — | — | — | — | — | — | — | — | — | — | — | — | — | Al | 17 |
| F6 | Bare | 2.5 | 0.25 | 1.0 | — | 0.5 | — | — | — | — | — | — | — | — | — | — | — | — | — | Al | 20 |
| F7 | Bare | 2.5 | 0.25 | 1.0 | — | — | — | 0.05 | — | — | — | — | — | — | — | — | — | — | — | Al | 17 |
| F8 | Bare | 2.5 | 0.25 | 1.0 | — | — | — | 0.3 | — | — | — | — | — | — | — | — | — | — | — | Al | 17 |
| F9 | Bare | 2.5 | 0.25 | 1.0 | — | — | — | — | 0.05 | — | — | — | — | — | — | — | — | — | — | Al | 17 |
| F10 | Bare | 2.5 | 0.25 | 1.0 | — | — | — | — | 0.3 | — | — | — | — | — | — | — | — | — | — | Al | 18 |
| F11 | Bare | 2.5 | 0.25 | 1.0 | — | — | — | — | — | 0.05 | — | — | — | — | — | — | — | — | — | Al | 17 |
| F12 | Bare | 2.5 | 0.25 | 1.0 | — | — | — | — | — | 0.3 | — | — | — | — | — | — | — | — | — | Al | 19 |
| F13 | Bare | 2.5 | 0.25 | 1.0 | — | — | — | — | — | — | 0.05 | — | — | — | — | — | — | — | — | Al | 17 |
| F14 | Bare | 2.5 | 0.25 | 1.0 | — | — | — | — | — | — | 0.3 | — | — | — | — | — | — | — | — | Al | 16 |
| F15 | Bare | 2.5 | 0.25 | 1.0 | — | — | — | — | — | — | — | 0.05 | — | — | — | — | — | — | — | Al | 17 |
| F16 | Bare | 2.5 | 0.25 | 1.0 | — | — | — | — | — | — | — | 0.3 | — | — | — | — | — | — | — | Al | 16 |
| F17 | Bare | 2.5 | 0.25 | 1.0 | — | — | — | — | — | — | — | — | 0.05 | — | — | — | — | — | — | Al | 17 |
| F18 | Bare | 2.5 | 0.25 | 1.0 | — | — | — | — | — | — | — | — | 0.3 | — | — | — | — | — | — | Al | 17 |
| F19 | Bare | 2.5 | 0.25 | 1.0 | — | — | — | — | — | — | — | — | — | 0.05 | — | — | — | — | — | Al | 17 |
| F20 | Bare | 2.5 | 0.25 | 1.0 | — | — | — | — | — | — | — | — | — | 0.3 | — | — | — | — | — | Al | 15 |
| F21 | Bare | 2.5 | 0.25 | 1.0 | — | — | — | — | — | — | — | — | — | — | 0 | — | — | — | — | Al | 17 |
| F22 | Bare | 2.5 | 0.25 | 1.0 | — | — | — | — | — | — | — | — | — | — | 0.1 | — | — | — | — | Al | 16 |
| F23 | Bare | 2.5 | 0.25 | 1.0 | — | — | — | — | — | — | — | — | — | — | — | 0 | — | — | — | Al | 17 |
| F24 | Bare | 2.5 | 0.25 | 1.0 | — | — | — | — | — | — | — | — | — | — | — | 0.1 | — | — | — | Al | 16 |
| F25 | Bare | 2.5 | 0.25 | 1.0 | — | — | — | — | — | — | — | — | — | — | — | — | 0 | — | — | Al | 17 |
| F26 | Bare | 2.5 | 0.25 | 1.0 | — | — | — | — | — | — | — | — | — | — | — | — | 0.1 | — | — | Al | 16 |
| F27 | Bare | 2.5 | 0.25 | 1.0 | — | — | — | — | — | — | — | — | — | — | — | — | — | 0 | — | Al | 17 |
| F28 | Bare | 2.5 | 0.25 | 1.0 | — | — | — | — | — | — | — | — | — | — | — | — | — | 0.1 | — | Al | 16 |
| F29 | Bare | 2.5 | 0.25 | 1.0 | — | — | — | — | — | — | — | — | — | — | — | — | — | — | 0 | Al | 17 |
| F30 | Bare | 2.5 | 0.25 | 1.0 | — | — | — | — | — | — | — | — | — | — | — | — | — | — | 0.5 | Al | 8 |

A casted ingot was manufactured by using the test materials. F5 to F30 were processed similarly to F1 and F3 in the first example. Particle distribution evaluation of the manufactured sheet material (element sheet) was performed similarly to in the first example. The measured number density of the Al—Fe—Mn—Si based intermetallic compound and the measured number density of the Si based intermetallic compound are represented in Table 6.

TABLE 6

| | | Particle distribution*1) of fin material (in core material) | | | | |
|---|---|---|---|---|---|---|
| | | Si based intermetallic compound (pieces/mm$^2$) | | Al—Fe—Mn—Si based intermetallic compound (pieces/mm$^2$) | | |
| No. | Configuration | 0.5 to 5 μm | greater than 5 μm and 10 μm or less | 0.01 μm or more and less than 0.5 μm *2) | 0.5 to 5 μm | greater than 5 μm and 10 μm or less |
| F5 | Bare | 2.3.E+03 | 0.0E+00 | 3.2E+01 | 4.0E+03 | 1.7E+02 |
| F6 | Bare | 2.0.E+03 | 0.0E+00 | 3.1E+01 | 3.8E+03 | 2.3E+02 |
| F7 | Bare | 2.7.E+03 | 0.0E+00 | 3.3E+01 | 4.1E+03 | 2.5E+02 |
| F8 | Bare | 2.4.E+03 | 0.0E+00 | 2.9E+01 | 3.6E+03 | 2.5E+02 |
| F9 | Bare | 2.5.E+03 | 0.0E+00 | 2.5E+01 | 3.1E+03 | 2.4E+02 |
| F10 | Bare | 2.4.E+03 | 0.0E+00 | 2.3E+01 | 2.8E+03 | 2.4E+02 |
| F11 | Bare | 2.5.E+03 | 0.0E+00 | 2.8E+01 | 3.5E+03 | 1.6E+02 |
| F12 | Bare | 2.7.E+03 | 1.7E+00 | 2.7E+01 | 3.4E+03 | 1.4E+02 |
| F13 | Bare | 2.6.E+03 | 0.0E+00 | 2.3E+01 | 2.8E+03 | 1.5E+02 |
| F14 | Bare | 2.5.E+03 | 8.0E+01 | 2.4E+01 | 3.0E+03 | 1.6E+02 |
| F15 | Bare | 2.5.E+03 | 0.0E+00 | 2.7E+01 | 3.3E+03 | 1.6E+02 |
| F16 | Bare | 2.4.E+03 | 3.3E+00 | 2.5E+01 | 3.1E+03 | 1.8E+02 |
| F17 | Bare | 2.6.E+03 | 0.0E+00 | 2.8E+01 | 3.4E+03 | 1.6E+02 |
| F18 | Bare | 2.7.E+03 | 0.0E+00 | 2.4E+01 | 3.0E+03 | 1.7E+02 |
| F19 | Bare | 2.5.E+03 | 0.0E+00 | 2.4E+01 | 2.9E+03 | 1.7E+02 |
| F20 | Bare | 2.4.E+03 | 3.8E+00 | 2.3E+01 | 2.8E+03 | 1.5E+02 |
| F21 | Bare | 4.1.E+03 | 0.0E+00 | 2.6E+01 | 3.2E+03 | 1.4E+02 |
| F22 | Bare | 9.2.E+03 | 0.0E+00 | 3.1E+01 | 3.8E+03 | 1.7E+02 |
| F23 | Bare | 3.6.E+03 | 0.0E+00 | 2.9E+01 | 3.6E+03 | 1.5E+02 |
| F24 | Bare | 7.8.E+03 | 0.0E+00 | 2.9E+01 | 3.6E+03 | 1.4E+02 |
| F25 | Bare | 2.4.E+03 | 0.0E+00 | 3.7E+01 | 4.6E+03 | 1.5E+02 |
| F26 | Bare | 2.6.E+03 | 0.0E+00 | 2.6E+01 | 3.2E+03 | 1.6E+02 |
| F27 | Bare | 3.4.E+03 | 0.0E+00 | 3.8E+01 | 4.6E+03 | 1.6E+02 |
| F28 | Bare | 9.3.E+03 | 0.0E+00 | 3.0E+01 | 3.8E+03 | 1.7E+02 |
| F29 | Bare | 2.4.E+03 | 0.0E+00 | 3.4E+01 | 4.2E+03 | 1.8E+02 |
| F30 | Bare | 2.7.E+03 | 0.0E+00 | 2.6E+01 | 3.3E+03 | 1.5E+02 |

*1)regarding exponential indication, for example, 1.4E+03 represents $1.4 \times 10^3$.
*2): unit is (pieces/μm$^3$)

Next, processing was performed so as to obtain a corrugate fin material in the similar manner to in the first example, and the same tube material and the same header material as those used in the first example were combined and thereby a heat exchanger was manufactured. The heat exchanger manufactured in this manner was evaluated similarly to in the first example. Evaluation results are represented in Table 7.

TABLE 7

| No. | Fin | Tube | Header | Presence of region B around grain boundary | Presence of region A around region B | Average area S of region B around grain boundary (μm) | Area occupancy ratio a on surfaces of region A (%) | L (μm) | L/T (—) | Natural potential of fin (mV) | Natural potential of fin − natural potential of fillet (mV) | Hollow corrosion of fin | Leakage in tube |
|---|---|---|---|---|---|---|---|---|---|---|---|---|---|
| Example 6 | F5 | T3 | H1 | Presence | Presence | 5 | 88 | 310 | 8.9 | −695 | 225 | A | None |
| Example 7 | F6 | T3 | H1 | Presence | Presence | 4 | 70 | 280 | 6.2 | −690 | 230 | A | None |
| Example 8 | F7 | T3 | H1 | Presence | Presence | 5 | 84 | 185 | 5.1 | −710 | 210 | A | None |
| Example 9 | F8 | T3 | H1 | Presence | Presence | 6 | 94 | 170 | 4.5 | −740 | 180 | A | None |
| Example 10 | F9 | T3 | H1 | Presence | Presence | 4 | 69 | 160 | 3.6 | −700 | 220 | A | None |
| Example 11 | F10 | T3 | H1 | Presence | Presence | 4 | 70 | 200 | 4.3 | −740 | 180 | A | None |
| Example 12 | F11 | T3 | H1 | Presence | Presence | 4 | 70 | 145 | 3.9 | −705 | 215 | A | None |
| Example 13 | F12 | T3 | H1 | Presence | Presence | 6 | 100 | 135 | 3.0 | −695 | 225 | A | None |
| Example 14 | F13 | T3 | H1 | Presence | Presence | 5 | 83 | 140 | 4.1 | −685 | 235 | A | None |
| Example 15 | F14 | T3 | H1 | Presence | Presence | 6 | 92 | 140 | 3.1 | −690 | 230 | A | None |
| Example 16 | F15 | T3 | H1 | Presence | Presence | 6 | 93 | 150 | 3.4 | −685 | 235 | A | None |
| Example 17 | F16 | T3 | H1 | Presence | Presence | 6 | 98 | 150 | 4.0 | −690 | 230 | A | None |

TABLE 7-continued

| No. | Fin | Tube | Header | Presence of region B around grain boundary | Presence of region A around region B | Average area S of region B around grain boundary (μm) | Area occupancy ratio a on surfaces of region A (%) | L (μm) | L/T (—) | Natural potential of fin (mV) | Natural potential of fin − natural potential of fillet (mV) | Hollow corrosion of fin | Leakage in tube |
|---|---|---|---|---|---|---|---|---|---|---|---|---|---|
| Example 18 | F17 | T3 | H1 | Presence | Presence | 6 | 90 | 140 | 4.2 | −700 | 220 | A | None |
| Example 19 | F18 | T3 | H1 | Presence | Presence | 4 | 70 | 145 | 3.8 | −685 | 235 | A | None |
| Example 20 | F19 | T3 | H1 | Presence | Presence | 5 | 81 | 140 | 3.5 | −695 | 225 | A | None |
| Example 21 | F20 | T3 | H1 | Presence | Presence | 5 | 82 | 145 | 4.3 | −700 | 220 | A | None |
| Example 22 | F21 | T3 | H1 | Presence | Presence | 4 | 69 | 140 | 3.6 | −685 | 235 | A | None |
| Example 23 | F22 | T3 | H1 | Presence | Presence | 6 | 97 | 150 | 3.1 | −695 | 225 | A | None |
| Example 24 | F23 | T3 | H1 | Presence | Presence | 6 | 98 | 150 | 4.3 | −705 | 215 | A | None |
| Example 25 | F24 | T3 | H1 | Presence | Presence | 5 | 79 | 140 | 3.1 | −690 | 230 | A | None |
| Example 26 | F25 | T3 | H1 | Presence | Presence | 5 | 73 | 140 | 3.4 | −695 | 225 | A | None |
| Example 27 | F26 | T3 | H1 | Presence | Presence | 5 | 72 | 145 | 3.0 | −680 | 240 | A | None |
| Example 28 | F27 | T3 | H1 | Presence | Presence | 4 | 71 | 150 | 3.9 | −700 | 220 | A | None |
| Example 29 | F28 | T3 | H1 | Presence | Presence | 6 | 89 | 140 | 3.7 | −705 | 215 | A | None |
| Example 30 | F29 | T3 | H1 | Presence | Presence | 4 | 70 | 150 | 3.2 | −695 | 225 | A | None |
| Example 31 | F30 | T3 | H1 | Presence | Presence | 5 | 77 | 150 | 4.3 | −690 | 230 | A | None |

In Examples 6 to 31, there was no leakage in the tube and evaluation results of hollow corrosion of the fin after the corrosion test had A. That is, the good result was obtained.

Third Example

A fin, a tube, and a header were formed by using the following materials and these components were assembled so as to have a shape of a heat exchanger, similarly to in the first example. Then, the entirety was bonded and heated, and thereby a heat exchanger was manufactured. In the third example, an influence of the main addition element was examined.

Manufacturing of Fin Material

First, a casted ingot of an alloy composition represented in Table 8 was manufactured. In Table 8, "-" of the alloy composition indicates being less than a detection limit, and a "residue" includes inevitable impurities. Regarding F31 and F33 to F43, casting was performed by using the DC casting method so as to have a size of 400 mm in thickness, 1000 mm in width, and 3000 mm in length. A casting rate was set to 40 mm/minute. After the ingot was subjected to surface cutting and thus the thickness was caused to be 380 mm, the ingot was heated up to 500° C. and is held at 500° C. for 5 hours, and then went through the hot-rolling process, as a heating holding process before hot-rolling. The total rolling reduction ratio was set to 93% at the hot rough rolling stage in the hot-rolling process, and rolling was performed so as to have a thickness of 27 mm at this stage. A pass in which the rolling reduction ratio was equal to or greater than 15% was performed five times at the hot rough rolling stage. After the hot rough rolling stage, the rolling material went through the hot finish rolling stage and was rolled so as to have a thickness of 3 mm. Then, in the cold rolling process, a rolled sheet was rolled so as to have a thickness of 0.145 mm. The rolling material went through an intermediate annealing process at 380° C. for 2 hours. At last, rolling was performed so as to have the final sheet thickness of 0.115 mm at the final cold-rolling stage, and a result of rolling was used as a sample material.

TABLE 8

| | | Core material composition (mass %) | | | | | | | | | | | | | | | | | | | |
|---|---|---|---|---|---|---|---|---|---|---|---|---|---|---|---|---|---|---|---|---|---|
| No. | Configuration | Si | Fe | Mn | Cu | Mg | Zn | In | Sn | Ni | Ti | V | Zr | Cr | Be | Sr | Bi | Na | Ca | Residue | Liquidity at 605° C. (%) |
| F31 | Bare | 2.5 | 0.25 | 1.0 | — | — | 1.5 | — | — | — | — | — | — | — | — | — | — | — | — | Al | 20 |
| F32 | Bare | 2.5 | 0.25 | 1.0 | — | — | 1.5 | — | — | — | — | — | — | — | — | — | — | — | — | Al | 20 |
| F33 | Bare | 1.8 | 0.25 | 1.0 | — | — | 0.1 | — | — | — | — | — | — | — | — | — | — | — | — | Al | 9 |
| F34 | Bare | 3.0 | 0.25 | 1.0 | — | — | 2.0 | — | — | — | — | — | — | — | — | — | — | — | — | Al | 31 |
| F35 | Bare | 2.5 | 0.10 | 0.3 | — | — | 1.5 | — | — | — | — | — | — | — | — | — | — | — | — | Al | 26 |
| F36 | Bare | 2.5 | 0.30 | 1.5 | — | — | 1.5 | — | — | — | — | — | — | — | — | — | — | — | — | Al | 20 |
| F37 | Bare | 3.0 | 0.10 | 0.1 | 0.1 | — | 1.5 | — | — | — | — | — | — | — | — | — | — | — | — | Al | 33 |
| F38 | Bare | 3.0 | 0.50 | 1.5 | — | — | 1.5 | — | — | — | — | — | — | — | — | — | — | — | — | Al | 27 |
| F39 | Bare | 1.8 | 0.25 | 1.0 | 0.4 | — | 5.0 | — | — | — | — | — | — | — | — | — | — | — | — | Al | 20 |
| F40 | Bare | 1.5 | 0.25 | 1.0 | — | — | — | — | — | — | — | — | — | — | — | — | — | — | — | Al | 3 |
| F41 | Bare | 3.8 | 0.10 | 0.1 | — | — | 1.5 | — | — | — | — | — | — | — | — | — | — | — | — | Al | 41 |
| F42 | Bare | 2.5 | 1.50 | 1.5 | — | — | — | — | — | — | — | — | — | — | — | — | — | — | — | Al | 11 |
| F43 | Bare | 3.5 | 0.10 | 0.0 | — | — | — | — | — | — | — | — | — | — | — | — | — | — | — | Al | 33 |

Regarding a test material of F32, a casted ingot was manufactured by using the twin roll type continuous casting rolling method (CC). In the twin roll type continuous casting rolling method, the molten metal temperature in casting was from 650° C. to 800° C. and the casting rate was set to 0.6 m/minute. Direct measurement of the cooling rate is difficult. However, as described above, it is considered that the cooling rate is in a range of 300° C./second to 700° C./second by sump control in the molten metal. The sump control in the molten metal is performed by controlling the aluminum coating thickness and using the rolling load. Such a casting process caused a casted ingot having a width of 130 mm, a length of 20000 mm, and a thickness of 7 mm to be obtained. Then, the obtained ingot sheet was subjected to cold rolling so as to be 0.7 μm. After intermediate annealing at 420° C. for 2 hours, cold rolling was performed so as to be 0.1 mm. After second annealing at 350° C. for 3 hours, rolling was performed at the final cold-rolling ratio of 30% so as to be 0.07 mm, and a result of rolling was used as a sample material.

During casting in the CC, a crystal particle pulverizing agent was put at the molten metal temperature of 680° C. to 750° C. At this time, the crystal particle pulverizing agent was continuously put into the molten metal flowing in a gutter at a constant rate by using a wire-like crystal particle pulverizing agent rod. The gutter links a molten metal holding furnace and the headbox right ahead of the hot-water supply nozzle. The crystal particle pulverizing agent adjusted an addition amount by using an Al-5Ti-1B alloy so as to be 0.002% in B amount conversion.

Particle distribution evaluation of the manufactured sheet material (element sheet) was performed similarly to in the first example. The measured number density of the Al—Fe—Mn—Si based intermetallic compound and the measured number density of the Si based intermetallic compound are represented in Table 9.

TABLE 9

| | | Particle distribution*1) of fin material (in core material) | | | | |
|---|---|---|---|---|---|---|
| | | Si based intermetallic compound (pieces/mm$^2$) | | Al—Fe—Mn—Si based intermetallic compound (pieces/mm$^2$) | | |
| No. | Configuration | 0.5 to 5 μm | greater than 5 μm and 10 μm or less | 0.01 μm or more and less than 0.5 μm *2) | 0.5 to 5 μm | greater than 5 μm and 10 μm or less |
| F31 | Bare | 2.0E+03 | 0.0E+00 | 3.6E+01 | 4.2E+03 | 2.8E+02 |
| F32 | Bare | 3.8E+04 | 1.0E+00 | 3.8E+02 | 2.4E+04 | 1.2E+00 |
| F33 | Bare | 1.7E+03 | 0.0E+00 | 3.9E+01 | 4.5E+03 | 2.9E+02 |
| F34 | Bare | 2.3E+03 | 0.0E+00 | 3.6E+01 | 4.1E+03 | 2.7E+02 |
| F35 | Bare | 2.5E+03 | 0.0E+00 | 5.7E+00 | 1.1E+03 | 9.8E+01 |
| F36 | Bare | 1.9E+03 | 4.2E+00 | 6.3E+01 | 5.3E+03 | 4.1E+02 |
| F37 | Bare | 2.7E+03 | 0.0E+00 | 2.8E+00 | 5.7E+02 | 8.1E+01 |
| F38 | Bare | 2.3E+03 | 6.7E+00 | 7.9E+01 | 5.7E+03 | 4.9E+02 |
| F39 | Bare | 1.8E+03 | 0.0E+00 | 3.5E+01 | 4.0E+03 | 2.7E+02 |
| F40 | Bare | 1.6E+03 | 0.0E+00 | 3.6E+01 | 4.2E+03 | 2.8E+02 |
| F41 | Bare | 3.0E+03 | 0.0E+00 | 3.0E+00 | 6.2E+02 | 8.8E+01 |
| F42 | Bare | 1.9E+03 | 9.8E+00 | 2.9E+02 | 9.4E+03 | 1.4E+03 |
| F43 | Bare | 2.9E+03 | 0.0E+00 | 1.7E+00 | 3.1E+02 | 8.0E+01 |

*1)regarding exponential indication, for example, 1.4E+03 represents $1.4 \times 10^3$.
*2): unit is (pieces/μm$^3$)

As the fin material, a fin material having a sheet thickness of 0.115 mm was subjected to corrugate processing and a corrugate fin material having a fin peak height of 8 mmm, a fin pitch of 3 mm, and a length of 400 mm was used. The same tube and the same header as those used in the first example were used.

These members were assembled so as to have the shape in FIG. 5 and the entirety was coated with fluoride flux from a surface. Then, heating and bonding was performed at a furnace of nitrogen atmosphere. When an assembly was heated, the highest temperature was set to 605° C. When the temperature of the assembly was equal to or higher than 400° C., oxygen concentration in the furnace was controlled so as to be equal to or less than 100 ppm, and the dew point was controlled so as to be equal to or lower than −40° C. A period of time when the members were held at a temperature of 600° C. to 605° C. was set to 3 minutes.

A heat exchanger manufactured in this manner was evaluated similarly to in the first example. Evaluation results are represented in Table 10.

TABLE 10

| No. | Fin | Tube | Header | Presence of region B around grain boundary | Presence of region A around region B | Average area S of region B around grain boundary (μm) | Area occupancy ratio a on surfaces of region A (%) | L (μm) | L/T (—) | Natural potential of fin (mV) | Natural potential of fin − natural potential of fillet (mV) | Hollow corrosion of fin | Leakage in tube |
|---|---|---|---|---|---|---|---|---|---|---|---|---|---|
| Example 32 | F31 | T3 | H1 | Presence | Presence | 5 | 90 | 700 | 11.0 | −855 | 65 | A | None |
| Example 33 | F32 | T3 | H1 | Presence | Presence | 3 | 97 | 450 | 16.4 | −850 | 70 | A | None |
| Example 34 | F33 | T3 | H1 | Presence | Presence | 1 | 100 | 300 | 2.9 | −700 | 220 | B | None |
| Example 35 | F34 | T2 | H1 | Presence | Presence | 6 | 86 | 600 | 6.3 | −840 | 10 | A | None |
| Example 36 | F35 | T2 | H1 | Presence | Presence | 14 | 62 | 850 | 29.7 | −800 | 50 | A | None |
| Example 37 | F36 | T2 | H1 | Presence | Presence | 3 | 97 | 150 | 3.2 | −795 | 55 | A | None |
| Example 38 | F37 | T2 | H1 | Presence | Presence | 25 | 58 | 110 | 2.5 | −795 | 55 | B | None |
| Example 39 | F38 | T2 | H1 | Presence | Presence | 3 | 99 | 80 | 1.2 | −775 | 75 | B | None |
| Example 40 | F39 | T2 | H1 | Presence | Presence | 5 | 90 | 430 | 8.6 | −995 | −145 | B | None |
| Comparative Example 41 | F40 | T3 | H1 | none | — | — | 88 | 735 | 8.9 | −700 | 220 | C | None |
| Comparative Example 42 | F41 | T3 | H1 | Presence | none | 29 | 12 | 190 | 2.8 | −835 | 85 | C | None |
| Comparative Example 43 | F42 | T3 | H1 | none | — | — | 100 | 140 | 3.6 | −705 | 215 | C | None |
| Comparative Example 44 | F43 | T3 | H1 | Presence | none | 54 | 22 | 110 | 2.3 | −700 | 220 | C | None |

In Examples 32 to 40, there was no leakage in the tube and an evaluation result of hollow corrosion of the fin after the corrosion test had B or higher. That is, the good result was obtained.

In Comparative Examples 41 to 44, there was no leakage in the tube, but hollow corrosion of the fin occurred significantly. The evaluation is C.

INDUSTRIAL APPLICABILITY

According to the present invention, a heat exchanger in which leakage of a working fluid does not occur for a long period of time under a high corrosion environment and degradation of cooling performance due to corrosion is suppressed is obtained. For example, the heat exchanger is appropriately used as a heat exchanger for a room air-conditioner or a heat exchanger for a car air-conditioner.

The invention claimed is:

1. A heat exchanger comprising:

an aluminum tube through which a working fluid circulates; and an aluminum fin which is bonded to the tube, wherein the aluminum fin has a region B around a grain boundary, and a region A around the region B, in the region B, $5.0\times10^4$ pieces/mm$^2$ less of Al—Fe—Mn—Si based intermetallic compound, each of which has equivalent circle diameters of 0.1 to 2.5 μm, are present, and in the region A, $5.0\times10^4$ pieces/mm$^2$ to $1.0\times10^7$ pieces/mm$^2$ of Al—Fe—Mn—Si based intermetallic compound, each of which has equivalent circle diameters of 0.1 to 2.5 μm, are present, an average area of the region B per a length of the grain boundary is set as s μm and satisfies $2<s<40$, an area occupancy ratio of the region A on a surface of the fin is equal to or more than 60%, the aluminum tube comprises a tube material comprising a 3000-series or 1000-series extruded perforated tube and having a Si content less than 1.0 mass %, the aluminum fin comprises a fin material having a heat bonding ability in a single layer, wherein the fin material comprises an aluminum alloy containing Si:1.0 mass % to 5.0 mass %, Fe:0.1 mass % to 2.0 mass %, Mn:0.1 mass % to 2.0 mass % with balance being Al and inevitable impurities, 250 pieces/mm$^2$ to $7\times10^4$ pieces/mm$^2$ of Si based intermetallic compound, each of which has equivalent circle diameters of 0.5 to 5 μm, are present, and 10 pieces/mm$^2$ to 1000 pieces/mm$^2$ of Al—Fe—Mn—Si based intermetallic compound, each of which has equivalent circle diameters of greater than 5 μm, are present, and an Al—Si eutectic structure is not on the surface of the aluminum tube other than a fillet at a bonding portion of the aluminum fin and the aluminum tube.

2. The heat exchanger according to claim 1, wherein when a grain size of an Al matrix in an L-LT cross-section of the fin is set as L μm, and a grain size of an Al matrix in an L-ST cross-section of the fin is set as T μm , $L\geq100$ and $L/T\geq2$.

3. The heat exchanger according to claim 1, wherein the aluminum alloy further contains one or more selected from among Mg:2.0 mass % or less, Cu:1.5 mass % or less, Zn:6.0 mass % or less, Ti:0.3 mass % or less, V:0.3 mass % or less, Zr:0.3 mass % or less, Cr:0.3 mass % or less and Ni:2.0 mass % or less.

4. The heat exchanger according to claim 1, wherein the fin comprises a fin material having a heat bonding ability in a single layer, wherein the fin material comprises an aluminum alloy containing Si:1.0 mass % to 5.0 mass % and Fe:0.01 mass % to 2.0 mass % with balance being Al and inevitable impurities including Mn, wherein 250 pieces/mm$^2$ to $7\times10^5$ pieces/mm$^2$ of Si based intermetallic compound, each of which has equivalent circle diameters of 0.5 to 5 μm, are present, and 100 pieces/mm$^2$ to $7\times10^5$ pieces/mm$^2$ of Al—Fe—Mn—Si based intermetallic compound, each of which has equivalent circle diameters of 0.5 to 5 μm, are present.

5. The heat exchanger according to claim 4, wherein the aluminum alloy further contains one or more selected from among Mn:2.0 mass % or less, Mg:2.0 mass % or less, Cu:1.5 mass % or less, Zn:6.0 mass % or less, Ti:0.3 mass % or less, V:0.3 mass % or less, Zr:0.3 mass % or less, Cr:0.3 mass % or less and 2.0 mass % or less of Ni.

6. The heat exchanger according to claim 1, wherein the fin comprises a fin material having a heat bonding ability in a single layer, wherein the fin material comprises an aluminum alloy containing Si:1.0 mass % to 5.0 mass % and Fe:0.01 mass % to 2.0 mass % with balance being Al and inevitable impurities including Mn, wherein 200 pieces/$mm^2$ less of Si based intermetallic compound, each of which has equivalent circle diameters of 5.0 to 10 μm, are present, and 10 pieces/$mm^2$ to $1\times10^4$ pieces/$\mu m^3$ of Al—Fe—Mn—Si based intermetallic compound, each of which has equivalent circle diameters of 0.01 to 0.5 μm, are present.

7. The heat exchanger according to claim 6, wherein the aluminum alloy further contains one or more selected from among Mn:0.05 mass % to 2.0 mass %, Mg:0.05 mass % to 2.0 mass %, Cu:0.05 mass % to 1.5 mass %, Zn:6.0 mass % or less, Ti:0.3 mass % or less, V:0.3 mass % or less, Zr:0.3 mass % or less, Cr:0.3 mass % or less and Ni:2.0 mass % or less.

8. The heat exchanger according to claim 1, wherein a natural potential of the fin is equal to or greater than −910 mV, and the natural potential of the fin is nobler than a natural potential of the fillet by 0 mV to 200 mV.

9. The heat exchanger according to claim 8, wherein relationships between natural potentials at the fin (Fin), a surface of the tube (TS), a core of the tube (TB), and the fillet (Fillet) satisfy the following expressions:

$$TS\text{-}Fillet \leq 200\ mV \quad (1),$$

$$Fillet \geq -950\ mV \quad (2),$$

$$TB\text{-}TS \geq 100\ mV \quad (3), \text{ and}$$

$$TS \geq -950\ mV \quad (4).$$

10. The heat exchanger according to claim 3, wherein the aluminum alloy further contains 0.3% or less of Sn, or 0.3% or less of In.

* * * * *